US006961971B2

(12) United States Patent
Schneider et al.

(10) Patent No.: US 6,961,971 B2
(45) Date of Patent: Nov. 8, 2005

(54) MOTOR ADJUSTABLE SUPPORT DEVICE FOR THE UPHOLSTERY OF A SEAT AND/OR RECLINING FURNITURE

(75) Inventors: Johannes Schneider, Kirchlengern (DE); Eckhart Dewert, Zürich (CH)

(73) Assignee: Cimosys AG, Goldingen (CH)

( * ) Notice: Subject to any disclaimer, the term of this patent is extended or adjusted under 35 U.S.C. 154(b) by 216 days.

(21) Appl. No.: 10/177,750

(22) Filed: Jun. 24, 2002

(65) Prior Publication Data

US 2003/0052238 A1 Mar. 20, 2003

Related U.S. Application Data

(63) Continuation of application No. PCT/EP00/13074, filed on Dec. 21, 2000.

(30) Foreign Application Priority Data

Dec. 23, 1999 (DE) ..... 299 22 669 U
Sep. 21, 2000 (DE) ..... 100 46 751

(51) Int. Cl.[7] ..... A47B 7/02
(52) U.S. Cl. ..... 5/618; 5/613; 5/616; 5/617
(58) Field of Search ..... 5/613, 616, 617, 5/618

(56) References Cited

U.S. PATENT DOCUMENTS

| | | | |
|---|---|---|---|
| 3,051,965 | A | 9/1962 | Szemplak et al. |
| 3,300,794 | A | 1/1967 | Altorfer |
| 3,717,376 | A | 2/1973 | Lutchansky |
| 3,868,103 | A | 2/1975 | Pageot et al. |
| 4,258,445 | A | 3/1981 | Zur |
| 4,336,621 | A | 6/1982 | Schwartz et al. |
| 4,349,924 | A | 9/1982 | Zur |
| 4,381,571 | A | 5/1983 | Elliott |
| 4,463,463 | A | 8/1984 | Kaneko |
| 4,559,656 | A | 12/1985 | Foster |

(Continued)

FOREIGN PATENT DOCUMENTS

| | | |
|---|---|---|
| CH | 607 682 | 10/1978 |
| DE | 32 182 78 A1 | 11/1983 |
| DE | 38 42 078 C2 | 7/1992 |
| DE | 195 00 185 A1 | 7/1996 |
| DE | 195 03 650 A1 | 8/1996 |
| DE | 195 42 321 A1 | 5/1997 |
| DE | 297 01 084 U1 | 7/1997 |

(Continued)

OTHER PUBLICATIONS

Internationaler Recherchenbericht (PCT) Artikel 18 sowie Regeln 43 und 44 PCT, Inernationales Anmeldedatum Dec. 21, 2000, Internationales Aktenzeichen PCT/EP 00/13082 (4 pp.).

PCT Schriftlicher Bescheid (Regel 66 PCT) dated Dec. 21, 2000 (6 pp.).

*Primary Examiner*—Teri Pham Luu
(74) *Attorney, Agent, or Firm*—Shlesinger, Arkwright & Garvey LLP

(57) ABSTRACT

Motor adjustable support device for the upholstery of a seat and/or of reclining furniture, especially suited for a bed mattress, including a base body having rails, and one adjustable support element adjustable relative to the base body. An adjusting device for the adjustment of the support device relative to the base body may be provided. One of the rails may be hollow or open on one side for receiving part of the adjusting device. The one adjustable element can be adjusted between a first adjustment position and a second adjustment position and that interacts with the support element, and that is received in the first adjustment position in a rail, or as viewed in a side view, for example, within the bounds of the rail, and that protrudes in the second adjustment position over the rail toward the support side.

84 Claims, 53 Drawing Sheets

U.S. PATENT DOCUMENTS

| | | | |
|---|---|---|---|
| 4,589,151 | A | 5/1986 | Behrens |
| 4,800,599 | A | 1/1989 | Korchinski et al. |
| 4,928,332 | A | 5/1990 | Ogden et al. |
| 5,063,623 | A | 11/1991 | Bathrick et al. |
| 5,490,298 | A | 2/1996 | Goldsmith et al. |
| 5,491,854 | A | 2/1996 | Music |
| 5,537,701 | A | 7/1996 | Elliott |
| 5,542,744 | A | 8/1996 | Bathrick |
| 5,544,376 | A | 8/1996 | Fromson |
| 5,577,280 | A | 11/1996 | Elliott |
| 5,640,730 | A | 6/1997 | Godette |
| 5,675,849 | A | 10/1997 | Koch |
| 5,687,437 | A | 11/1997 | Goldsmith |
| 5,740,568 | A | 4/1998 | Elliott |
| 5,870,784 | A | 2/1999 | Elliott |
| 5,916,086 | A | 6/1999 | Rossdeutscher |
| 5,926,872 | A | 7/1999 | Rossdeutscher |
| 5,926,877 | A | 7/1999 | Lin |
| 6,006,379 | A | 12/1999 | Hensley |
| 6,061,852 | A | 5/2000 | Bathrick et al. |
| 6,079,065 | A | 6/2000 | Luff et al. |
| 6,088,853 | A | 7/2000 | Jansen |
| 6,101,647 | A | 8/2000 | Stroud et al. |
| 6,105,187 | A | 8/2000 | Gnjatovic |
| 6,209,157 | B1 | 4/2001 | Hensley |
| 6,269,707 | B1 | 8/2001 | Koch |
| 6,311,348 | B1 | 11/2001 | Luff et al. |
| 6,393,641 | B1 | 5/2002 | Hensley |
| 6,679,555 | B2 | 1/2004 | Bangert |
| 6,687,932 | B1 | 2/2004 | Bangert et al. |
| 2001/0000828 | A1 | 5/2001 | Hensley |
| 2002/0152552 | A1 | 10/2002 | Dewert |
| 2002/0162170 | A1 | 11/2002 | Dewert |
| 2003/0079290 | A1 | 5/2003 | Dewert |
| 2003/0106154 | A1 | 6/2003 | Takeuchi |
| 2003/0208845 | A1 | 11/2003 | Heaton |
| 2004/0034934 | A1 | 2/2004 | Weinman et al. |

FOREIGN PATENT DOCUMENTS

| | | | |
|---|---|---|---|
| DE | 299 07 850 | U1 | 10/1999 |
| DE | 200 00 700 | U1 | 5/2000 |
| EP | 0 373 912 | | 6/1990 |
| EP | 0 372 032 | B1 | 5/1992 |
| EP | 0 568 957 | A1 | 11/1993 |
| EP | 0 583 660 | A1 | 2/1994 |
| EP | 0 721 754 | A1 | 7/1996 |
| EP | 0 873 709 | A1 | 10/1998 |
| EP | 0 884 011 | A1 | 12/1998 |
| EP | 0 935 937 | A1 | 8/1999 |
| WO | 91/01099 | | 2/1991 |
| WO | 92/09520 | | 6/1992 |
| WO | 99/42021 | | 8/1999 |

f 2

MOTOR ADJUSTABLE SUPPORT DEVICE FOR THE UPHOLSTERY OF A SEAT AND/OR RECLINING FURNITURE

CROSS REFERENCE TO RELATED APPLICATIONS

This application is a continuation of Application No. PCT/EP00/13074, filed Dec. 21, 2000, which claims the priority of both German Application No. 100 46 751.2, filed Sep. 21, 2000 and German Application No. 299 22 669.7, filed Dec. 23, 1999, and each of which is incorporated herein by reference.

This application relates to Assignee's concurrently filed application entitled "MOTOR-DRIVEN, ADJUSTABLE SUPPORTING DEVICE FOR THE UPHOLSTERY OF SEATING AND/OR RECLINING FURNITURE, FOR EXAMPLE OF A MATTRESS OR A BED" (Ref. No. 7218) and Assignee's concurrently filed application entitled "ADJUSTABLE PADDING DEVICE FOR A PIECE OF FURNITURE USED FOR SITTING AND/OR LYING UPON" (Ref. No. 7219).

FIELD OF THE INVENTION

The invention relates to a motor adjustable support device for the upholstery of a seat and/or of reclining furniture, especially for a bed mattress.

BACKGROUND OF THE INVENTION

Such support devices are generally known, such as in the form of motor adjustable slats for beds or recliners.

A motor adjustable support device is known from EP 0 583 660 B1 that has a base body, as well as support elements that can be adjusted relative to the base body. In particular, the support device known from this printed publication has a central supporting element including ends to which a head support element and a leg support element are pivotably linked to each other at a pivot axis parallel to each other. In order to adjust the head support element and the leg support element relative to the base body, the known support device has an adjusting device that possesses two adjustment motors, of which one each is assigned to the head support element for the adjustment of the same, and one is assigned to the leg support element for the adjustment of the same. The adjusting device is arranged in a housing below the support device. One disadvantage of the support device known from the printed publication is that it has a substantial height essentially larger than the height of a commonly known slat system that can be adjusted by hand. Another disadvantage of this known support device is that it appears rather bulky, and requires substantial room for receiving the housing of the adjusting device below the base body.

A similar adjusting device intended for assembly below the actual support device is known from EP 0 372 032 D1.

A motor adjustable support device of the referenced type is known from DE 38 42 078 C2, which has a base body equipped with rails. This known support device further has support elements that are adjustable relative to the base body, as well as an adjusting device for the adjustment of the adjusting elements relative to the base body that are received in a housing below the rails. The support device designed as a slat system that is known from this printed publication has the disadvantage that it has a great height which is substantially larger than the height of commonly known slat systems that can be adjusted by hand. Another disadvantage of the known support device is that it appears rather bulky, and requires substantial room for receiving the housing of the adjusting device below the base body.

The invention is based on the object of providing a motor adjustable support device that is lower in height than known devices having a base and rails.

This object is achieved by the provision of the inventive motor adjustable support device for the upholstery of a seat and/or of reclining furniture, especially suited for a bed mattress, including a base body that has rails, and at least one adjustable support element adjustable relative to the base body. An adjusting device for the adjustment of the support device relative to the base body may be provided. At least one of the rails may be hollow or open on one side for receiving at least part of the adjusting device. The adjusting device may have at least one adjustable element that can be adjusted in a first adjustment position and a second adjustment position and that interacts with the support element to be adjusted, and that is received in a first adjustment position in a rail, or as viewed in a side view, for example, within the bounds of the rail, and that protrudes in a second adjustment position over the rail toward the support side.

The invention is achieved by the idea of arranging the adjusting device below the actual base body. This teaching immediately above is based on the idea of at least partially receiving the elements of the adjusting device in one of the rails, or in several rails of the base body. According to the inventive teaching, the rails are hollow, or at least open on one side. This creates a cavity in the rails, into which the elements of the adjusting device can be received.

This substantially reduces the height of the support device. Due to the inventive embodiment, the support device can have a height that is not, or is insignificantly larger than the height of a commonly known slat system that can be adjusted by hand.

Another advantage of the inventive support device is that no room is required below the support device for receiving the elements of the adjusting device so that, for instance, in the case of a bed, the remaining room below the support device may be utilized for storage without limitations.

Due to the reception of the elements of the adjusting device in the rails, these elements are covered from the sight of the user so that the inventive support device does not visually differ, or insignificantly visually differs from a commonly known support system that can be adjusted by hand, such as in the form of a slat system. Once all elements of the adjusting device have been received by the rails, which is possible without great effort in a respective embodiment of the rails, none of the elements protrude over the base body at an adjustment position in which the support elements of the support device are not adjusted relative to the base body. This prevents a user of the support device from reaching into the adjustment mechanism, and therefore prevents injury.

Another advantage of the inventive support device is that the elements of the adjusting device received by the rails are protected from damage and soiling.

Additionally, the transport of the inventive support devices is easy, as these may be stacked without any problems. When stacking several inventive support devices, the elements of the adjusting device received by the rails are reliably protected from damage.

The inventive support device may be part of a so-called futon bed so that the teaching according to the invention also makes use of a motor adjustment for such futon beds.

Another advantage of the inventive teaching is that the inventive support device is such that the inventive support device is functional even without a subbase, such as without a bed frame. This simplifies the presentation of the function of the inventive support device, such as in retail stores, or department stores, which may be laid flat on the floor for this purpose, and then presented in its function.

Another inventive solution teaches that at least one adjustment motor of the adjusting device is arranged adjacent a rail at a side view inside of the rails' bounds or visual extent. The teaching also enables a low height that is not, or is larger than the height of a commonly known support device that can be adjusted by hand so that the support device essentially has the same advantages as the support device set forth above.

In a support device according to of the type set forth above, additional elements of the adjusting device, or all elements of the adjusting device are preferably arranged on the base body so that they, at least in a first adjustment position, in which the support elements of the support device are not adjusted relative to each other, in a side view, are received within the limits of the base body.

A further development of the teachings set forth above may include that at least one of the rails is designed, at least in section, as an open hollow profile toward one side of the support device. This embodiment is particularly simple, and can therefore be produced at low cost. With respective dimensioning of the hollow profile, all elements of the support device can be received by the rail, or the rails.

Another development of the teachings set forth above may include that at least one of the rails, at least at a section, is designed as a closed hollow profile. This embodiment results in a particularly high stability. Further, the elements of the furniture drive received in the closed hollow profile, such as the adjustment motor, are especially safely protected from damage.

An adjustment mechanism of the adjusting device can be selected among a large range according to the respective requirements. An advantageous embodiment provides that the adjusting device has at least one adjustable adjusting element between the first adjustment position, and a second adjustment position that interacts with the support element to be adjusted, and is received in a first adjustment position by a rail, or in a side view, within the limitations of the rail, and in a second adjustment position protrudes over the rail toward the support side. In this embodiment, the adjusting element does not protrude over the rail in its first adjustment position, in which, for instance, the support elements are not adjusted relative to each other, and in which they are chucking a continuous support level.

A further development of the previously mentioned embodiment provides that the rail has a recess on the support side, through which the adjusting element protrudes toward the support side in a second adjustment position. The stability of the hollow profile is affected only at a low degree by the recess so that the inventive support device generally has a high stability. If the support device has several adjusting elements that are received in the rail, or rails, a recess is assigned to each adjusting element, through which is protrudes toward the support side in a second adjustment position.

The adjusting element can be designed in any suitable way, such as an adjusting element that can be moved linear out from the rail. Usefully, the adjusting element is an adjustment lever.

A further development of the previously mentioned embodiment provides that the adjustment lever is a pivot lever that is pivotably linked toward the support side. This embodiment of the pivotably linked elements enables a large pivot angle with a compact construction at the same time.

In a embodiment according of the type set forth above, individual elements, or all elements of the support device may be received by the rail, or the rails. Usefully, at least one adjustment motor of the adjusting device is received in a rail as is intended in one embodiment. In this embodiment, the adjustment motor, or adjustment motors, is protected from damage and soiling due to the arrangement in the rail.

The adjusting device may have any suitable drive element according to the respective requirements. Usefully, the adjusting device has at least one drive element with linear back and forth movement.

A further development of the previously mentioned embodiment provides that the linear movable drive element interacts with the adjusting element for the adjustment of the same, and that means are intended, which convert the back and forth movement of the drive element into a movement of the adjusting element between its adjustment positions. In this embodiment, corresponding to the respective requirements, the means which convert a back and forth movement of the drive element into a movement of the adjusting element between its adjustment positions, can work according to any suitable kinematics. These means are preferably arranged in the rails, or in side view, within the limitations of the rails.

In the embodiment with the pivot lever and the drive element with linear back and forth movement, a further embodiment provides that the back and forth movement of the drive element is converted into a pivot movement of the pivot lever between its adjustment positions. This embodiment unites the advantages of an adjustment by means of a pivot lever with the advantages of a drive element with linear back and forth movement. These means are preferably arranged in the rails, or in side view, within the limitations of the rail.

In the previously mentioned embodiment, the pivot lever can be pivotably linked to the drive element with linear back and forth movement, as is intended by a further development.

Another development of the embodiment with the drive element with linear back and forth movement provides that it is arranged in one of the rails, or in side view, within the limitations of the rail. In this embodiment, the drive element does not increase the height of the support device. In an arrangement of the drive element in one of the rails, the drive element is also protected from damage and soiling.

An extraordinarily advantageous further development of the embodiment with the adjusting element that is adjustable between a first and a second adjustment position provides that the adjustment direction has an actuator that moves relative to the adjusting element, and that the adjusting element has an abutting face for abutting onto the actuator, whereby the actuator moves along the abutting face of the adjusting element during the adjustment movement, and thereby adjusts the adjusting element between its first adjustment position and its second adjustment position. This embodiment enables a compact construction. Further, it can easily be produced, is low in production costs, and is also robust. The base principle of this embodiment can also be used in common support devices, in which the adjusting device is arranged below the base body. Based on the invention, a relative movement between the adjusting element and the actuator means that the adjusting element is locally fixed, and the actuator is movable, or that the actuator is locally fixed, and the adjusting element is movable, or that both the adjusting element and the actuator are movable.

A purposeful further development of the previously mentioned embodiment provides that the actuator moves linear relative to the adjusting element, and that the abutting face of the adjusting element is tilted relative to the movement axis of the actuator. This embodiment enables a large adjustment stroke simultaneously with a compact construction. By correspondingly selecting the tilt of the abutting face of the adjusting element relative to the movement axis of the actuator, the adjustment stroke, which the adjusting element performs with a linear movement of the actuator by a certain travel, is selectable from a wide range. In this embodiment, the abutting face can also be designed on the actuator, for instance, in the shape of a tilted level at an actuator designed in a wedge or ramp shape.

The abutting face of the adjusting element in the previously mentioned embodiment can be a surface that is essentially level. For instance, the abutting face can interact with the actuator in the way of a tilted level.

The abutting face of the adjusting element, however, may also be designed bow-shaped in a cross section, as another further development provides. In this embodiment, the adjustment stroke can be different in a linear movement of the actuator by the same travel in various phases of the adjustment movement. This enables a wide range of adjustments of the kinematics of the adjusting device to the respective requirements.

In the previously mentioned embodiments, the abutting face preferably forms an acute angle with the movement axis of the actuator. If the abutting face is constructed bow-shaped at the cross section, the end points of the bow-shaped cross section preferably form an acute angle to the movement axis.

A further development of the previously mentioned embodiment provides that the abutting face is constructed convex to the actuator in the cross section.

Another development provides that the actuator is arranged in one of the rails, or in side view, within the limitations of the rail. In this embodiment, the actuator does not protrude over the base body so that a compact construction is achieved. With the arrangement of the actuator in one of the rails, it is also protected from damage and soiling.

Another extraordinarily advantageous further development of the embodiment with the pivot lever provides that an angle-movable actuator is arranged between the pivot lever and the base body, or a part connected to it, or between the pivot lever and the drive element, or a part connected to it, respectively, which will interact with the stop unit during the course of the adjustment movement for the pivot action of the pivot lever. This embodiment also enables a compact construction. Furthermore, it can easily be produced, and is therefore low in cost, and is also robust. The base principle of this embodiment may also be used in common support devices, in which the adjusting device is arranged below the base body.

According to the respective requirements, the angle-movable actuator can be stressed on pull and/or pressure, as is intended by a further development.

Corresponding to the respective kinematics, the angle-movable actuator can be designed in many ways. Usefully, however, the actuator is designed as a lever or rod.

A further advantageous development of the embodiment with the angle-movable actuator provides that it is received in one of the rails, or in side view, within the limitations of the rail, at least in the first adjustment position of the pivot lever. In this embodiment, the angle-movable actuator does not protrude over the base body in the first adjustment position so that a compact construction is achieved. When receiving the angle-movable actuator in the rail, it is protected from damage at least in the first adjustment position.

A further development of the embodiment with the angle-movable actuator provides that the pivot lever is pivotably linked to the base body, or to a part connected to it, that a first end of the actuator is pivotably linked to the pivot lever around a pivot axis parallel and at a distance to the pivot axis of the pivot lever, and that a stop unit is constructed at the linear movable drive element, or at a part connected to it, which abuts a second end of the actuator during the course of the adjustment movement in such a way, that the actuator pivots around its second end during the further course of the adjustment movement, and the pivot lever thereby pivots around its pivot axis. This embodiment also enables a compact construction and requires only a few elements. It is therefore easy to produce and low in cost, and also robust in its construction.

A further development of the embodiment with the angle-movable actuator provides that the pivot lever is pivotably linked to the base body, or to a part connected to it, that a first end of the actuator is pivotably linked to the drive element around a pivot axis parallel and at a distance to the pivot axis of the pivot lever, and that a second end of the actuator is fed at a guide relative to the pivot lever that is movable, whereby a stop unit is arranged at one end of the guide onto which the actuator abuts with its second end during the course of the adjustment movement in such a way, that the actuator pivots around the pivot axis assigned to it and the pivot lever thereby pivots around the pivot axis that is assigned to it. This embodiment has the same advantages as those in the previously mentioned embodiment.

Another development of the embodiment with the angle-movable actuator provides that the pivot lever is pivotably linked to the drive element, or to a part connected to it, that a first end of the actuator is pivotably linked to the base body, or a part connected to it, around a pivot axis parallel and at a distance to the pivot axis of the pivot lever, and that a second end of the actuator is movably fed at a guide relative to the pivot lever, whereby a stop unit is arranged at one end of the guide, onto which the actuator abuts with its second end during the course of the adjustment movement in such a way, that the actuator in the further course of the adjustment movement pivots around the pivot axis assigned to it, and the pivot lever thereby pivots around the pivot axis that is assigned to it. This embodiment has the same advantages of those of the two previously mentioned embodiments.

Another development of the embodiment with the angle-movable actuator provides that the pivot lever is linked to the linear movable drive element, or to a part connected to it, that a first end of the actuator is pivotably linked to the pivot lever around a pivot axis parallel and at a distance to the pivot axis of the pivot lever, and that a stop unit is arranged at the base body, onto which a second end of the actuator abuts during the course of the adjustment movement in such a way, that the actuator pivots around its second end during the further course of the adjustment movement, and the pivot lever thereby pivots around its pivot axis. This embodiment has the same advantages as those of the three previously mentioned embodiments.

In the previously mentioned embodiment including a guide, the guide can be constructed in any suitable way. Usefully, the guide is an extended recess, into which the actuator engages with a side protrusion, such as a pin or a roll. This embodiment is easy to produce, and therefore low in cost, as well as robust.

Usefully, in the previously mentioned embodiment, the longitudinal axis of the recess runs toward the movement axis of the linear movable drive element at an acute angle, as is intended in one of the embodiments.

The recess forming the guide may be constructed in any suitable way corresponding to the respective kinematics required. Usefully, the recess is straight. This simplifies the creation of the recess at the pivot lever, and therefore simplifies the production.

In the previously mentioned embodiment, the recess is usefully a groove or a slot.

The form of the pivot lever can be selected from a large range according to the respective requirements. Usefully, the pivot lever is constructed as an angle lever, or as a bow-shaped lever, as a further development provides. This creates particularly favorable kinematics.

Another, extraordinarily advantageous further development of the teaching of claim 1 provides that at least a first rail of the base body, and a second rail of the base body, at least in an area of their ends facing each other, is hollow, that a drive element is arranged in the first rail, that a rope, ribbon, or chain-shaped pull means is intended, the first end of which is fixed on one of the rails, or on a part connected to it, and which interacts with the drive element arranged in the first rail for the adjustment of the rails relative to each other, whereby the pull means is fed like a pulley successively by at least one turn that is assigned to the first rail, and at least one turn that is assigned to the second rail. In this embodiment, all elements of the adjusting device can be received by the hollow rails so that they are protected from damage and soiling, and are not visible to the user. Due to the use of the coefficient principle of a pulley, smaller, and therefore less expensive adjustment motors can exert high forces with such an adjusting device. A particular advantage of this embodiment is that the elements of the adjusting device can be accommodated in the smallest of spaces so that a particularly compact construction can be achieved.

A further development of the previously mentioned embodiment provides that the drive element is a linear movable drive element, with which the second end of the pull means forms a connection. A particularly simple construction is achieved in this way, because linear movable drive elements, such as spindle drive, are available as simple and low cost standard elements.

The second end of the pull means can be fixed to one of the elements of the adjusting device in any suitable way. Usefully, however, the second end of the pull means is fixed on the drive element. This further simplifies the construction.

Another development of the embodiment with the hollow rails provides that the drive element is a pivot driven angle element for coiling of the pull means, at which the second end of the pull means is fixed. This embodiment is also compact and simple, and can therefore be produced at low cost.

The first end of the pull means can be fixed to a element of the support device in any suitable way. Usefully, the first end of the pull means is fixed to the second rail, particularly to an interior wall of the second rail.

A further development of the embodiment with the linear movable drive element and the pull means provides that the linear movable drive element is designed as a pull means, and exerts a pull force onto the pull means for the adjustment of the second rail relative to the first rail. The construction is further simplified in this embodiment.

It is generally sufficient that the pull means is fed successively by a turn assigned to the first rail, and by a turn assigned to the second rail like a 2-rope pulley. However, an extraordinarily advantageous further development provides that the pull means is fed by a turn assigned to the first rail, and a turn assigned to the second rail like a 4-rope pulley. This embodiment achieves especially high forces. The first rail can be adjustable relative to the second rail in any suitable way, for instance, linear adjustable.

Usefully, the second rail can be pivoted relative to the first rail in such a way that the adjusting device forms a pivoting drive. This embodiment is especially suitable for slat systems with support elements that can be pivoted relative to each other.

Another purposeful development provides that a turn that is assigned to one of the rails, is arranged at this rail, especially at an interior wall of the rail. Because the turns are arranged at the rails, the construction is further simplified in this embodiment, as separate elements connected to the elements for retaining the turns are not required.

A turn that is assigned to one of the rails, however, may also be arranged on an intermediate element that forms a force transmission connection to this rail, as is intended by another embodiment.

Another advantageous development of a embodiment that works like a pulley provides that the turns are designed by turning rollers. In this embodiment, the friction is reduced at the turns so that any loss of force due to friction is reduced.

Usefully, the turns are received by the rails. They are therefore protected from damage, and are not visible from the exterior.

Another advantageous development of the embodiment with the hollow rails provides that at least one turn that is assigned to one of the hollow rails is constructed of an axis, or is arranged on an axis, which extends through the interior of the rail by means of a recess running through the recess constructed in the other rail, in the direction of the adjustment. In this way, the turns can be arranged relative to the drive element in any suitable way, such as a winding element, without regard of the rail form.

A further development of the embodiment with the pivoting connection between the rails and the recesses through which the turns extend provides that the recesses run across the pivoting axis in a radius.

In the embodiments with the linear movable drive element, this can be constructed in any suitable way. A further development provides that the linear movable drive element is a spindle nut arranged on a pivot proof fixed spindle that is movable in axial direction. Such spindle drives are available as simple and low cost standard elements so that the production of an inventive support device is further simplified and is lower in cost to produce.

In kinematic reverse of the previously mentioned embodiment, the linear movable drive element can also be a fixed spindle that is movable in its axial direction, that is arranged on a locally fixed, pivot driven spindle nut.

The fixed spindle in the previously mentioned embodiment is usefully a threaded spindle, whereby the spindle nut has a female thread. Such threaded spindles are easily produced, and are therefore low in cost, as well as robust.

Usefully, the adjusting device has at least one electric motor as the adjustment motor. Electric motors are available in compact constructions, as simple and low cost standard elements. This further simplifies the production of the inventive support device, and makes it low in cost.

The form, size and amount of the support elements relative to the base body can also be selected from a wide range. Usefully, the support device has at least a first support element, and a second support element for the plane support of the upholstery, whereby the first support element and the second support element are linked with each other, and can be pivoted relative to each other by means of the adjusting device. This embodiment enables a pivoting adjustment of the support elements relative to the base body, as is generally known, for instance, in slat systems.

A further development of the previously mentioned embodiment provides that the first support element is constructed of a center support element, and the second support element is constructed of the upper body support element, and that a leg support element is intended, which is linked with the central supporting element on its side opposite of the upper body support element, and pivots around a pivot axis that is essentially parallel to the pivot axis of the upper body support element. In this embodiment, the adjustment possibilities of the support device are further expanded.

Other developments of the previously mentioned embodiment provide that a head support element is intended, which is pivotably linked to the upper body support element on its side opposite of the upper body support element, and pivots around a pivot axis that is essentially parallel to the pivot axis between the central supporting element and the upper body support element, and/or that a lower leg support element is intended, which is pivotably linked to the leg support element on its side opposite of the leg support element, and pivots around a pivot axis that is essentially parallel to the pivot axis between the central supporting element and the leg support element. In these embodiments, the adjustment possibilities are even greater.

Another development of the embodiment with the adjusting element provides that the support element to be adjusted is loosely positioned on an adjusting element assigned to this support element. In this embodiment, for instance, the adjusting element can move along the support elements in a gliding motion with its end facing the opposite side of the support element. In this embodiment, the contact between the adjusting element and the assigned support element is maintained during the entire adjustment movement by means of the support element's dead weight.

Another extraordinarily advantageous development of the inventive teaching provides that the adjusting device has at least two adjustment devices, whereby each adjusting device is assigned to a support element for the adjustment of the same, and that mechanical linking means are intended that couple a movement of a element of the first adjusting device in such a way with the movement of a element of the second adjusting device that an adjustment movement of the first adjusting device for the adjustment of the assigned support element is linked mechanically to an adjustment movement of the second adjusting device for the adjustment of the assigned support element. This embodiment requires only one drive with one of the adjusting devices, such as an electric motor. The other adjusting device is driven by means of the mechanical linking means. In this way, the construction of the inventive support device is further simplified, and therefore low in cost. This embodiment is particularly advantageous when the adjustment device has a multitude of adjusting devices, only a part of which need to be equipped with a drive, such as an electric motor, while the other adjusting devices are driven by linking means.

A further development of the previously mentioned embodiment provides that the linking means have at least one linking element that couples a turn of the element of the first adjusting device to a turn of the element of the second adjusting device, in particular, which torque proof links the element of the first adjusting device to the element of the second adjusting device. With this embodiment, for instance, a drive, such as an electric motor, can be assigned to a first pivot lever received in a first longitudinal rail of the base body, while a respective second pivot lever received in a second longitudinal rail is torque proof linked to the first pivot lever so that when the first pivot lever is pivoted, the second pivot lever also pivots.

The linking element in the previously mentioned embodiment is preferably a shaft, as is intended in a embodiment.

Another development of the embodiment with linking means provides that the linking means essentially have a linking element that links the element of the first adjusting device slide proof to the element of the second adjusting device. In this embodiment, for instance, a linear movable drive element can be arranged in the first longitudinal rail, such as a spindle nut of a spindle drive, the linear movement of which is transferred via the linking element to a element of the second adjusting device received by a second longitudinal rail so that a spindle drive as the linear drive of the second adjusting device is not necessary.

In the previously mentioned embodiment, the linking element is preferably constructed in rod shape or disk shape. This achieves a simple and low cost construction.

Another development of the embodiment with linking means provides that the first adjusting device, and the second adjusting device are assigned the same support element. In this embodiment, for instance, both adjusting devices can be received by different longitudinal rails of the base body, and may together serve for the adjustment of the support element.

Another development provides that the first adjusting device and the second adjusting device are assigned to different support elements. In this embodiment, for instance, the first adjusting device can be assigned to the lower leg support element, and the second adjusting device can be assigned to the leg support element so that the adjustment movement of the leg support element is linked with the adjustment movement of the lower leg support element.

According to a further development, if the first adjusting device and the second adjusting device are assigned to different support elements, the linking means can be designed in such a way that the adjustment of that support element to which the first adjusting device was assigned, occurs at essentially the same time as the adjustment of that support element, to which the second adjusting device was assigned.

The linking means, however, can also be designed in such a way that the adjustment of that support element, to which the second adjusting device was assigned, occurs at a lateral to the adjustment of that support element, to which the first adjusting device was assigned. In this embodiment, the support elements are adjusted successively timed.

An extraordinarily advantageous development of the embodiment with linking means provides that the linking means are arranged in one of the rails, or in side view, within the limitations of the rails. In these embodiments, the linking means do not protrude over the rails, and therefore do not increase the height of the support device.

The shape and construction of the base body can be selected from a wide range. Usefully, the base body is constructed as a frame, as is intended in a further development.

According to another embodiment, the base body has at least two longitudinal rails that are parallel to each other, and are at a distance from one another, which are connected to each other by at least one cross rail. This embodiment achieves a simple, yet at the same time robust construction of the base body.

Generally, the elements of the adjusting device can be received by any of the rails. According to a further development, however, at least one of the longitudinal rails is constructed for receiving elements of the adjusting device. This embodiment is advantageous, because longitudinal rails usually provide more room for receiving elements of the adjusting device, than cross rails do.

Another purposeful development provides that the support device is constructed as a slat system. In this embodiment, the support device provides a spring comfort, as is generally known from slat systems.

Another development of the embodiment with the pivoting connected support elements provides that an adjustment arrangement that has a dead point for pivoting of the support elements relative to each other is assigned to two neighboring support elements that pivot relative to each other, and that actuator means are intended that move the adjustment arrangement beyond its dead point into a stable adjustment position for pivoting the support elements relative to each other, in which a reverse position of the support elements relative to each other into the base position is prevented. In this embodiment, the moving of the adjustment arrangement beyond its dead point suffices for the adjustment of the support elements relative to each other. In the then achieved position, a self-stoppage is achieved due to which a reverse position of the support elements relative to each other is prevented. The base principle of this embodiment can also be used in common support devices, in which the adjusting device is arranged below the base body.

A simple, and therefore low cost embodiment of the base principle of the previously mentioned embodiment provides that the adjustment arrangement has a knee lever, one lever arm of which is articulated on the first support element, and the other arm of which is articulated on the second support element.

In the previously mentioned embodiment, the stable adjustment position is Usefully an adjustment position, in which the support elements are pivoted relative to each other.

A further development of the embodiment with the knee lever provides that one of the lever arms of the knee lever is pivot proof connected to an actuator lever, whereby the free end of the angle lever, or of the actuator lever, can be moved back and forth for the operation of the adjustment arrangement. This embodiment is also particularly simple in construction.

Another development of the embodiment with the adjustment arrangement having a dead point provides that the adjustment arrangement has an eccentric, which is eccentrically pivotably linked to one of the support elements, and onto which the other support element abuts in such a way that the support elements pivot relative to each other by a turn of the eccentric. This embodiment also enables a pivoting of the support elements relative to each other by means of a simple, and therefore low cost adjustment arrangement, whereby a reverse position of the support elements relative to each other is prevented due to the self-stoppage of the eccentric in the stable adjustment position. By correspondingly choosing the form and eccentricity of the eccentric, a self-stoppage can be achieved across an additional adjustment area of the support elements relative to each other, and a reverse position is therefore prevented.

A further development of the previously mentioned embodiment provides that an actuator that is pivot proof linked to the eccentric is intended for the pivoting of the eccentric around its pivot axis, the free end of which can be moved back and forth for the pivoting of the eccentric. The adjustment arrangement in this embodiment has only a few elements, and can therefore be easily produced at low cost.

In the embodiments with the angle lever, or the actuator lever, respectively, a drive element for moving its free end back and forth is usefully assigned to its free end.

A particularly simple construction is achieved in the previously mentioned embodiment in that the linear movable drive element, or a part connected to it, has a guide that essentially extends lateral to the linear movement axis of the drive element, and into which the free end of the angle lever, or of the actuator lever, respectively, engages in at least one adjustment position.

Another development of the embodiment with the angle lever, or the actuator lever, respectively, and the drive element that can be moved back and forth provides that the rail, into which the linear movable drive element is received, has a recess, through which the free end of the angle lever, or of the actuator lever, respectively, extends in at least one adjustment position for the interaction with the guide.

A seat and/or reclining furniture, especially a bed that is equipped with the inventive support device, may be provided in accordance with any of the embodiments.

The invention is explained in further detail by means of the attached, strongly schematical drawings, in which the embodiments are illustrated in detail.

Relative terms such as up, down, left, and right are for convenience only and are not intended to be limiting.

DETAILED DESCRIPTION

Figure 1:
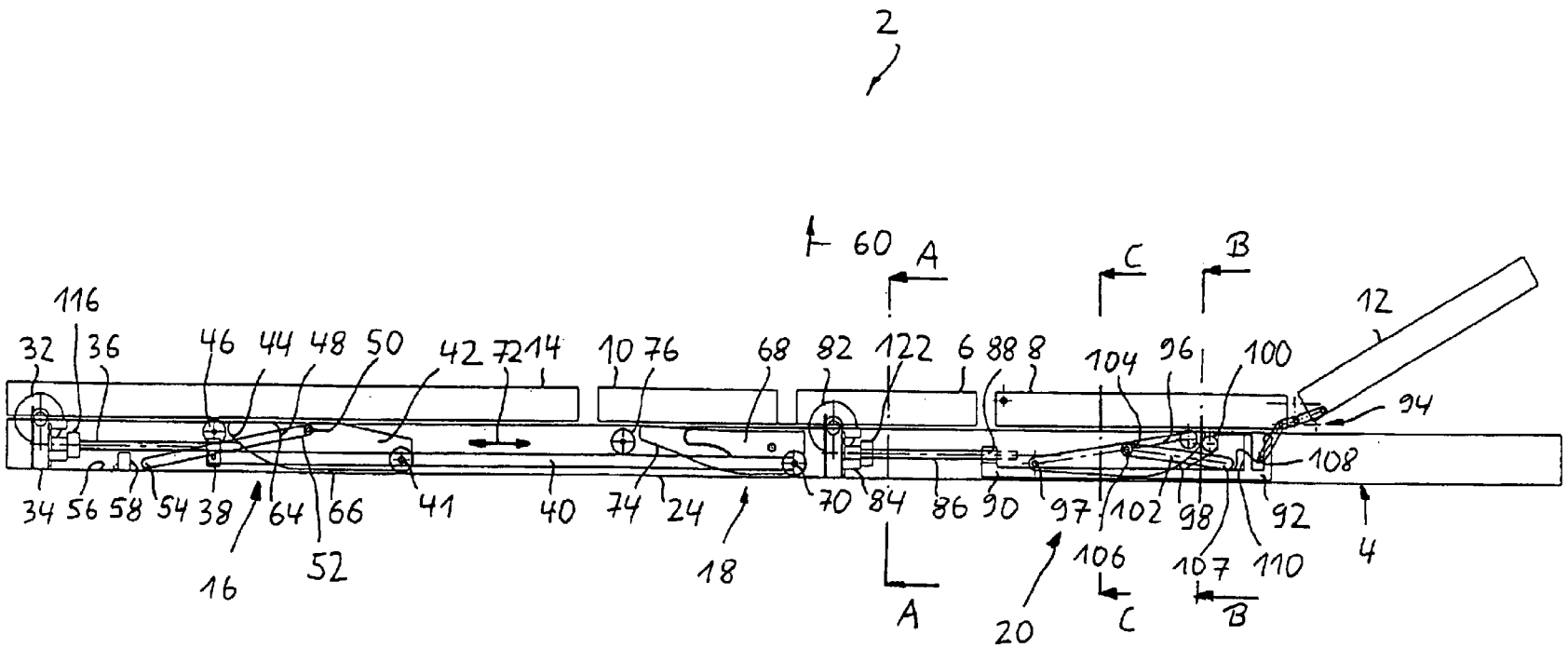
FIG. 1 shows a side view of a embodiment of an inventive support device in a first adjustment position, whereby a wall of a longitudinal rail of the base body facing the viewer of FIG. 1 has been omitted for illustration purposes, so that the elements of the adjusting device received by the longitudinal rail can be recognized.

FIG. 1 shows a first embodiment of an inventive motor adjustable supporting device 2 for the upholstery, not illustrated in the drawing, of a seat and/or of a piece of reclining furniture or reclining furniture, which may be used for a bed mattress, which is constructed as a slat system. The supporting device 2 has a frame-like base body 4, which in the following is explained in more detail by FIG. 2. The supporting device 2 further has several support elements that are adjusted relative to the base body, which serve for the surface support of the upholstery, not illustrated in the drawing, of a seat and/or reclining furniture.

In further detail, the supporting device 2 has a central supporting element 6 to which an upper body supporting element 8 is pivotably linked that moves around a horizontal pivot axis, to which a leg supporting element 10 is pivotably linked at its side opposite of the upper body supporting element 8 that moves around a pivot axis parallel to and moving around a pivot axis of the upper body support element 8. A head support element 12 is pivotably linked to the upper body supporting element 8 on its side opposite of the central supporting element and that moves around a pivot axis parallel to the pivot axis between the central supporting element 6 and the upper body support element 8. Further, a lower leg support element 12 is pivotably linked to the leg supporting element 10 on its side opposite of the central supporting element 6 and that moves around a pivot axis between the central supporting element 6 and the leg supporting element 10.

The supporting device 2 further has an adjusting device for the adjustment of the support elements 8 to 14 relative to the base body 4, and relative to each other, respectively, which has three adjusting devices 16, 18, 20. The adjusting device 16 serves for the adjustment of the lower leg support element 14, the adjusting device 18 serves for the adjustment of the leg supporting element 10, and the adjusting device 20 serves for the adjustment of the upper body supporting element 8 and of the head support element 12 relative to the base body 4.

Figure 2:
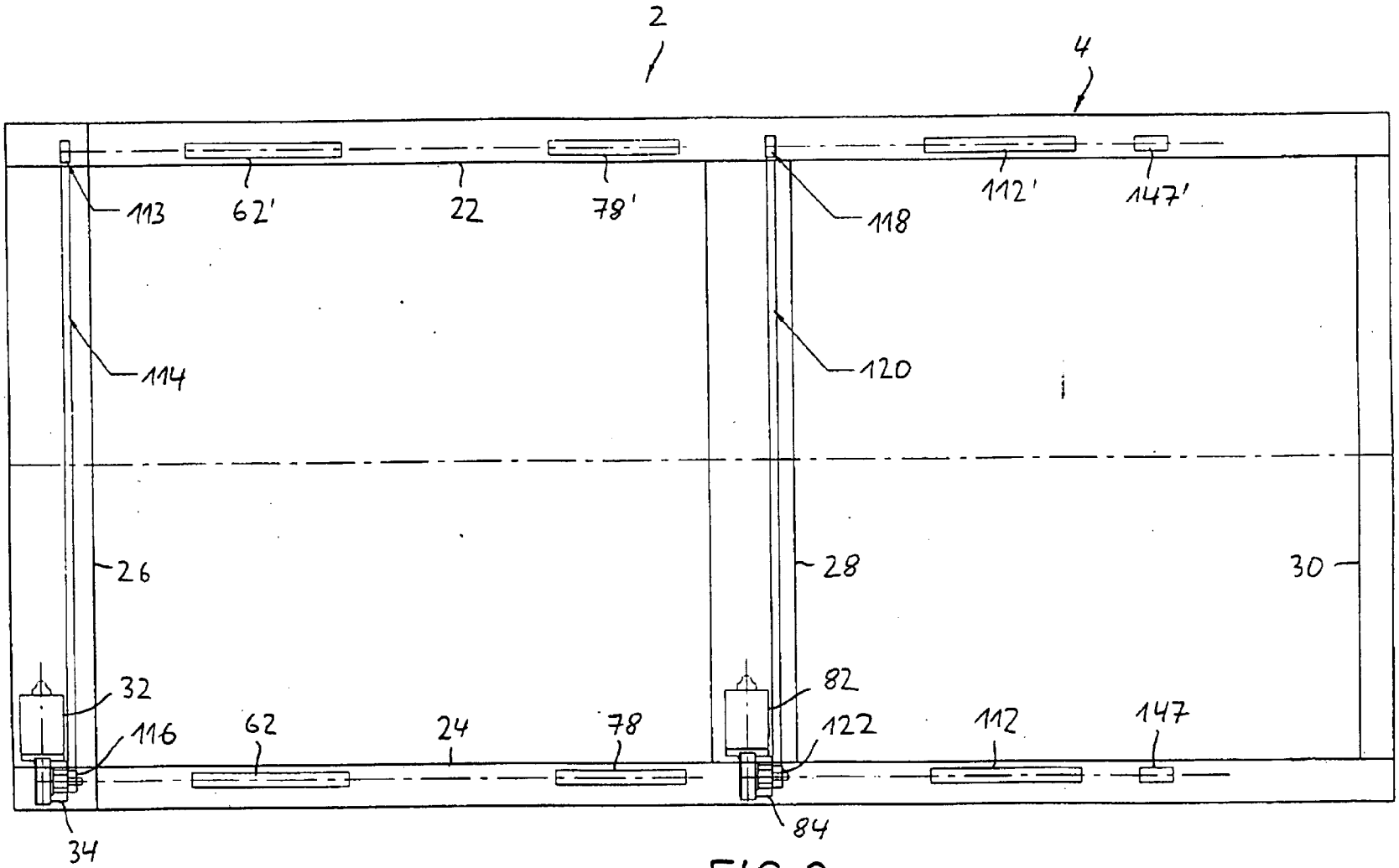
FIG. 2 shows a top view of the support device according to FIG. 1, whereby some of the elements are illustrated for purposes of clearly illustrating the arrangement of the elements of the adjusting device in the rails.

FIG. 2, which shows a top view of the supporting device 2 according to FIG. 1, illustrates that the base body 4 is frame-like, and has two longitudinal rails 22, 24 extending parallel to each other and at a distance from one another, which are connected to each other by cross rails 26, 28, 30 that are parallel to each other and at a distance from one another. In this embodiment, the longitudinal rails 22, 24, as well as the cross rails, 26, 28 are hollow for receiving the elements of the adjusting device, essentially as closed hollow profiles.

The construction of the adjusting devices 16, 18, 20 is further explained in detail in FIG. 1, in which the wall of the rail 24 facing the viewer was omitted for illustration purposes so that the elements of the adjusting devices 16, 18, 20 can be recognized.

The adjusting device 16 has an adjustment motor 32, that is received and supported by the cross rail 26 (compare FIG. 2), and is interlinked to a pivot drive by means of an angle drive 34 with a fixed spindle 36 that is received by the longitudinal rail 24 and pivotably linked to the same, on which a spindle nut 38 with a female thread is arranged pivot proof and movable in axial direction, which forms a linear movable drive element of the adjusting device 16. A rod-shaped pull or tensioning element 40 is connected to the spindle nut 38, to which an adjustment element or adjustable element in the form of an adjustment lever constructed as a pivot lever 42 is linked that moves around a pivot axis 41 parallel to the pivot axis between the support elements 6 to 14.

The pivot lever 42 has an abutting face 44 for the abutment onto an actuator 46 on one the hand, which is constructed by means of a roller pivotably linked at an interior wall of the longitudinal rail 24. The abutting face 44 of the pivot lever 42 is constructed bow-shaped in cross section in this embodiment, and convex facing toward the actuator 46. Due to the arrangement of the pivot lever 42 relative to the pull element 40 connected to the linearly movable spindle nut 38, the pivot lever 42 can be linearly moved relative to the actuator 46, whereby the pivot lever 42 moves along the actuator 46 with its abutting face 44 during the adjustment movement, and is hereby pivoted, as is further explained below in detail in FIG. 7.

On the other hand, the adjusting device 16 has an angularly movable actuator that is constructed of a lever 48 in this embodiment, the one end of which is pivotably linked to the pivot lever 42 at a distance to its pivot lever 41, and around a pivot axis 50 parallel to the pivot axis 41 of the pivot lever 42. The end 54 of the lever 48 opposite of the pivot axis 50 loosely bears on the interior on the bottom 56 of the longitudinal rail 24 and interacts with the abutment 58 during the course of the adjustment movement for the pivot operation of the pivot lever 42, which is arranged in a fixed position on the interior bottom 56 of the longitudinal rail 24 in the movement path of the end 54 of the lever 50.

As FIG. 1 shows, the fixed spindle 36, the spindle nut 38, the actuator 46, and the abutment 58 are received by the longitudinal rail 24 that is constructed as a hollow profile so that these elements of the adjusting device do not protrude over the base body 4 of the support device 2. In an adjustment position illustrated in FIG. 1, in which the lower leg supporting element 14 is not adjusted relative to the base body 4, the pivot lever 42 and the lever 48 associated with the same are also completely received by the longitudinal rail 24.

Figure 3:
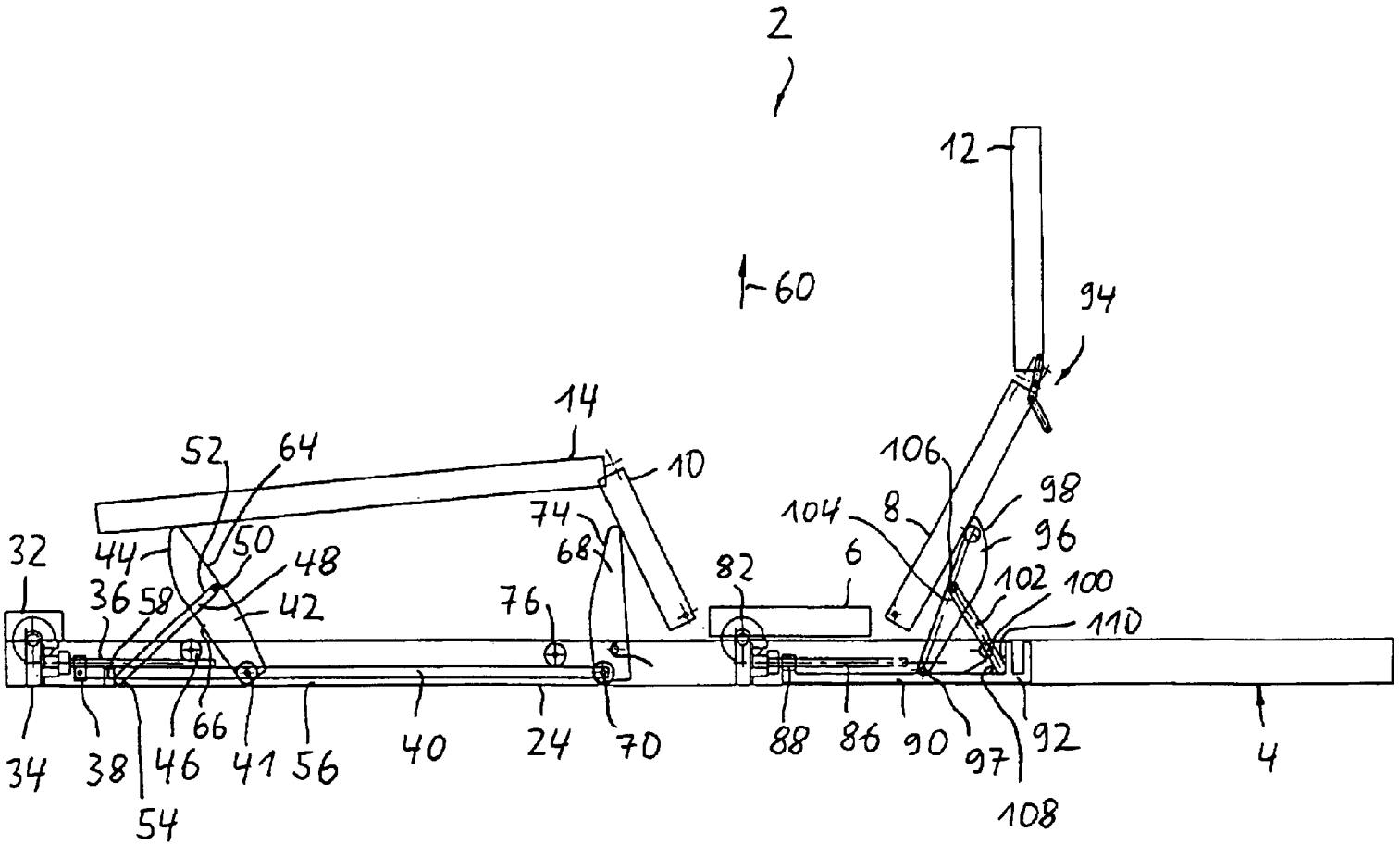
FIG. 3 shows the support device according to FIG. 1 in the same manner as FIG. 1 at a second adjustment position.

In order to adjust the lower leg supporting element 14 relative to the base body 4, the pivot lever 42 can be adjusted to a second adjustment position between the adjustment position illustrated in FIG. 1, in which the pivot lever 42 is received by the longitudinal rail 24, which is illustrated in FIG. 3, and in which the pivot lever 42 protrudes over the longitudinal rail 24 toward the support side as symbolized by an arrow 60 in FIGS. 1 and 3. For this purpose, a slit-shaped recess 62 is intended in the upper wall of the longitudinal rail 24, through which the pivot lever 42 extends in its adjustment position illustrated in FIG. 3, and protrudes in this way toward the support side 60 (compare FIG. 2).

The lower leg support element is at a distance from its pivot axis loosely positioned on the surface of the pivot lever 42 facing it, and is thereby supported by the pivot lever 42 in all adjustment positions of the support device.

In the adjustment position illustrated in FIG. 1, the lower leg supporting element 14 is positioned plane on an upper support surface 64 of the adjustment lever 42, which supports itself on the interior of the bottom 56 of the longitudinal rail 24 with a lower support surface 66 parallel to the upper support surface 64 so that the forces exerted into the adjustment lever 42 via the lower leg supporting element 14 in this adjustment position are exerted by the same into the longitudinal rail 24, and therefore do not lead to a stressing of the fixed spindle 36.

The adjusting device 18 has an adjustment element in the form of a pivot lever 68 that is pivotably linked to the pull element 40 around a pivot axis 70 parallel to the pivot axis 41 of the pivot lever 42, and can therefore be linearly moved back and forth together with the spindle nut 38 and the pull element 40 in the direction of the double arrow 72. In this embodiment, the pull element 40 therefore forms linking means for linking a linear movement of the pivot lever 68 at the adjusting device 18 to a linear movement of the pivot lever 42, or the spindle nut 38 of the adjusting device 16.

The pivot lever 68 has an abutting face 74 for abutting of an actuator 76 constructed as a roller, whereby the pivot lever 68 moves along the actuator 66 with its abutting face during the adjustment movement, and is thereby pivoted around its pivot axis 70. The actuator 76 is received by the longitudinal rail 24 and pivotably linked at an interior wall of the longitudinal rail 24. The abutting face 74 is tilted at an acute angle in each adjustment position of the pivot lever 68 relative to the linear movement axis of the pivot lever 68 determined by the linear movement axis of the spindle nut 38, and is constructed in a bow shape in a cross section. In contrast to the abutting face 44 of the pivot lever 42, which is constructed convex toward the assigned actuator 46, the abutting face 74 of the pivot lever 68 is constructed concave toward the assigned actuator 76. This achieves different, more advantageous kinematics for the adjustment of the leg support element 10, as compared to a movement of the abutting face 44 along the actuator 46.

FIG. 1 shows that the actuator 76 and the pull element 40 are received by the longitudinal rail 24. Furthermore, the pivot lever 68 is received by the longitudinal rail 24 in an adjustment position illustrated in FIG. 3, as is also shown in FIG. 1. The pivot lever 68 is adjustable between its first adjustment position and in a second adjustment position illustrated in FIG. 3, in which it protrudes over the rail toward the support side 60. For this purpose the longitudinal rail 24 has a slit-shaped recess 78 in its upper wall (compare FIG. 2), through which the pivot lever 68 extends in its second adjustment position toward the support side, as is shown in FIG. 3.

The leg supporting element 10 is loosely positioned on a support surface 80 of the pivot lever 68 that faces it.

The adjusting device 20 that serves for the adjustment of the upper body supporting element 8 and the head support element 12 relative to the base body 4, has an adjustment motor 82 in the form of an electric motor, that is received by and linked to the cross rail 28 that is constructed as a hollow profile (compare FIG. 2) and interacts with a pivot driven fixed spindle 86 in a pivot drive connection that is supported in the longitudinal rail 24 by means of an angle drive 84, on which a spindle nut 88 is arranged pivot proof and movable in axial direction of the fixed spindle 86.

The adjusting device 20 further has a pull element 90 that is pull proof connected to the spindle nut 88, on which an actuator 92 is attached at the end opposite of the spindle nut, which forms the actuator means for the operation of a knee lever 94, which serves for the adjustment of the head support element 12 relative to the upper body support element 8. The adjustment of the head support element 12 relative to the upper body supporting element 8 by means of the knee lever 94 is further explained in the following by FIG. 9.

The adjustment motors 34 and 82 can be controlled either together, or separate from each other by means of control means that are not illustrated in the drawing. The voltage supply of the adjustment motors 32 and 82 occurs by means of voltage supply means that are also not illustrated in the drawing.

The adjusting device 20 further has an adjustment element in the form of a pivot lever 96, the one end of which is pivotably linked to an interior wall of the longitudinal rail 24 around a pivot axis 97 parallel to the pivot axis of the support elements 8 to 14. The pivot lever 96 has an abutting face 98 for the abutment of an actuator 100, which is constructed as a roller that is pivotably linked to the pull element 90, and can be moved back and forth relative to the pivot lever 96 along a linear movement axis determined by the movement axis of the spindle nut 88.

The adjusting device 20 further has an angularly movable actuator 102 that is constructed as a lever in this embodiment, the one end 104 of which is pivotably linked to the pivot lever 96, at a distance of its pivot axis around a pivot axis 106 parallel to the pivot axis of the pivot lever 96. The end 107 of the lever 102 opposite of the pivot axis 106 is loosely positioned on a surface 108 of the pull element 90 facing it. An abutment 110 is constructed at the end of the pull element 90 opposite of the spindle nut 88, with which the actuator 102 interacts during the course of the adjustment movement for the adjustment of the pivot lever 96.

FIG. 1 shows that the fixed spindle 86, the spindle nut 88, the pull element 90, as well as the actuator 100 are received by the longitudinal rail 24 that is constructed as a hollow profile, and therefore do not protrude over the base body 4 of the support device 2. Furthermore, both the pivot lever 96 and the angularly movable actuator 102 are received in the longitudinal rail 24 in the adjustment position illustrated in FIG. 1 so that these elements do not protrude over the longitudinal rail 24 in this adjustment position.

The pivot lever 96 is adjustable between its adjustment position illustrated in FIG. 1, in which it is received by the longitudinal rail 24, and in a second adjustment position illustrated in FIG. 3, in which it protrudes over the longitudinal rail 24 toward the support side 60. For this purpose, the upper wall of the longitudinal rail 24 has a slit-shaped recess 112 (compare FIG. 2), through which the pivot lever 96 extends in its second adjustment position toward the support side 60, and thereby protrudes over the longitudinal rail 20.

The upper body supporting element 8 is loosely positioned on the pivot lever 96 with its side facing the pivot lever 96, and is thereby supported by the same in all adjustment positions.

Generally, the adjusting devices 16, 18, 20 that are received by the longitudinal rail 24 are sufficient for the adjustment of the support elements 6 to 14. In the embodiment illustrated in FIG. 1, however, the longitudinal rail 22 is also constructed as an essentially closed hollow profile, into which additional adjusting devices are received. The leg supporting element 10 and the lower leg supporting element 14 are assigned additional adjusting devices the construction of which essentially corresponds to the construction of the adjusting devices 16, 18.

The pivot drive of one of the fixed spindles assigned to these adjusting devices, however, does not occur by means of a separate adjustment motor, but instead by means of a drive pulley 113 (compare FIG. 2) that is pivotably linked in the longitudinal rail 22 and pivot proof connected to the fixed spindle assigned to the related additional adjusting devices. A drive belt 114 is intended for the pivot drive of the drive pulley 112 and the related fixed spindle, which is guides across a drive pulley 116 that is pivot proof linked to a drive shaft of the angle drive 34, and therefore pivot proof linked to the fixed spindle 36 of the adjusting drive 16. A pivot movement of the fixed spindle 36 is therefore synchronously transferred to the fixed spindle arranged at the longitudinal rail 22. The drive belt 114 therefore forms mechanical linking means for the linking of a turn of the fixed spindle received by the longitudinal rail 22 to a turn of the fixed spindle 36 received by the longitudinal rail 24. This arrangement has the advantage that no separate adjustment motor is required as a pivot drive of the fixed spindle received by the longitudinal rail 22, which simplifies the construction of the inventive support device 2, and therefore makes it low in cost. Another advantage of this arrangement is that due to the mechanical linking means formed by the drive belt 114, the adjustment movement of the adjusting devices 16, 18 received by the longitudinal rail 24 occurs completely synchronous with an adjustment movement of the adjusting devices received by the longitudinal rail 22. However, it is generally possible to provide a separate adjustment motor as the pivot drive of the fixed spindle received by the longitudinal rail 22.

Furthermore, an additional adjusting device is arranged in the longitudinal rail 22 that is assigned to the upper body supporting element 8 and to the head support element 12. However, this additional adjusting device is constructed correspondingly to the adjusting device 20, whereby a separate adjustment motor is not intended as the pivot drive for the assigned fixed spindle. Rather, the pivot drive occurs by means of a drive pulley 118 that is attached in the longitudinal rail 22 and is pivotably linked to the respective fixed spindle, which interacts with the drive pulley 122 in a pivot drive connection by means of a drive belt 120, which is connected pivot proof with the output shaft of the angular gear 84, and therefore connected to the fixed spindle 86.

As FIG. 2 shows, the drive pulleys 113, 116, or 118, 122, respectively, are received by the longitudinal rails 22, 24, and the drive belts 114, 120 are received by the cross rails 26, 28, so that they do not protrude over the base body 4.

As FIG. 2 further shows, the longitudinal rail 22 has slot-shaped recesses 62', 68', 112' corresponding to the slot-shaped recesses 62, 68, 112, through which adjustment levers extend in the adjustment position illustrated in FIG. 3, that are assigned to the adjusting devices received by the longitudinal rail 22.

FIG. 3 shows the supporting device 2 in a second adjustment position, in which the pivot levers 42, 68, 96 are pivoted, and extend through the recesses 62, 78, 112 in the longitudinal rails 24 and protrude toward the support side 60 in such a way that the upper body supporting element 8 and the head support element 12, as well as the leg support element 6 and the lower leg supporting element 14 are adjusted relative to the central supporting element 6 and the base body 4.

Figure 4:
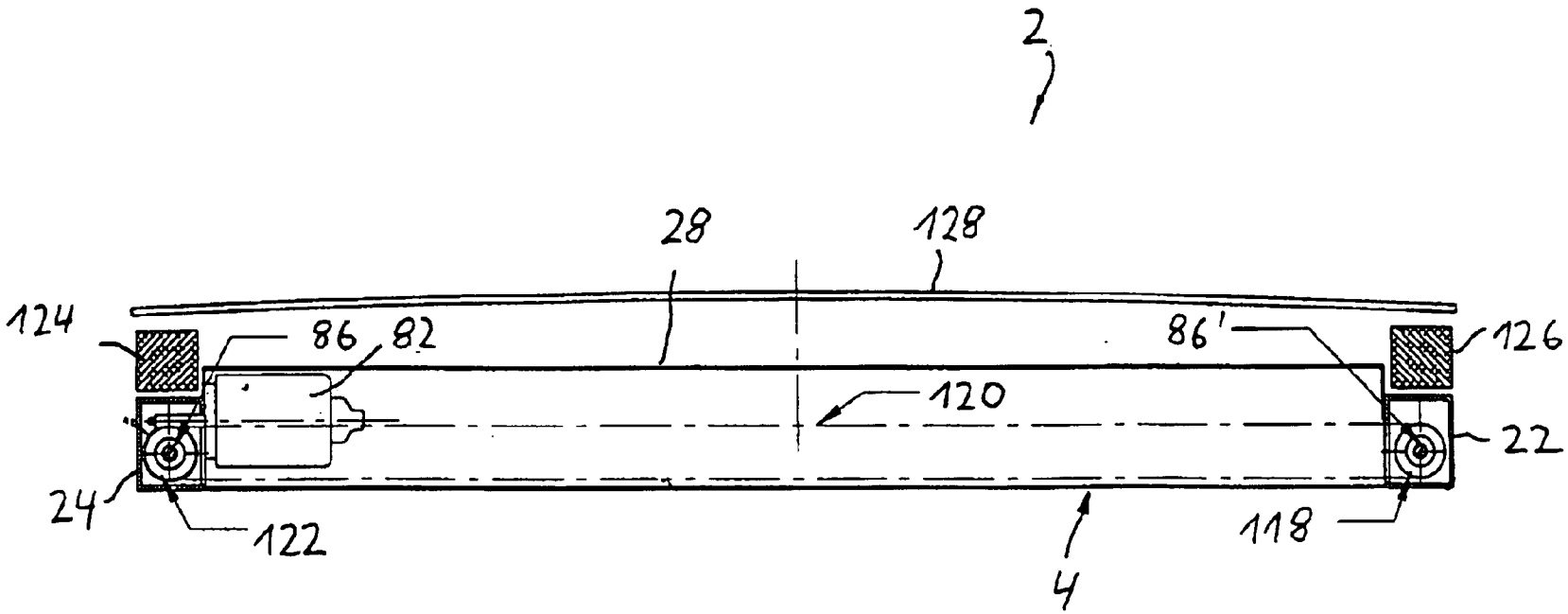
FIG. 4 shows a section along a line A—A in FIG. 1 in an enlarged scale.

FIG. 4, which illustrates a section along a line A—A in FIG. 1, shows that the longitudinal rails 22, 24, as well as the cross rail 28 are constructed as hollow profiles, whereby the fixed spindle 86 that is received by the longitudinal rail 24, and a fixed spindle 86' that is received by the longitudinal rail 22, which are pivot proof connected to the drive pulleys 118, or 122, respectively assigned to them, are guided across the drive belt 120. Furthermore, FIG. 4 shows longitudinal rails 124, 126 of the central supporting element 6 that are connected to the surfaces of the longitudinal rails 22, 24 of the base body that face them. The longitudinal rails 124, 126 of the central supporting element 6 bear the slats of the slat system on their upper surface, of which a slat 128 is shown in FIG. 4.

Figure 5:
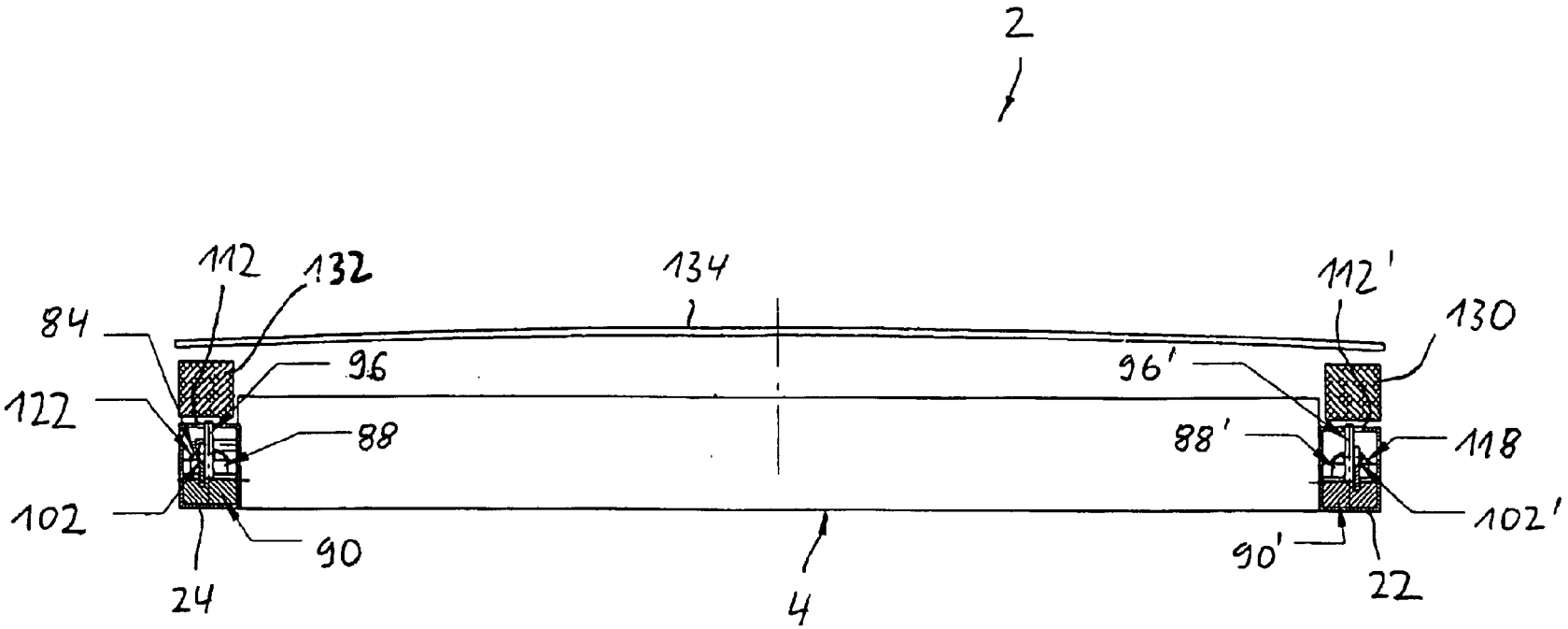
FIG. 5 shows a section along a line B—B in FIG. 1 in the same manner as FIG. 4.

FIG. 5, which illustrates a section along a line B—B in FIG. 1, shows that the longitudinal rails 22, 24 are constructed as closed hollow profiles in this area, and that the pivot lever 96 extends through the recess 112, and a pivot lever 96' received by the longitudinal rail 22 extends through a recess 112', whereby the pivot lever 96' supports a longitudinal rail 130, and the pivot lever 96 supports a longitudinal rail 132 of the upper body support element 8. The longitudinal rails 130, 132 bear the slats of the slat system, of which FIG. 5 shows a slat identified by reference number 134.

FIG. 5 further shows that the drive pulley 122 and the spindle nut 88, as well as the lever 102 are received by the longitudinal rail 24, while the drive pulley 118, and the spindle nut 88', as well as a lever 102' are received by the longitudinal rail 22.

Figure 6:
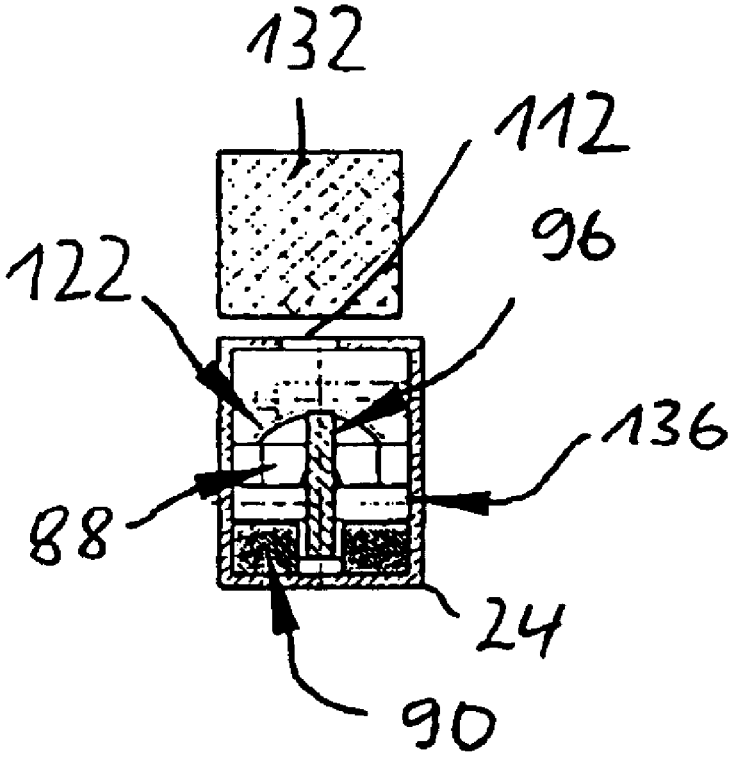
FIG. 6 shows a section along a line C—C in FIG. 1 in the same manner as FIG. 4, whereby only one longitudinal rail is illustrated.

FIG. 6 shows a section along a line C—C, whereby only the longitudinal rail 24 is illustrated in this figure. FIG. 6 shows that the pivot lever 96 is pivotably linked in the longitudinal rail 24 by means of a bolt 136. FIG. 6 also shows that the pull element 90 is constructed in a fork shape in the area of the pivot lever 96.

The adjustment of the leg supporting element 10 and the lower leg supporting element 14 relative to the base body 4 and the central supporting element 6 is explained further below in FIGS. 7A to 7D.

Figure 7A:
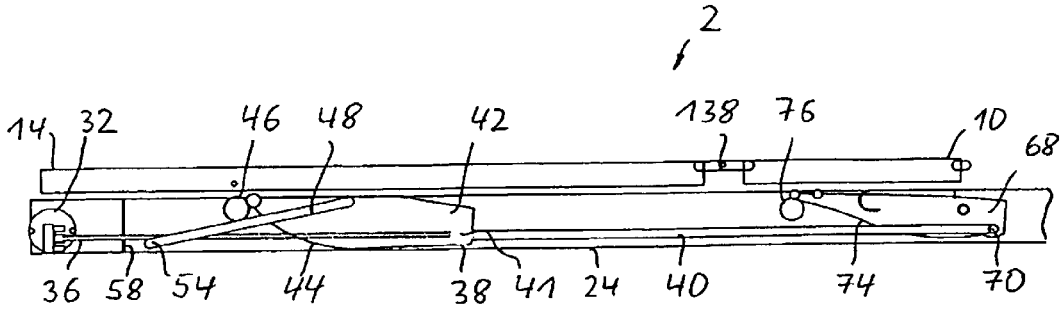
FIGS. 7A–7D shows a section of a slightly varied embodiment of FIG. 1 shown in the same manner as FIG. 1 in the area of the lower leg support element, and the leg support element for clearly illustrating the adjustment movement in various adjustment positions.

FIG. 7A shows a section from a supporting device 2 according to FIG. 1 in a first end position of the adjustment movement, in which the leg supporting element 10 and the lower leg supporting element 14 are not adjusted relative to the central supporting element 6, and stretch a mutual support level together with the additional support elements 12, 14. A slight variation of FIG. 1 is that the pivot lever 42 is not linked to the pull element 40 at a distance to the spindle nut 38, but is directly linked to the spindle nut 38.

In order to adjust the leg supporting element 10 and the lower leg supporting element 14, the adjustment motor 32 drives the fixed spindle 36 in such a way that the spindle nut 38 in FIG. 7A moves to the left on the fixed spindle 36. Here, the pivot lever 42 first abuts to the actuator 46 with its abutting face 44 while pivoting around its pivot axis 41.

Since the pivot lever 68 is linked to the spindle nut 38 by means of the pull element 40, the pivot lever 68 also moves linear to the left as in FIG. 7A, whereby it abuts to the actuator 76 with its abutting face 79, and pivots around its pivot axis 70.

The leg supporting element 10 is pivotably linked to the lower leg supporting element 14 by means of a pivot bearing, while pivoting around a pivot axis 138, while the pivot bearing has a stop unit, in such a way that a clockwise pivoting of the lower leg supporting element 14 relative to the leg supporting element 10 is prevented, however, a counter-clockwise pivoting is enabled. Due to this stop unit, the leg supporting element 10 and the lower leg supporting element 14 continue to stretch a mutual support level in the first movement phase of the adjustment movement.

Figure 7B:
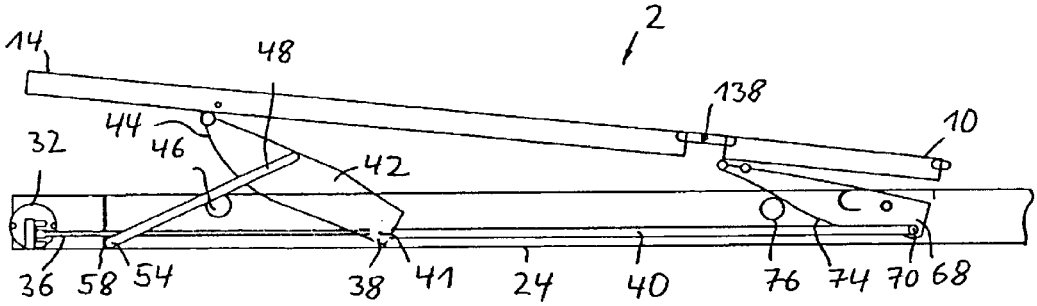

In a second movement phase illustrated in FIG. 7B, the lever 48 abuts to the stop unit 58 with its end 54 so that in the further course of the adjustment movement the actuator 46 is disengaged from the abutting face 44 of the pivot lever 42, and the pivot lever 42 pivots instead around its pivot axis 41 exclusively by the effect of the lever 48, as is illustrated in FIG. 7B. Here, the pivot lever 68 continues to move along the actuator with its abutting face 74, whereby the kinematics in the embodiment is chosen in such a way that the leg supporting element 10 and the lower leg supporting element 14 continue to stretch a mutual support level in this second movement phase.

Figure 7C:
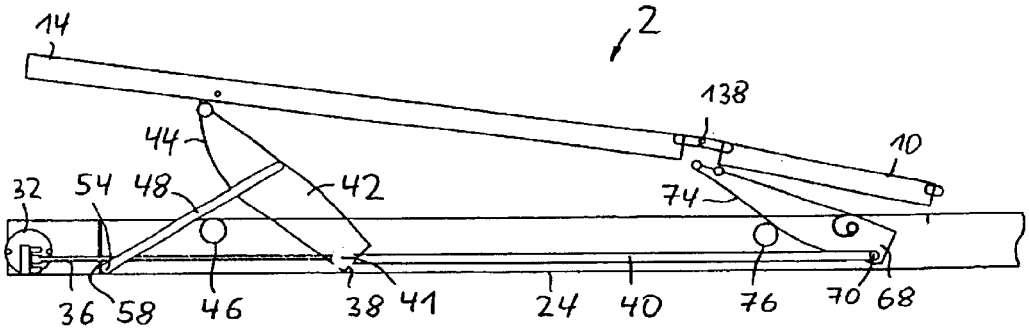

In the further course of the adjustment movement, the pivot levers 42 and 68 continue to pivot around the pivot axis 41, 70 assigned to them so that the tilt of the leg supporting element 10 and of the lower leg supporting element 14 is further increased until, in a movement phase illustrated in FIG. 7C, the lower leg supporting element 14 begins to pivot around the pivot axis 138 relative to the leg supporting element 10.

Figure 7D:
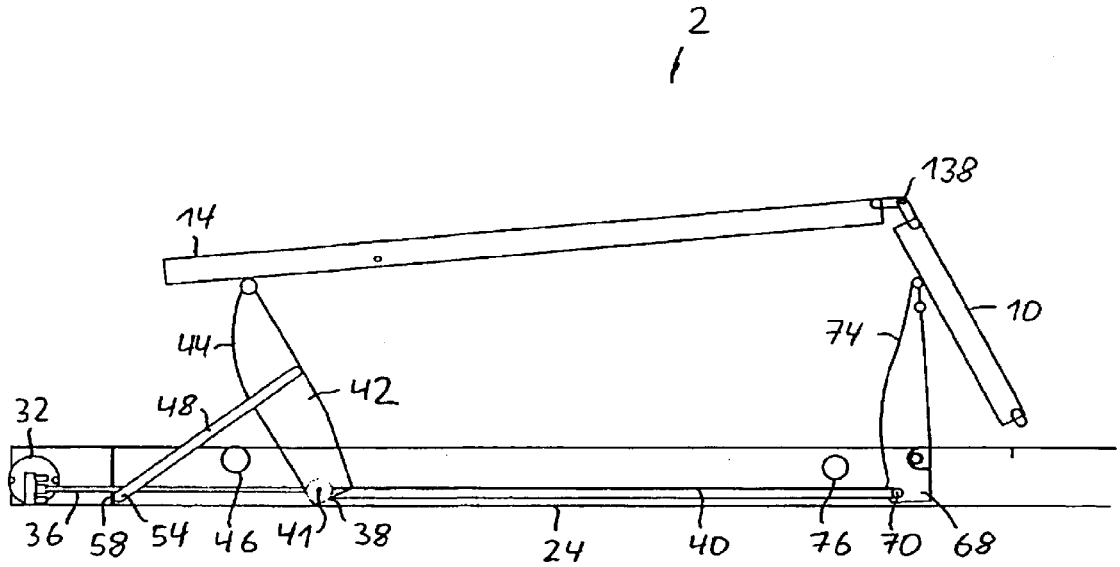

In the further course of the adjustment movement, the pivot levers 42 and 68 continue to pivot around their pivot axis 41 or 70, and the lower leg supporting element 14 continues to pivot around the pivot axis 138 relative to the leg supporting element 10 until the second end position of the adjustment movement illustrated in FIG. 7D has been achieved.

The adjustment of the upper body supporting element 8 and the head support element 12 relative to the central supporting element 6 and the base body 4 is further explained below in FIGS. 8 and 9.

Figure 8:
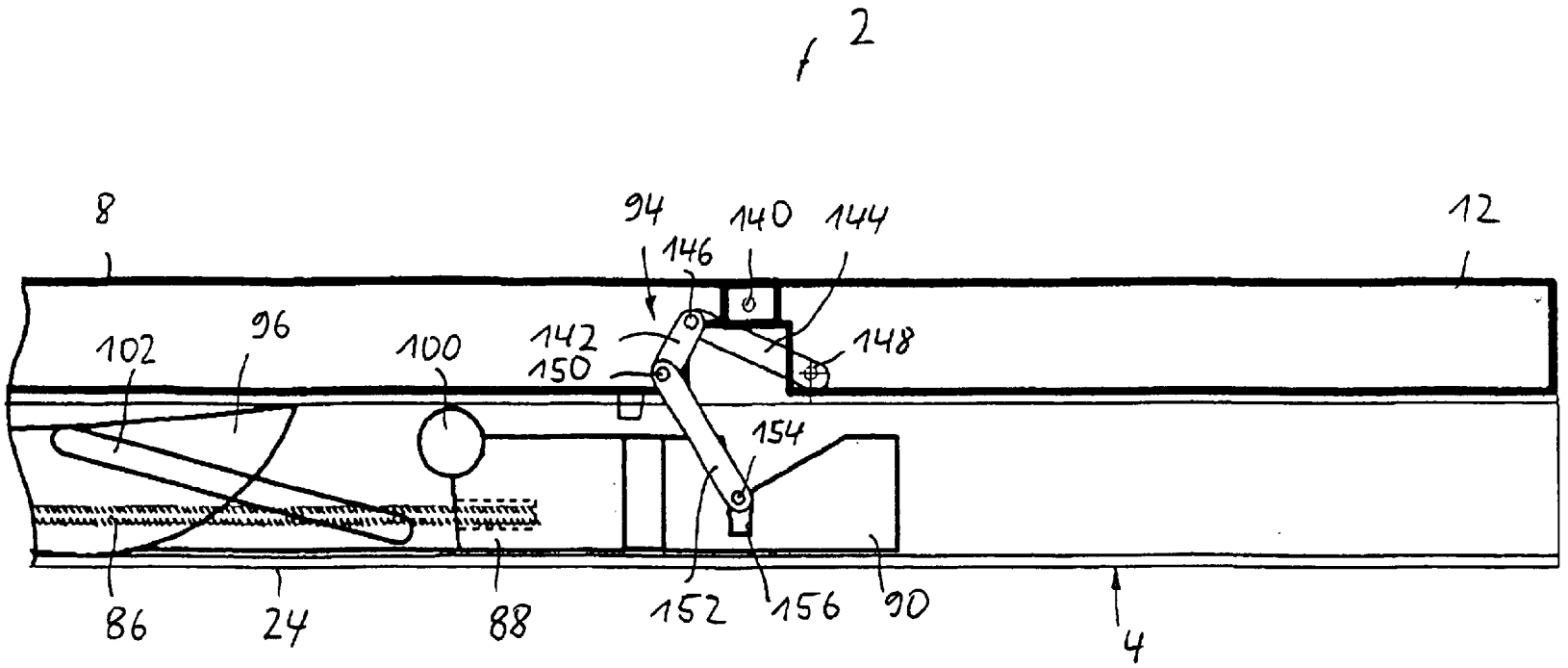
FIG. 8 shows a singularity of a slightly varied embodiment in the area of the head support element as compared with FIG. 1 in the same manner as FIG. 1 on an enlarged scale.

FIG. 8 represents a singularity in the area of the connection between the upper body supporting element 8 and the head support element 12. Both support elements 8, 12 are pivotably linked around a pivot axis 140, whereby the pivoting occurs by means of a knee lever 94 that has two lever arms 142, 144 that are pivotably linked to a knee 146. The end of the lever arm 144 opposite of the knee 146 is pivot supported on the head support element 12 at one joint 148, and the end of the lever arm 142 opposite of the knee 146 is pivot supported on the upper body supporting element 8 at a joint 150. One end of an actuator lever 152 is pivot proof connected to the lever arm 142, the other end of which engages with a pin 154 into a guide 156 constructed at the pull element 90, which is positioned vertical to the linear movement axis of the spindle nut 88.

Figure 9A:
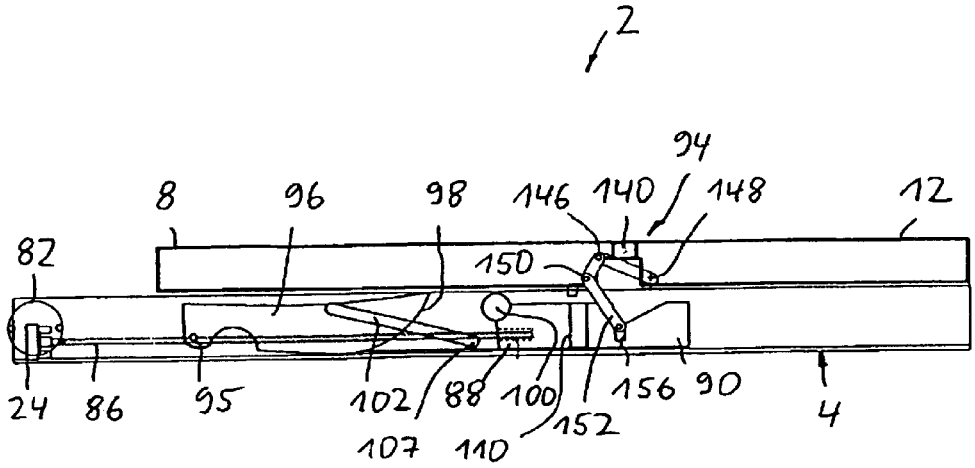
FIGS. 9A–9F shows the embodiment according to FIG. 8 in various adjustment positions in the same manner as FIG. 8 for clearly illustrating the adjustment movement.

FIG. 9A represents a first end position of the adjustment movement in which the head support element 12 and the upper body supporting element 8 are not pivoted relative to the central supporting element 6, and together stretch an essentially horizontal support level. In this base position, the actuator lever extends through a slot-shaped recess 147 (compare FIG. 2) constructed in the upper wall of the longitudinal rail 24, and engages into the guide 156. Correspondingly, a recess 147' is constructed in the longitudinal rail 22 (compare FIG. 2).

Figure 9B:
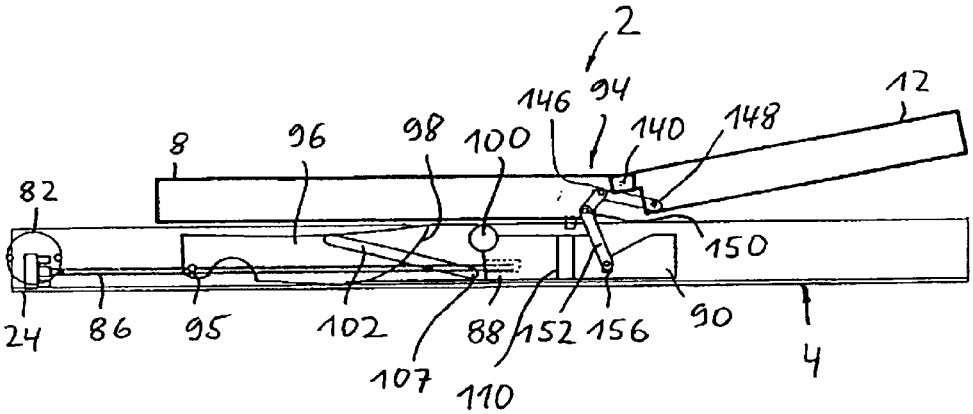

In order to adjust the head support element 12 relative to the upper body supporting element 8 in a first movement phase of the adjustment movement, the adjustment motor 82 drives the fixed spindle 86 in such a way that the spindle nut 88 moves to the left in FIG. 9A on the fixed spindle. Here, a back wall 158 of the guide 156 in the movement direction pushes against the pin 154 so that the two-armed angle lever formed by the lever arm 142 and the actuator lever 152 pivots around the joint 150. This causes an enlargement of the angle between the lever arms 142 and 144 so that the head support element 12 pivots around the pivot axis 140 relative to the upper body support element 8, as is illustrated in FIG. 9B.

Figure 9C:
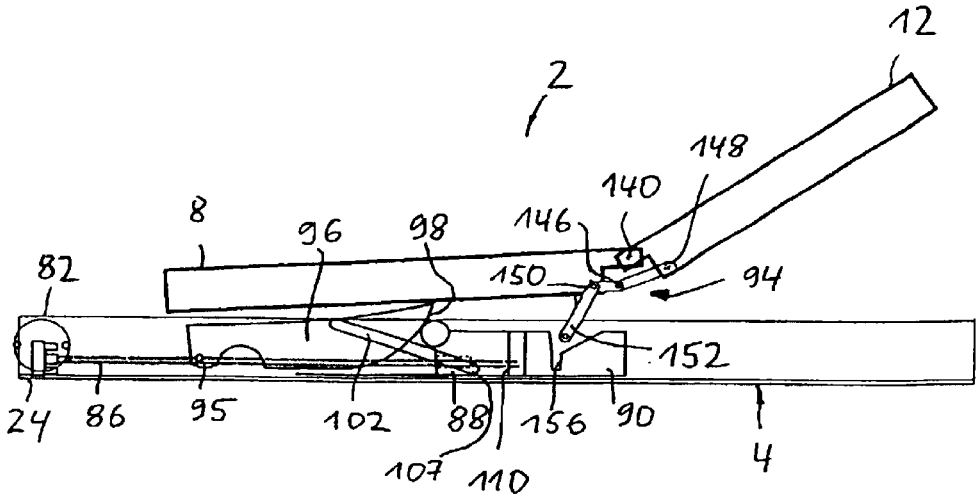

In the further course of the adjustment movement, the angle between the lever arms 142 and 144 further increases in a second movement phase until the angle is over 180°, and the dead point of the knee lever 94 is therefore exceeded, as is illustrated in FIG. 9C. This pivot position of the head support element 12 relative to the upper body supporting element 8 represents a stable adjustment position due to exceeding of the dead point of the knee lever 94 so that the head support element 12 does not adjust itself back even when stressed relative to the upper body support element 8.

Figure 9D:
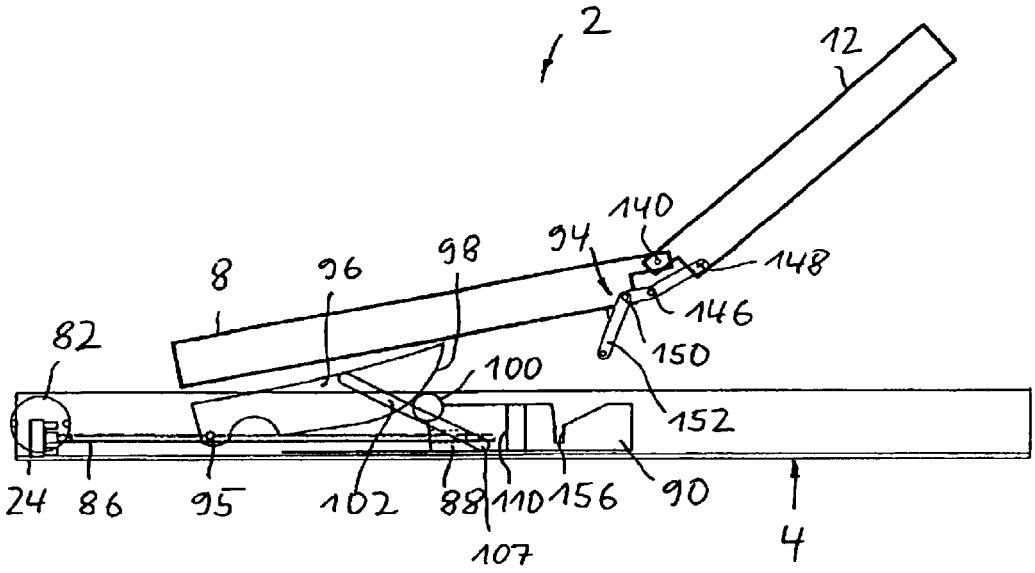

In the further course of the adjustment movement, the actuator lever 152 is disengaged from the guide 156. Further, the actuator 100 abuts to the abutting face 98 of the pivot lever 96 so that it pivots around its pivot axis 95, and the upper body supporting element 8 together with the head support element 10 thereby pivots it around the not in FIG. 9 illustrated pivot axis that was assigned to it, relative to the central supporting element 6, as is illustrated in FIGS. 9C and 9D.

Figure 9E:
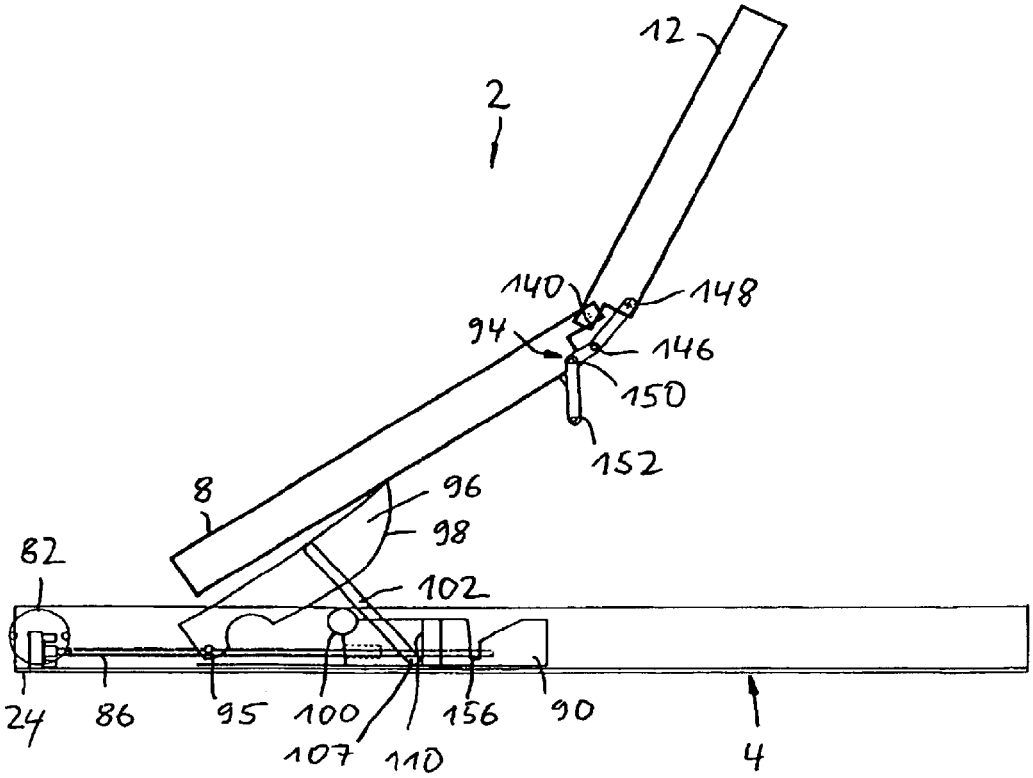

In a third movement phase of the adjustment movement, the abutment 110 of the pull element 90 abuts to the end 107 of the actuator 102 so that it pivots around its end 107, and thereby pivots the pivot lever 96 around the pivot axis 95 assigned to it, whereby the abutting face 98 of the pivot lever 96 is disengaged from the actuator 100, as is illustrated in FIG. 9E.

Figure 9F:
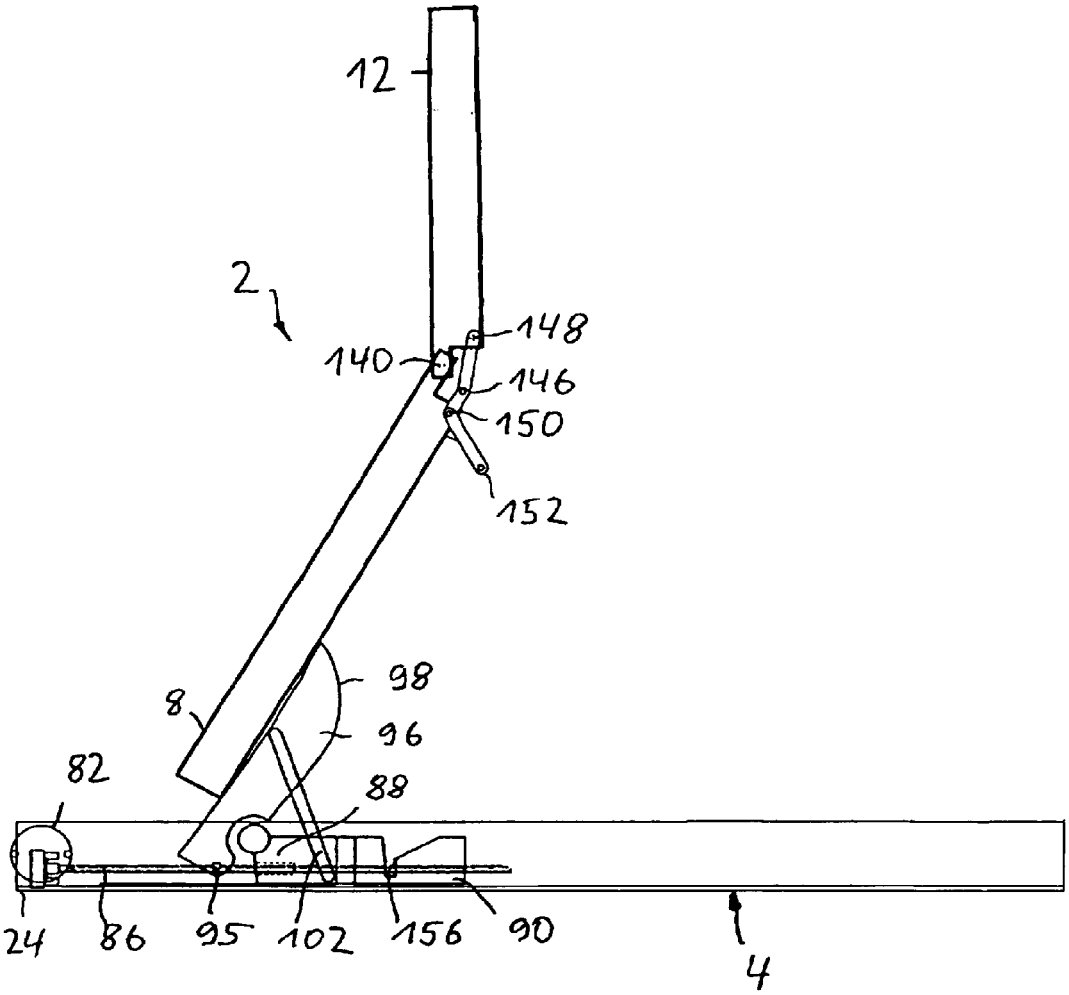

FIG. 9F represents a second end position of the adjustment movement.

The supporting device 2 illustrated in FIGS. 1–9 has a low height that is not, or only slightly higher than the height of commonly available slat systems adjustable by hand. This is due to the fact that the elements of the adjusting device in the first end position of the adjustment movement illustrated in FIG. 1 are completely received in the rails 22, 24, 26, 28 of the base body 4, and therefore do not protrude over the base body 4. The adjusting device therefore requires to additional room below the base body 4. Due to receiving of the elements in the rails 22, 24, 26, 28, the elements of the adjusting device are protected from damage and soiling. Due the kinematics chosen, the supporting device 2 enables a particularly ergonomic adjustment of the support elements 8, 10, 12, 14 that is customized to the body of the user.

The reverse adjustment of the support elements 8, 10, 12, 14 from the adjustment position illustrated in FIG. 3 into the base position illustrated in FIG. 1 occurs by the dead weight of the support elements 8, 10, 12, 14, however at a switched on operation. For this purpose, the adjustment motors drive the fixed spindle in such a way that the spindle nuts move into their base positions as illustrated in FIG. 1.

FIGS. 10A–10E show a variation of the adjusting devices 16, 18, in which the adjustment motor 32, the angular gear 34, the fixed spindle 36, and the spindle nut 38 are assigned to the adjusting device 18. A base element 160 of the adjusting device 16 is mechanically coupled to the spindle nut 38 by means of the pull element so that the base element 160 follows a linear movement of the spindle nut 38. In this embodiment, the pivot levers 42 and 68 are pivotably linked to an interior wall of the longitudinal rail 24 around their pivot axis 41, or 70.

In kinematic reverse of the effect of the adjusting device 16 in the embodiment according to FIG. 1, the actuator 46 and the abutment 58 are arranged on the base element 160 and therefore movable in the variation according to FIG. 10, while the pivot lever 42 is supported locally fixed. In a corresponding way, the actuator 76 assigned to the pivot lever 86 is arranged on the spindle nut 38 and therefore movable in this example, while the pivot lever 68 is pivot supported locally fixed. In this variation, the pivot lever 68 is also assigned an angularly movable actuator in the form of a lever 162, the end 164 of which is pivot supported on the pivot lever 68 at a distance of its pivot axis 70, and the other end 166 of which interacts with the abutment 168 constructed on the spindle nut 38 during the course of the adjustment movement.

Figure 10A:
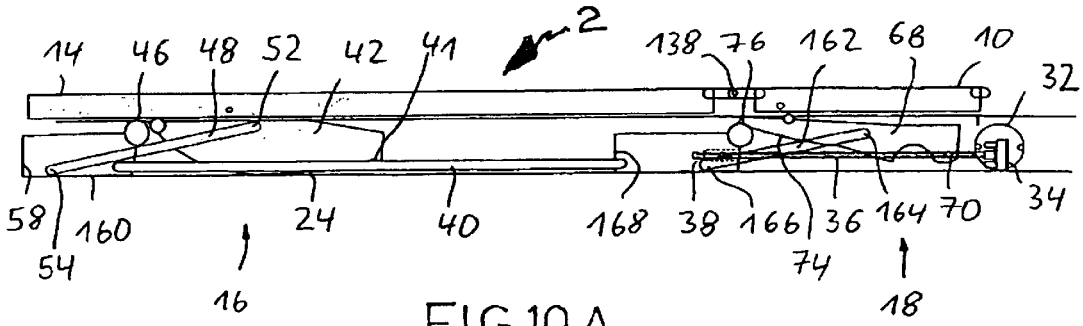
FIGS. 10A–10E shows a variation of the embodiment according to FIG. 7 in the same manner as FIG. 7.

FIG. 10A represents a first end position of the adjustment movement, in which the leg supporting element 10 and the lower leg supporting element 14 are not adjusted, and stretch a mutual, essentially horizontal support level. In order to adjust the support elements 10, 14, the adjustment motor 32 drives the fixed spindle 36 in such a way, that the spindle nut 38 of the adjusting device 18 moves to the right, and therefore also the base element 160 of the adjusting device 16 in FIG. 10 due to the coupling via the pull element 40. Here, the actuators 46 and 76 abut the abutting faces 44, or 74 of the pivot levers 42, or 68 in a first movement phase so that the pivot levers 42, 86 pivot around their pivot axis 41, or 70, and thereby adjust the leg supporting element 10 and the lower leg supporting element 14 relative to the central supporting element 6, whereby the leg supporting element 10 and the lower leg supporting element 14 continue to stretch a mutual support level.

Figure 10B:
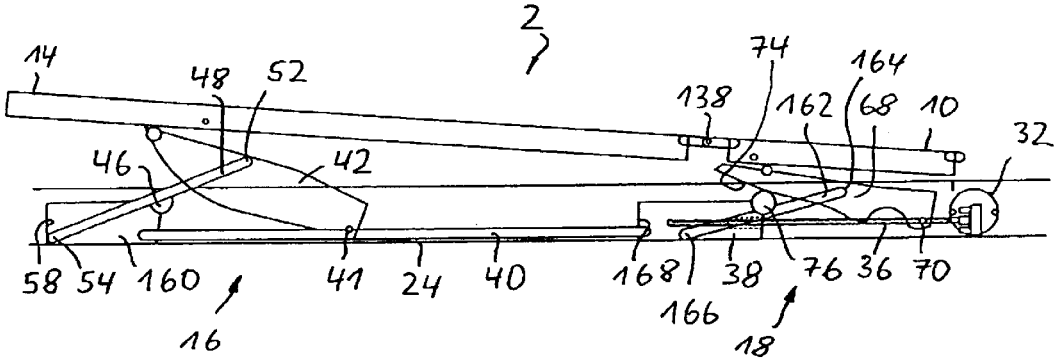

In a second movement phase, the lever 48 supported on the pivot lever 42 abuts the abutment 58 with its end 54 so that it pivots around its end 54 and the pivot lever 42 is therefore disengaged from the actuator 46 and continues to pivot as illustrated in FIG. 10B.

Figure 10C:
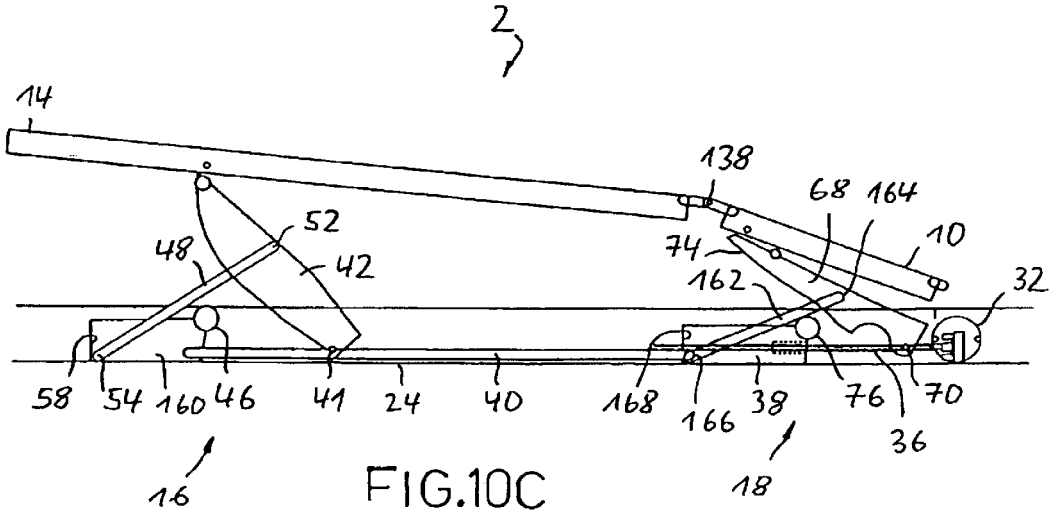

In a third movement phase of the adjustment movement, the abutment 168 abuts the end 166 of the lever 162 supported on the pivot lever 86 so that the lever 162 pivots around this end 166. Here, the pivot lever 68 is disengaged from the actuator 76 and continues to pivot as illustrated in FIG. 10C. In this movement phase, the lower leg supporting element 14 also pivots around the pivot axis 138 relative to the leg supporting element 10.

Figure 10D:
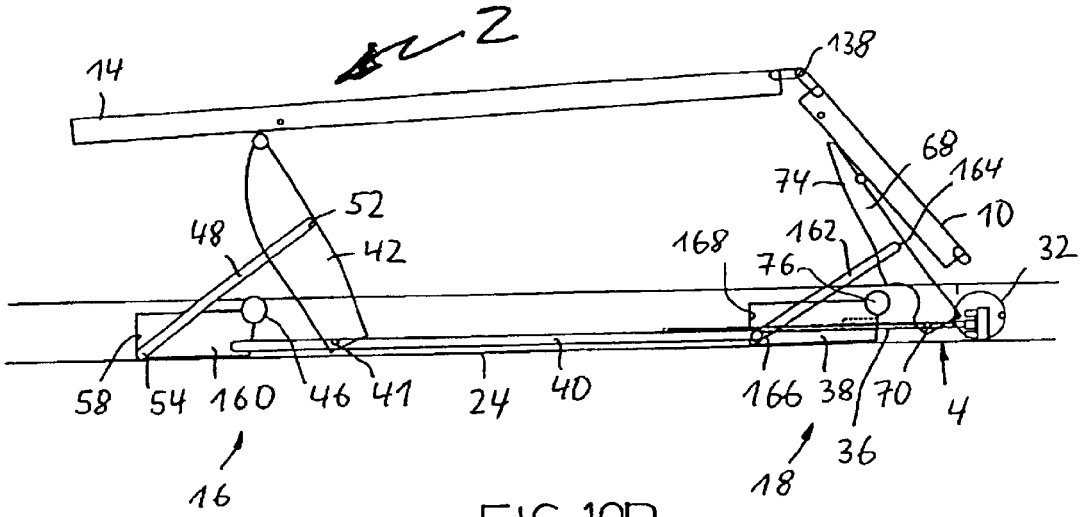
Figure 10E:
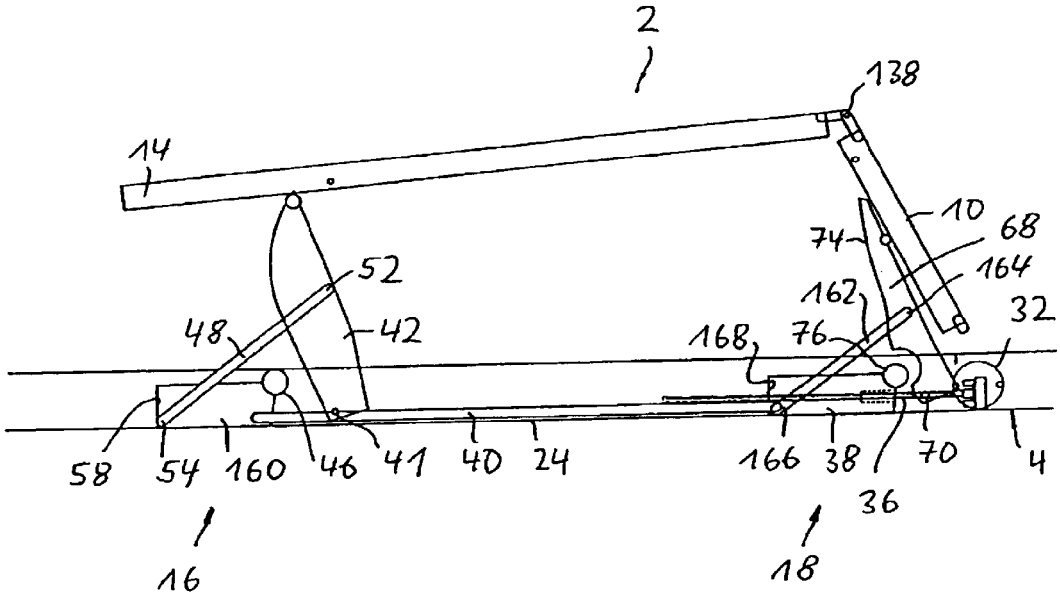

In the further course of the adjustment movement, the angle between the leg supporting element 10 and the lower leg supporting element 14 is increased, as illustrated in FIG. 10D until the second end position of the adjustment movement has been achieved, as illustrated in FIG. 10E.

Figure 11:
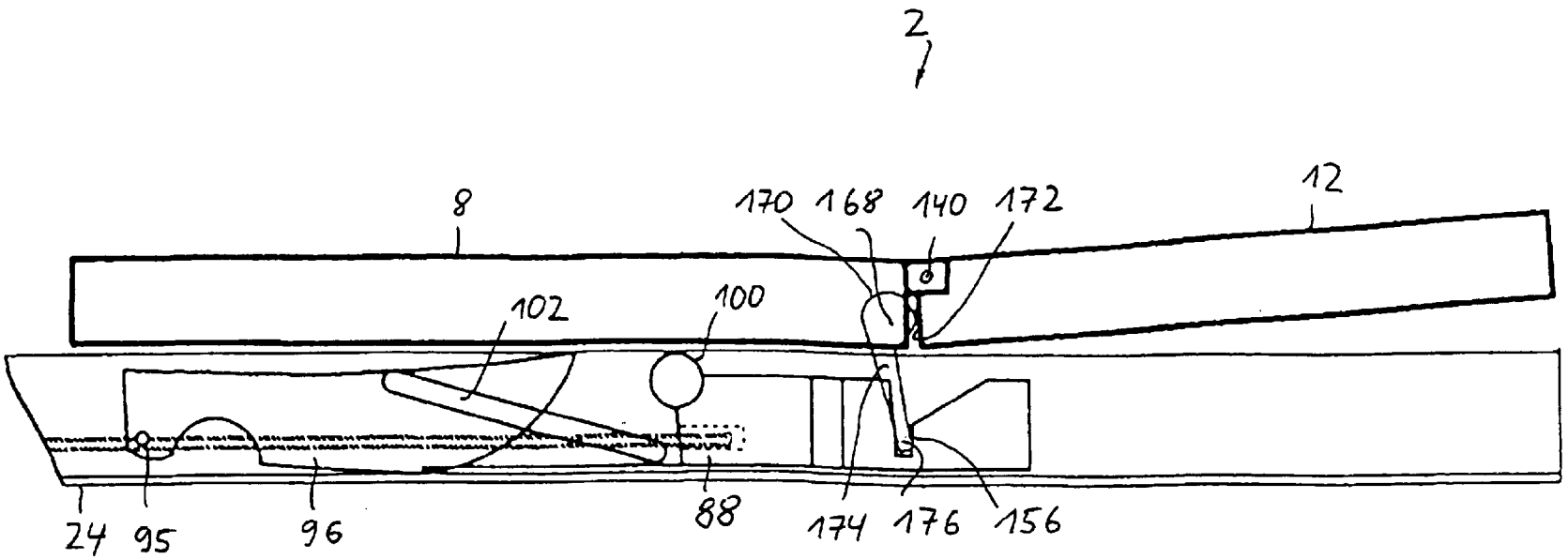
FIG. 11 shows a variation of the embodiment according to FIG. 8 in the same manner as FIG. 8.

FIG. 11 shows a variation of the adjustment arrangement from the adjustment of the head support element 12 relative to the upper body support element 10. In this variation, the adjusting device has an eccentric 170 supported on the upper body supporting element 8 around a pivot axis 168, that abuts an end face 172 of the head support element 12 facing the upper body support element 8. The eccentric 170 is received by a recess constructed in the upper body support element 8, and pivot proof linked to an actuator lever 174, the end 176 of which that is opposite of the axis 168 engages into the guide 156 at the spindle nut.

The adjustment of the head support element 12 relative to the upper body supporting element 8 by means of the eccentric 170 is further explained in the following by FIGS. 12A to 12E.

Figure 12A:
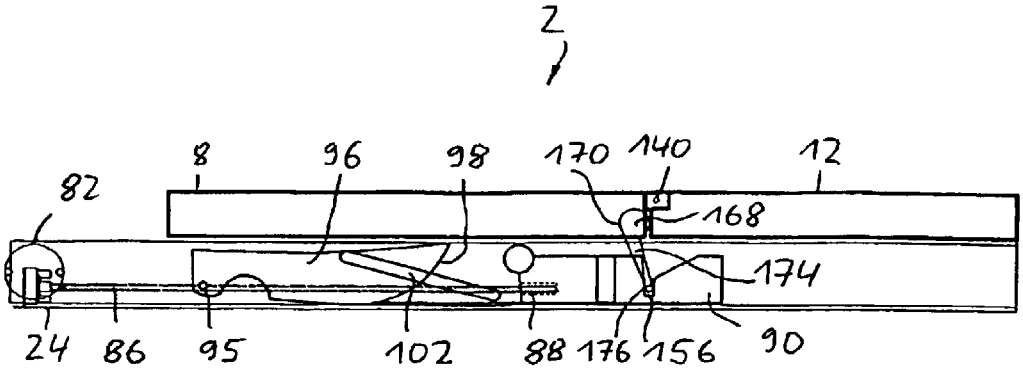
FIGS. 12A–12E shows the embodiment according to FIG. 11 in various adjustment positions in the same manner as FIG. 9.
Figure 12B:
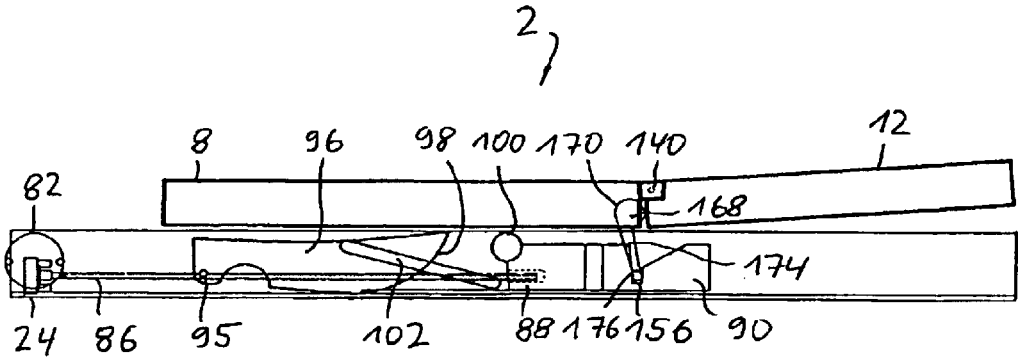

In a first end position of the adjustment movement illustrated in FIG. 12A, the head support element 12 is not adjusted relative to the upper body supporting element 8 so that the support elements 8, 12 stretch a mutual, essentially horizontal support level.

In order to adjust the head support element 12 relative to the upper body support element 8, the adjustment motor drives the fixed spindle 86 in such a way that the spindle nut 88 in FIG. 12 moves to the left. Here, the back wall 158 of the guide 156 in the movement direction of the spindle nut pushes against the end 176 of the lever 174 so that the lever in FIG. 12 pivots in counter-clockwise direction and pivots the eccentric 170, and thereby pivots the head support element 12 around the pivot axis 140 in counter-clockwise direction as illustrated in FIG. 12B. Here, the distance between the end face 172 of the head support element 12 and the axis 168 increases due to the eccentricity of the eccentric 170 until the end position of the adjustment movement of the head support element 12 relative to the upper body supporting element 8 as illustrated in FIG. 12C has been achieved, and the actuator lever 174 of the eccentric 170 is disengaged from the guide 156 as is illustrated in FIG. 12C.

Figure 12C:
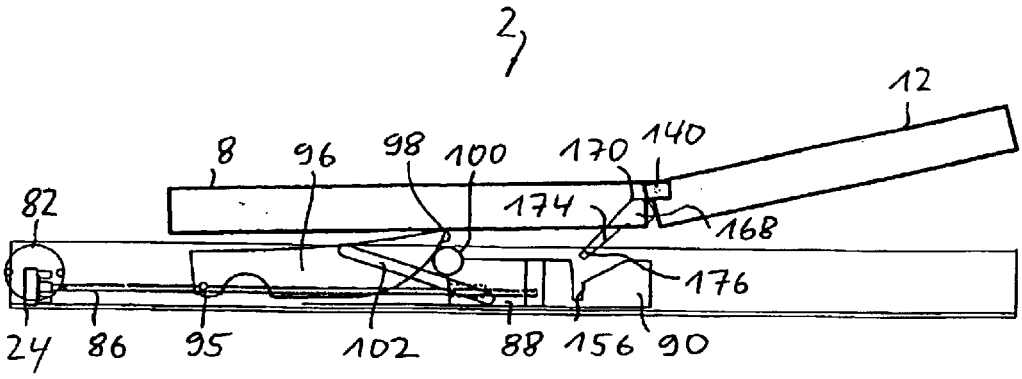
Figure 12D:
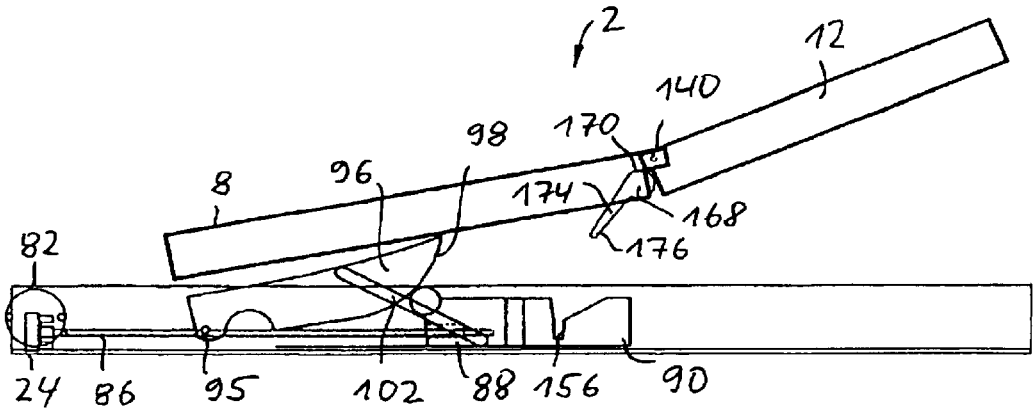
Figure 12E:
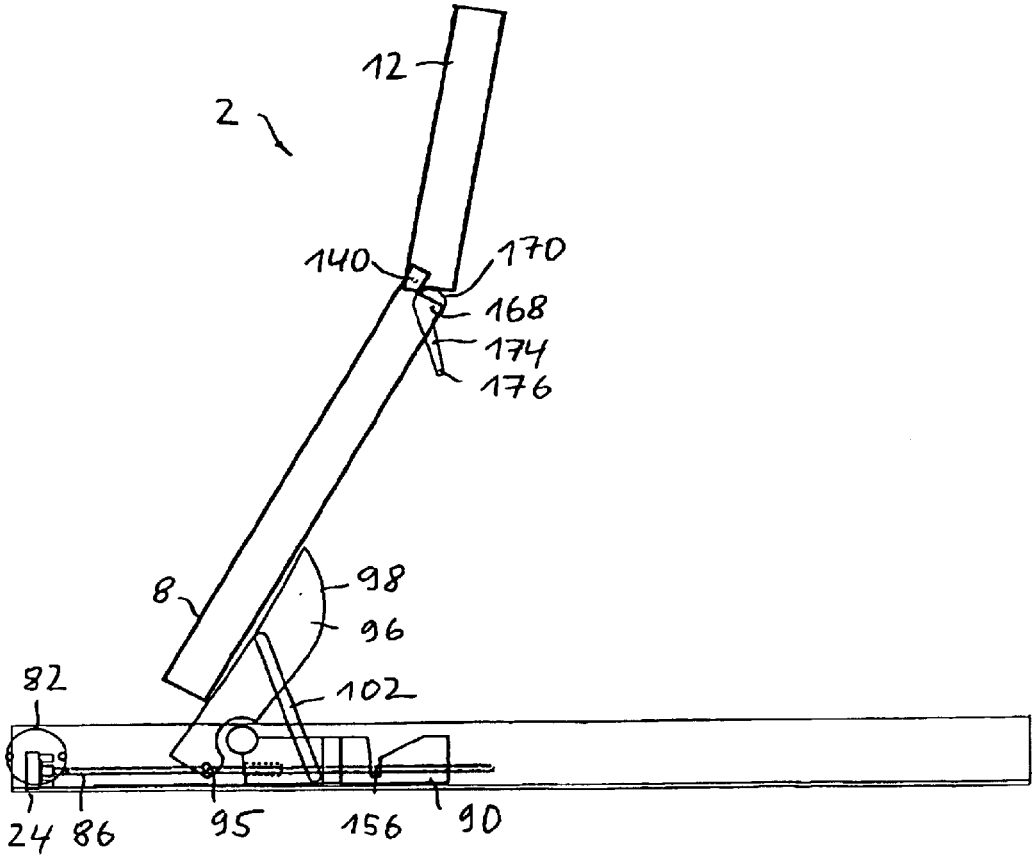

As illustrated in FIGS. 12D and 12E, the further course of the adjustment movement is performed when the second end position of the adjustment movement has been achieved as illustrated in FIG. 12E, in the same way as in the example according to FIG. 9.

The pivot position of the head support element 12 relative to the upper body support element 8, as illustrated in FIG. 12C, is a stable pivot position due to the self-stoppage of the eccentric 170 so that a reverse turn of the eccentric is prevented, and the head support element 12 does not reverse itself, even when stressed.

Figure 13:
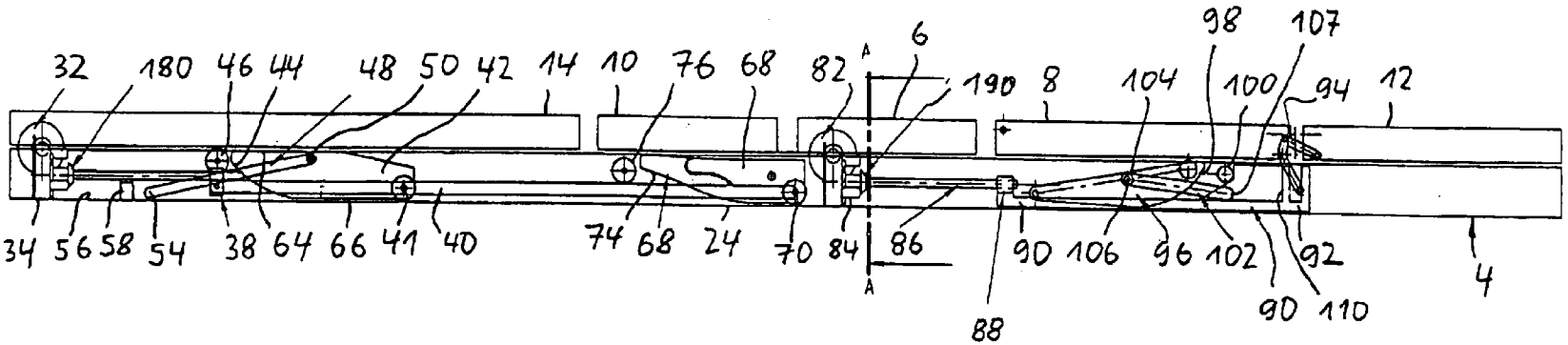
FIG. 13 shows a variation of the embodiment according to FIG. 1 in the same manner as FIG. 1.
Figure 14:
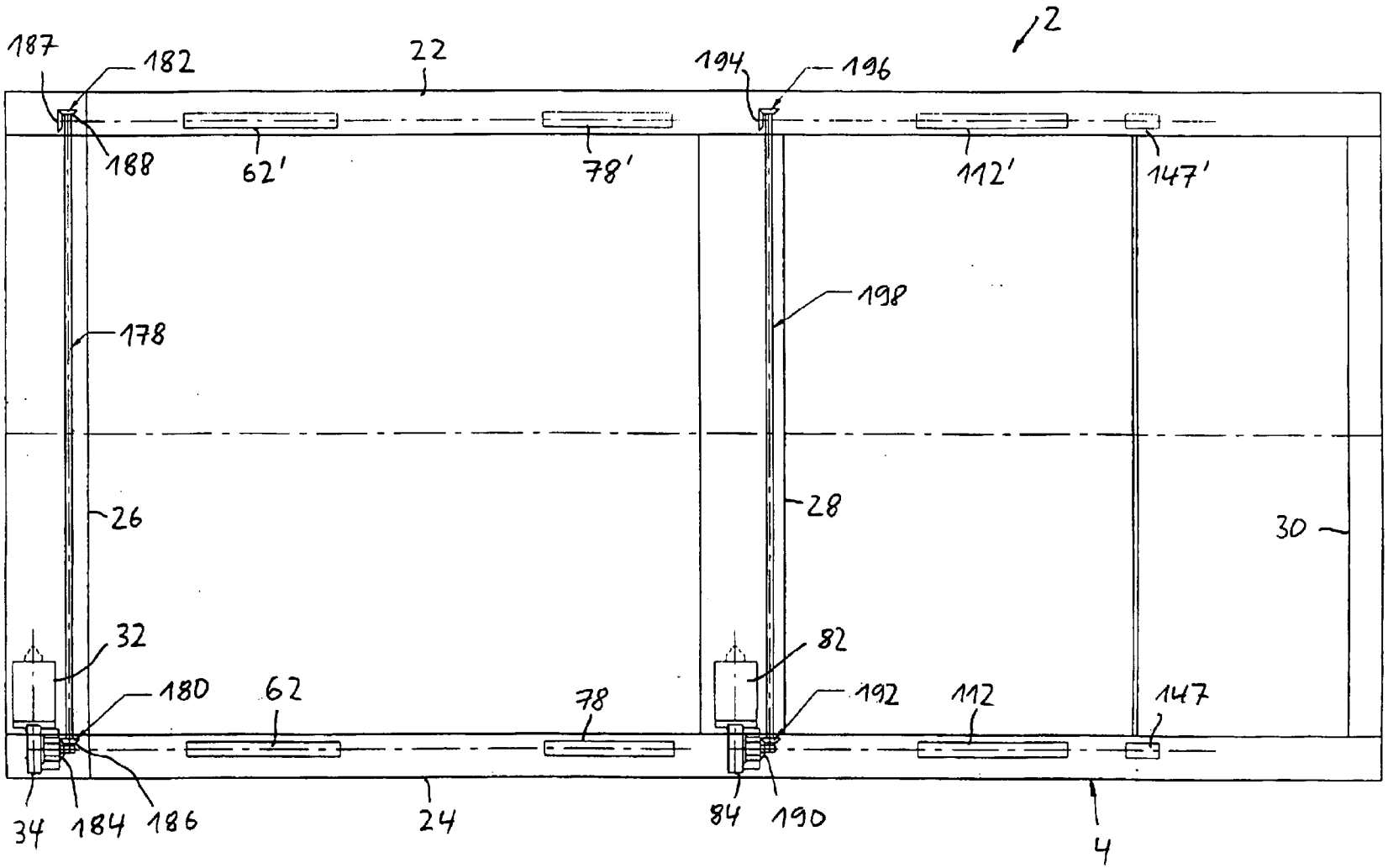
FIG. 14 shows a top view of the embodiment according to FIG. 13 in the same manner as FIG. 2.

FIGS. 13 and 14 show in the same illustration as in FIGS. 1 and 2, a different variation of the embodiment according to FIG. 1, in which the coupling means for the coupling of the turn of the fixed spindle 36' to the turn of the fixed spindle 36 occurs by means of a shaft 178 received by the cross rail 26, and the bevel gear 180, 182. For this purpose, a first bevel wheel 186 is pivot proof arranged on the drive shaft of the angular gear 34 that pivot proof engages into a second bevel wheel 186, which is pivot proof linked to the shaft 178. The bevel wheels 184, 186 are received by the longitudinal rail 24. An additional first bevel wheel 188 is pivot proof linked to the shaft 178 that interacts with an additional second bevel wheel 187, which is pivot proof linked to the fixed spindle 36', whereby the bevel wheels 187, 188 are received in the longitudinal rail 22.

In a corresponding way, a turn of the fixed spindle 86 by means of the bevel wheel pairs 190, 192, or 194, 196, and a shaft 198 is transferred onto the fixed spindle 86'. The shaft 198 is received by the cross rail 28, and the bevel wheel pairs 190, 192, or 194, 196 are received by the longitudinal rails 24, or 22.

Figure 15:
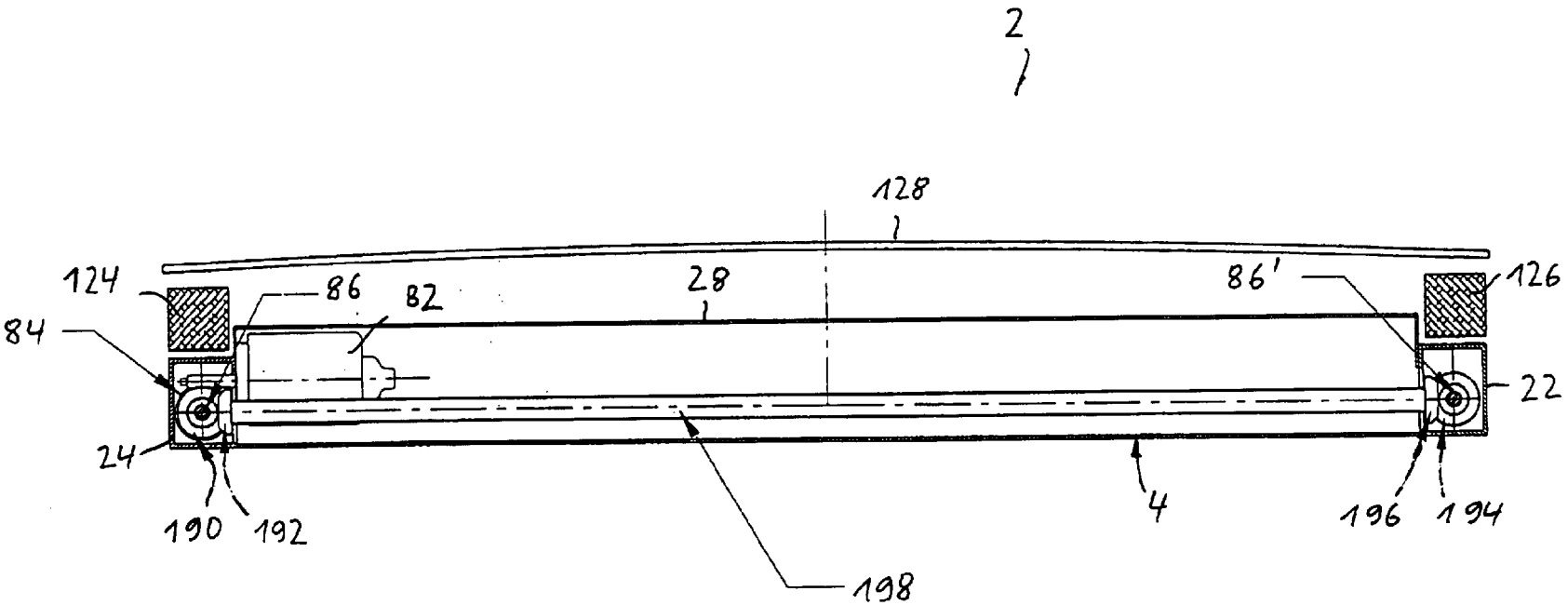
FIG. 15 shows a section along a line A—A in FIG. 13.

FIG. 15 shows a section along a line A—A in FIG. 13, whereby the shaft 198 and the bevel wheel pairs 190, 192, or 194, 196 can be recognized. Furthermore, FIG. 15 shows that the longitudinal rails 22, 24 are constructed open at their connection point to the cross rail 28 for the crossover of the shaft 198.

Figure 16:
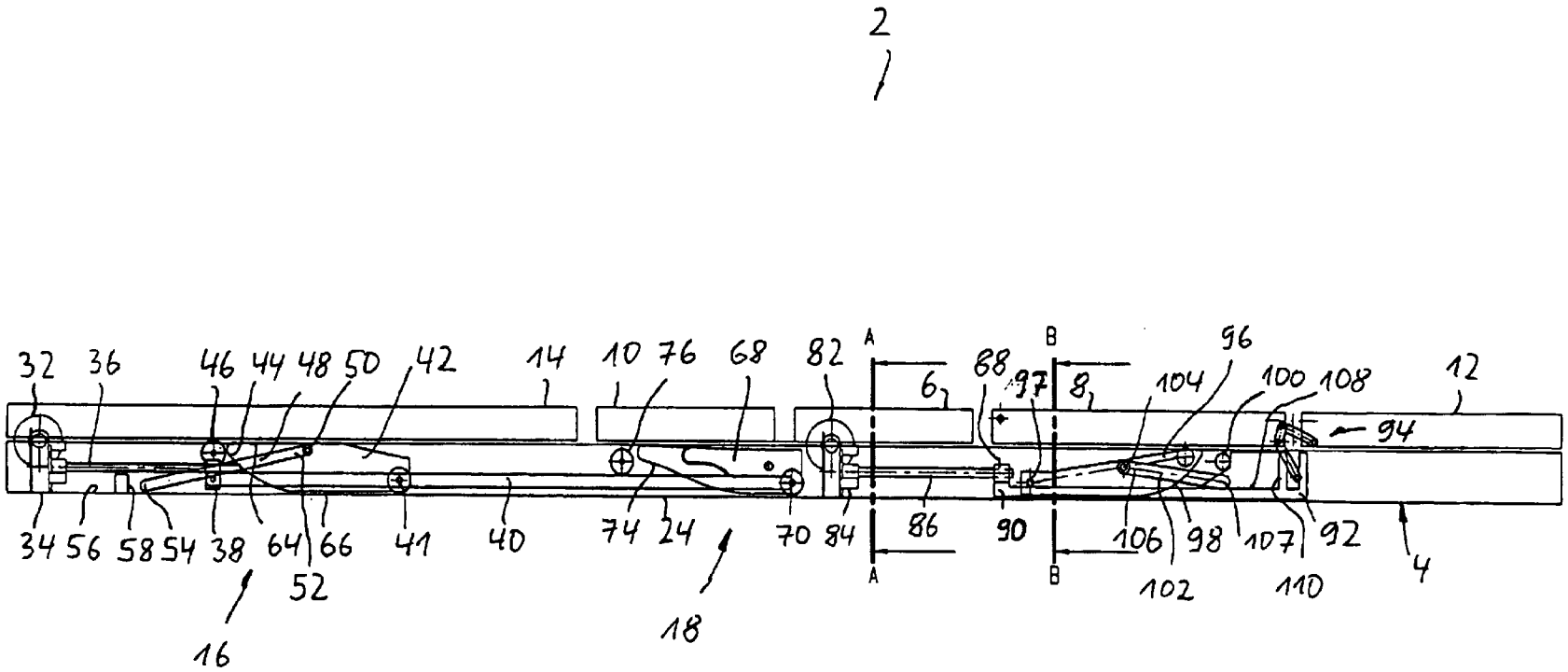
FIG. 16 shows a variation of the embodiment according to FIG. 1 in the same manner as FIG. 1.
Figure 17:
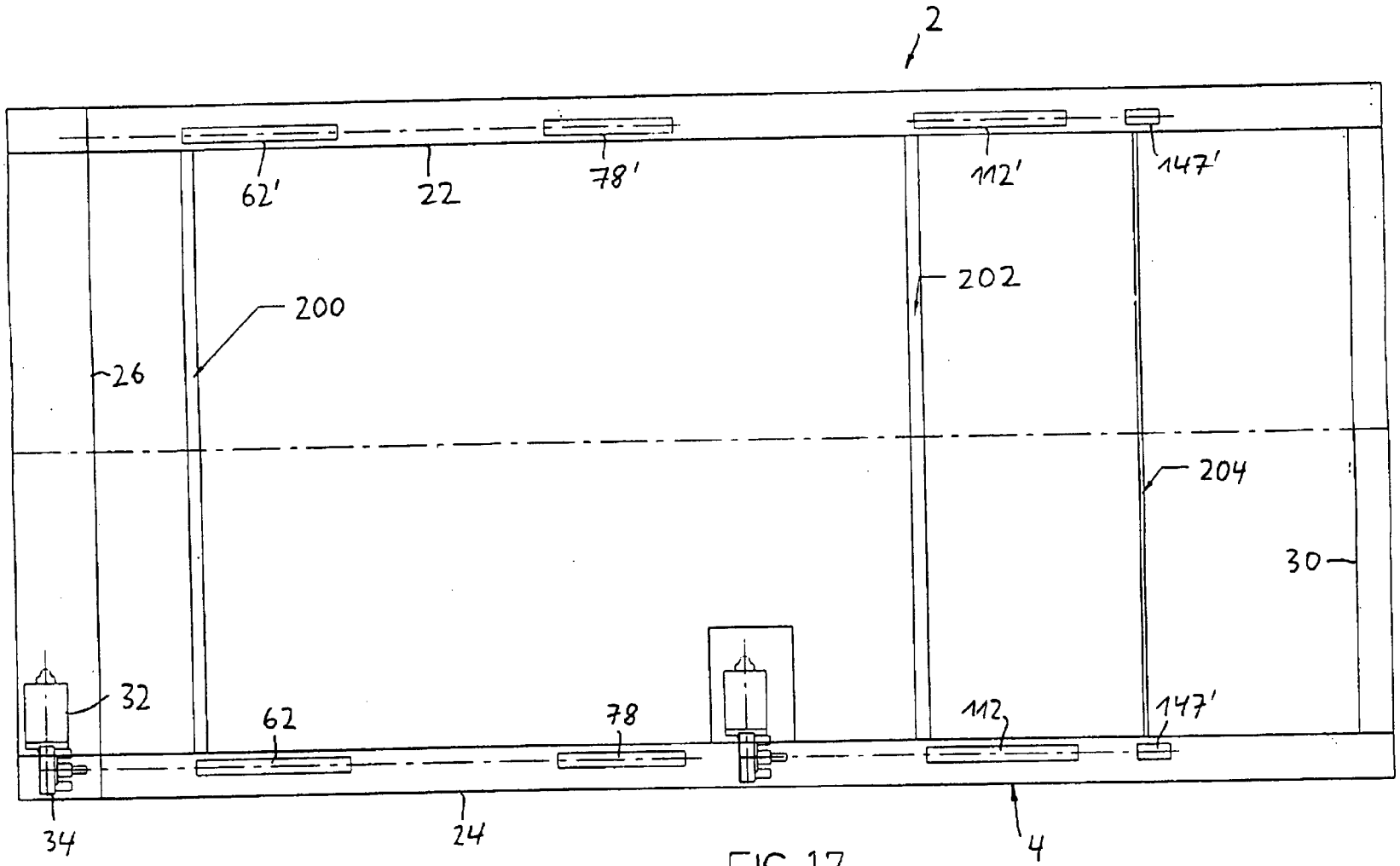
FIG. 17 shows a top view of the embodiment according to FIG. 16 in the same manner as FIG. 2.

FIGS. 16 and 17 show in a same illustration as FIGS. 1 and 2, an additional variation of the embodiment according to FIG. 1. In this variation, the adjusting devices 16, 18, 20 received by the rail 24 are constructed in the same way as has been described in FIG. 1.

However, contrary to FIG. 1, the adjusting devices received by the longitudinal rail 22 do not have a pivot drive. A linear movement of the pivot lever received by the longitudinal rail 22, and assigned to the lower leg supporting element 14, or the leg supporting element 10 is instead achieved by a pull element received by the longitudinal rail 22, on which the pivot levers are pivot linked, is firmly coupled to the pull element 40 by means of a rod-shaped connecting element. The rod-shaped connecting element 22 is fed in slots that are constructed in the side surfaces of the longitudinal rails 22, 24 that are facing each other. The adjusting devices received by the longitudinal rail 22 are also constructed as has been described in FIG. 1 for the adjusting devices received by the longitudinal rail 24.

An adjusting device received by the longitudinal rail 22 that is assigned to the upper body supporting element 8 and the head support element 12 is essentially constructed as has been described in FIG. 1 for the adjusting device 20, with the difference that the adjusting device has no pivot drive. In order to couple a pivot movement of a pivot lever linked to the longitudinal rail 22 that is assigned to the upper body supporting element 8 to the pivot movement of the pivot lever 96 linked to the longitudinal rail 24, a pivot shaft 202 is intended, the one end of which is pivot proof linked to the pivot lever 96 received by the longitudinal rail 24, and the other end of which is pivot proof linked to the pivot lever received by the longitudinal rail 22. The pivot shaft 202 extends through the recesses constructed by surfaces of the longitudinal rails 22, 24 that face each other into the interior of the longitudinal rails 22, 24. The adjusting device received by the longitudinal rail 22 that is assigned to the upper body supporting element 8 is also constructed as has been described in FIG. 1.

Furthermore, a pivot shaft 204 is intended in this variation that pivot proof links the axis 150 of the knee lever 94 to the corresponding shaft of a knee lever arranged in the area of the rail 22 so that the knee lever 94 and the additional knee lever are pivot proof coupled to each other.

Figure 18A:
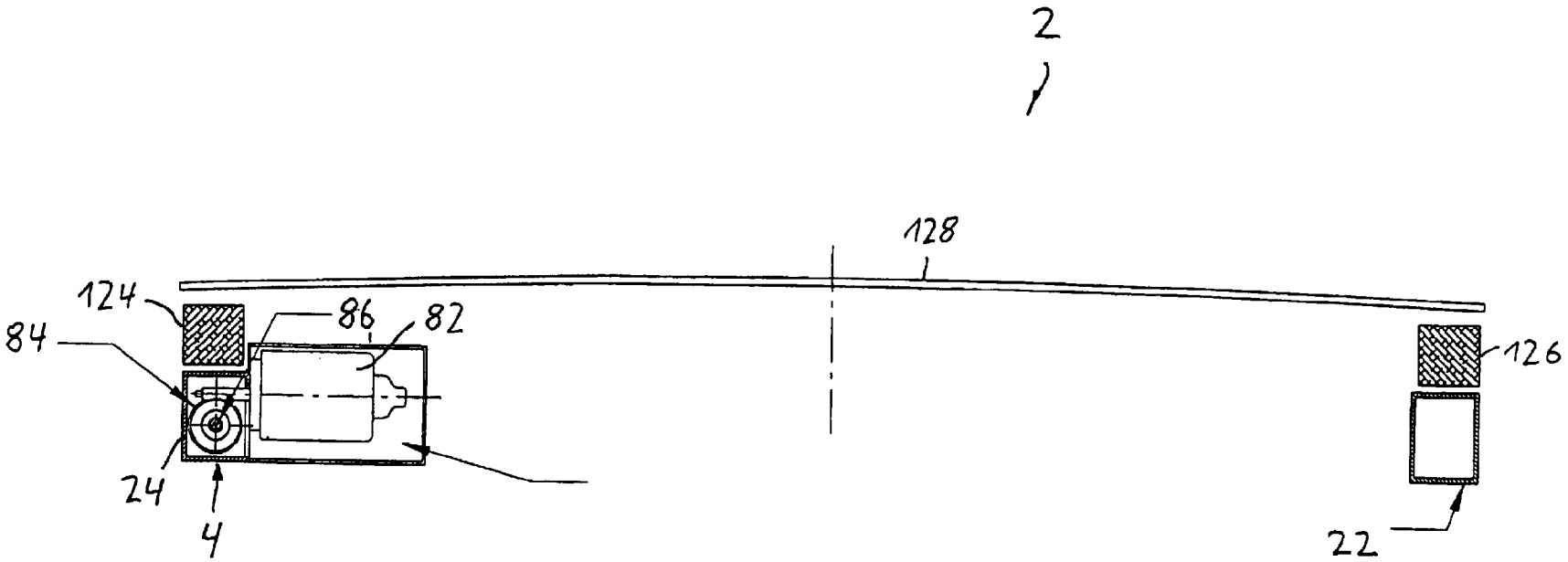
FIG. 18A shows a section along a line A—A in FIG. 16.

FIG. 18A shows a section along a line A—A in FIG. 16, whereby this figure shows that the adjustment motor 82 is received in a housing that is arranged in the longitudinal rail 24.

Figure 18B:
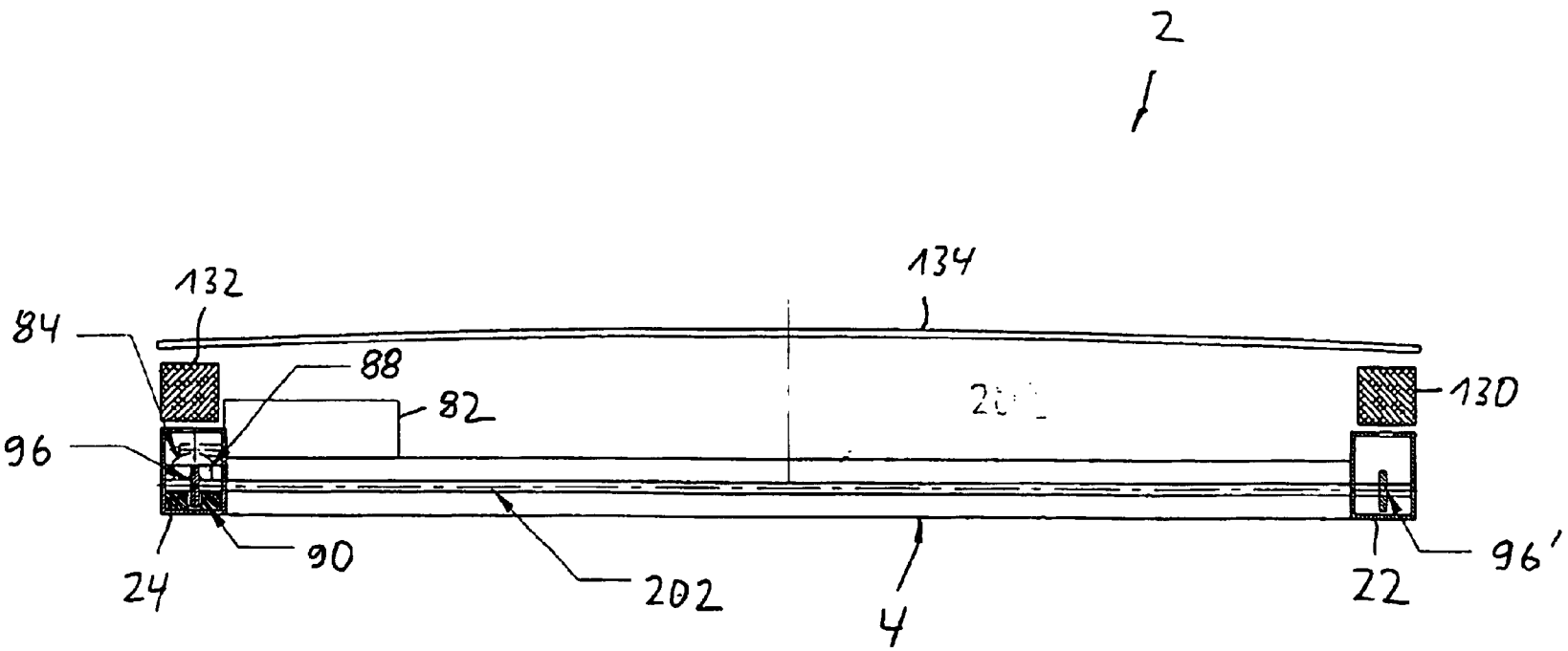
FIG. 18B shows a section along a line B—B in FIG. 16.

In FIG. 18B, which shows a section along a line B—B in FIG. 16, the pivot shaft 202 is recognizable, which links the pivot lever 96 to a pivot lever 96' received in the longitudinal rail 22.

Figure 19:
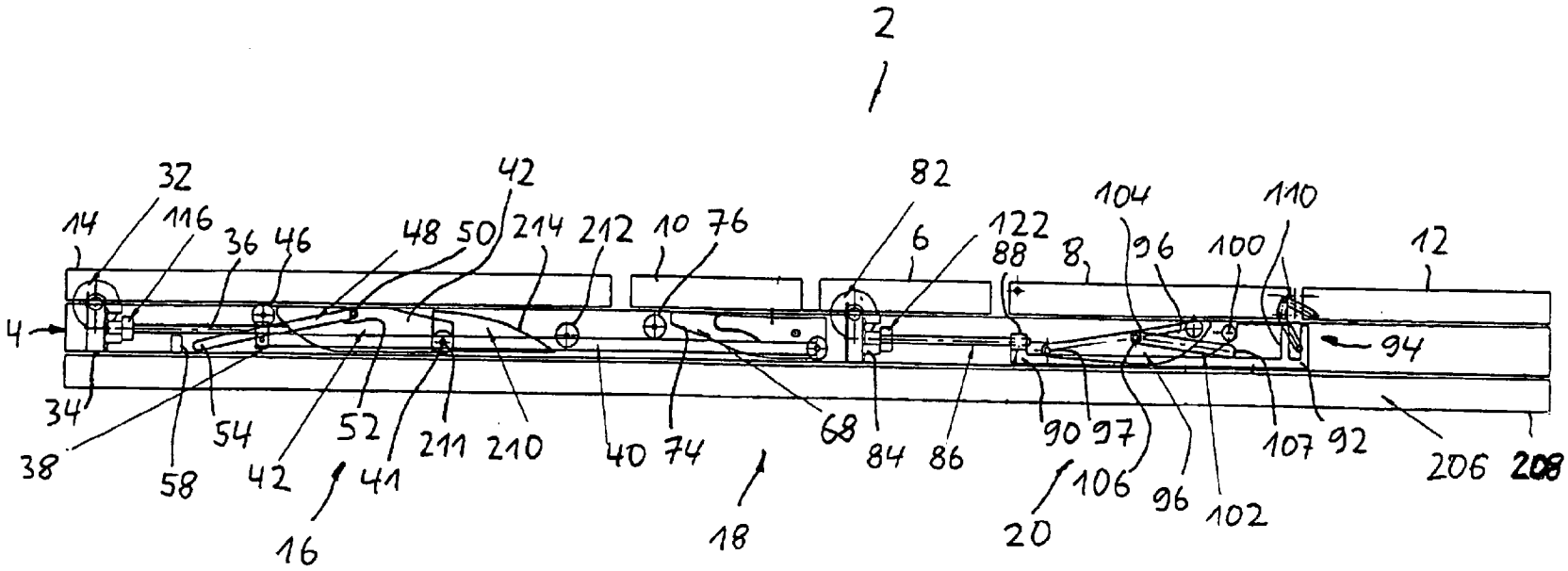
FIG. 19 shows a variation of the embodiment according to FIG. 1 in the same manner as FIG. 1.
Figure 20:
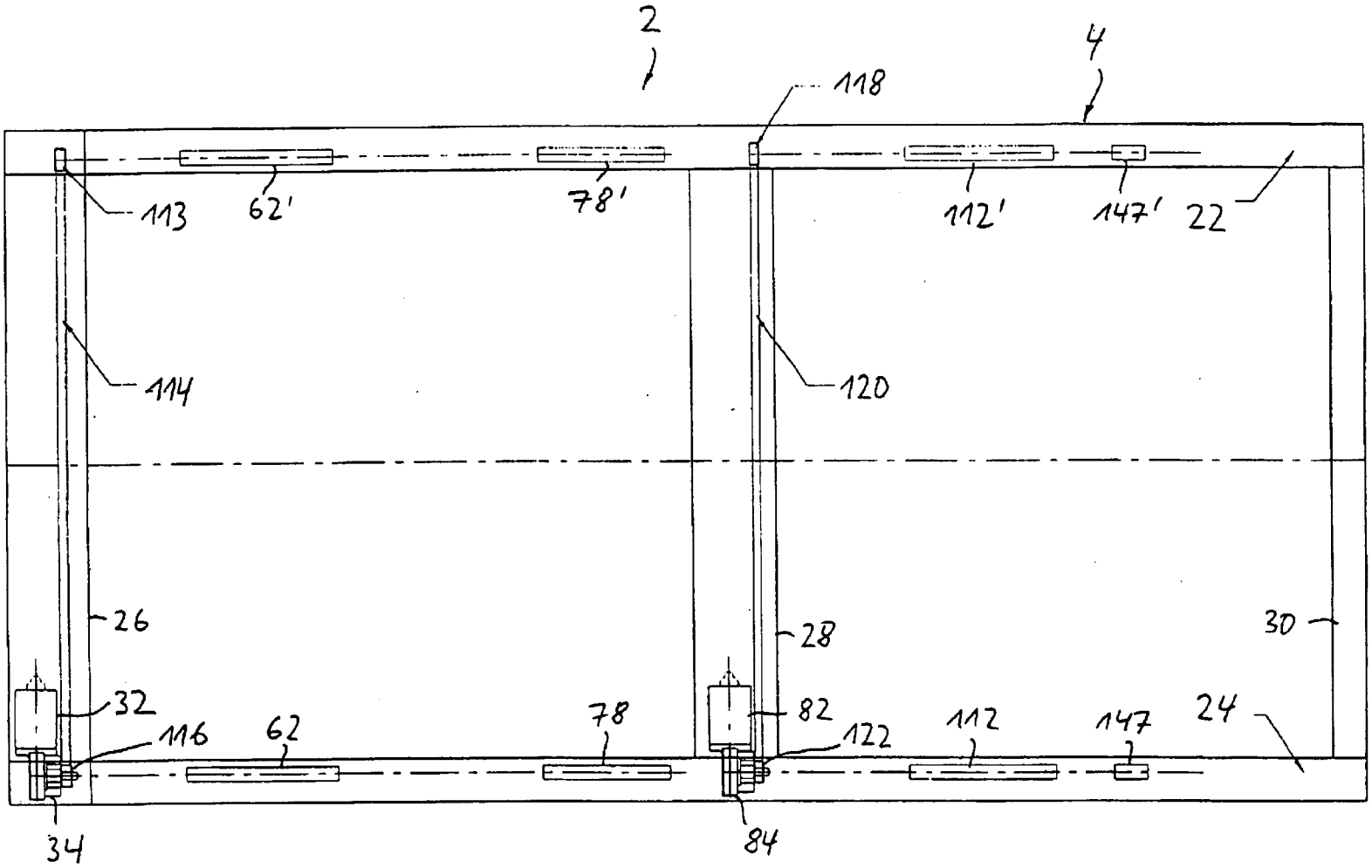
FIG. 20 shows a top view of the embodiment according to FIG. 19 in the same manner as FIG. 2.

FIGS. 19 and 20 show in the same manner as in FIG. 1 and FIG. 2 a variation of the embodiment, according to FIG. 1, in which the adjusting devices for the adjustment of the support elements 8 to 14 is constructed as has been described in FIG. 1. The variation differs from the embodiment according to FIG. 1 in that the entire supporting device 2 lies on a bearing surface 206. As the drawing does not completely show this, it is therefore explained here, the bearing surface 206 is constructed in the shape of a frame and has two longitudinal rails that are parallel and at a distance to each other, of which FIG. 19 only shows a longitudinal rail that is identified by the reference symbol 208. The longitudinal rails are connected to each other at their ends by means of cross rails. If necessary for stabilizing purposes, the longitudinal rails of the bearing surface 206 can be connected to each other at a distance to their ends by means of additional cross rails. It is also possible that the longitudinal rails of the bearing surface 206 are merely connected to each other at a distance to their ends by means of one or several cross rails. In a variation of the embodiment according to FIG. 19, the bearing surface can also be constructed of a plane bearing surface.

Further, the adjusting device 16 in this variation has an additional pivot lever 210 that is pivotably linked to the pull element 40 around a pivot axis 211 coaxial to the pivot axis 41 of the pivot lever 42. The pivot lever 210 can also be pivotably linked to the pull element 40 around a pivot axis at a distance to the pivot axis 41 of the pivot lever 42. The pivot lever 210 has an abutting face 214 that is convex toward an actuator 212 that is bow-shaped in the cross section, and in this embodiment is constructed as a roller. The actuator 212 is linked to an interior wall of the longitudinal rail 24 locally fixed.

As the drawing does not show this, it is therefore explained in further detail that a corresponding adjusting device 20' that is received by the longitudinal rail 22 has a corresponding pivot lever 210' to which an actuator in the form of a roller is assigned, which is linked to an interior wall of the longitudinal rail 22.

In a first adjustment position as illustrated in FIG. 19, and which forms a first end position of the adjustment position, the pivot lever 210 is completely received by the longitudinal rail 24, and the corresponding pivot lever 210 is received in the longitudinal rail 22 so that the pivot levers 210, 210' do not protrude over the base body 4 of the support device.

When the adjustment motor 32 drives the fixed spindle 36 in such a way that the spindle nut 38 in FIG. 19 moves to the left, an adjustment of the leg supporting element 10 and of the lower leg supporting element 14 is performed in a way as described in FIG. 1.

However, when the adjustment motor 32 drives the fixed spindle 36 in such a way that the spindle nut 38 in FIG. 19 moves to the right, the entire base body 4 is tilted from the bearing surface 206 as is explained in further detail in FIGS. 21A to 21D.

Figure 21A:
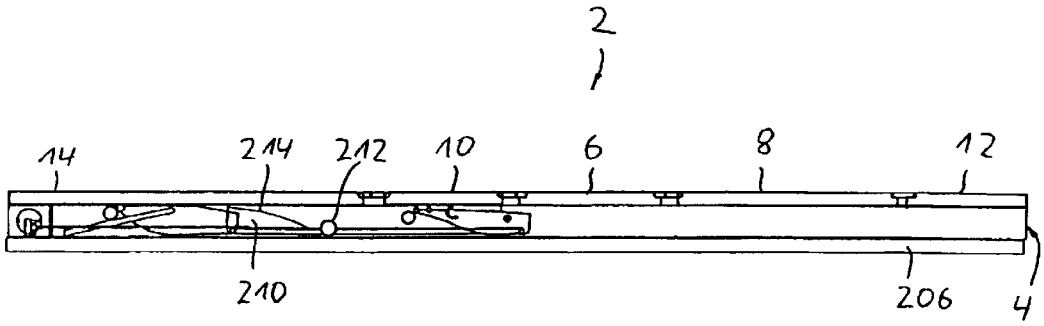
FIGS. 21A–21D shows the embodiment according to FIG. 19 in various adjustment positions in the same manner as FIG. 19, and at a smaller scale.
Figure 21B:
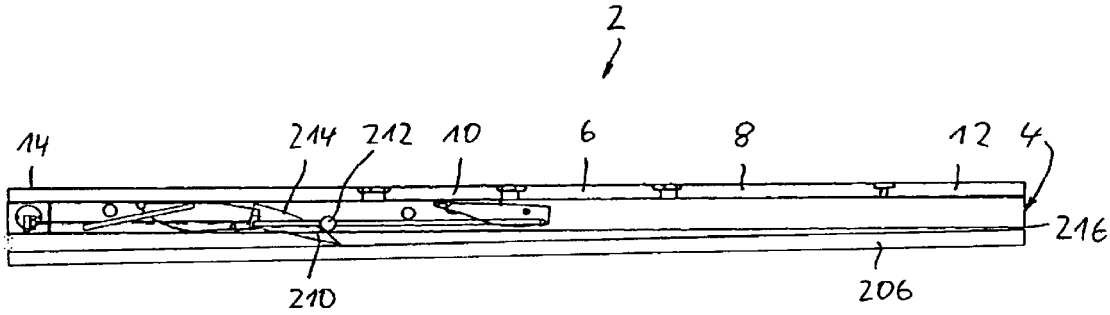

FIG. 21A shows the supporting device 2 according to FIG. 19 in the first end position of the adjustment movement as illustrated in FIG. 19.

If, based on this end position, the adjustment motor 32 drives the fixed spindle 36 in such a way that the spindle nut 38 in FIG. 21 moves to the right, the pull element 40 in FIG. 21, which can also be stressed with pressure due to its construction as a rod, and on which the pivot lever 210 is pivot linked, moves to the right. Here, the pivot lever 210 abuts with its bearing surface 214 onto the actuator 212 and pivots around the pivot axis 41. Because the base body 4 supports itself with the pivot lever 210 on the top of the bearing surface 206, the base body 4 is then tilted by its end 216 opposite of the adjusting device 16 relative to the bearing surface 206 as is illustrated in FIG. 21B.

Figure 21C:
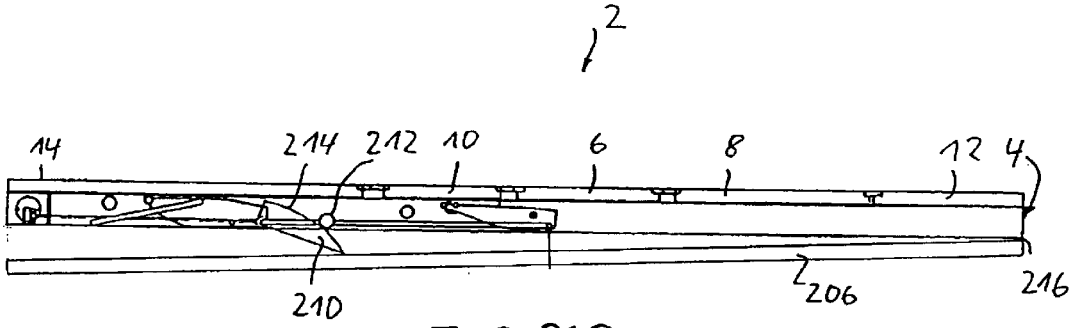
Figure 21D:
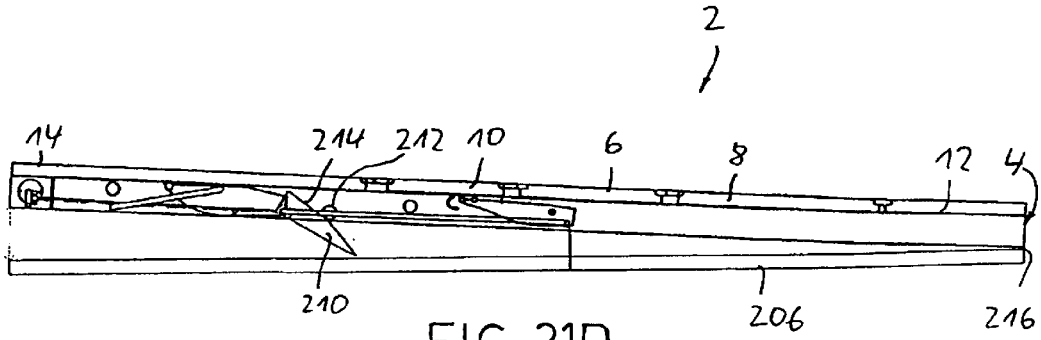

In the further course of the adjustment movement, the tilt of the base body 4 relative to the bearing surface 206 is increased as is illustrated in FIG. 21C until the second end position of this adjustment movement as illustrated in FIG. 21D is achieved, in which the entire bade body 4 relative to the bearing surface 206 is tilted by an angle of about 10°.

Figure 22:
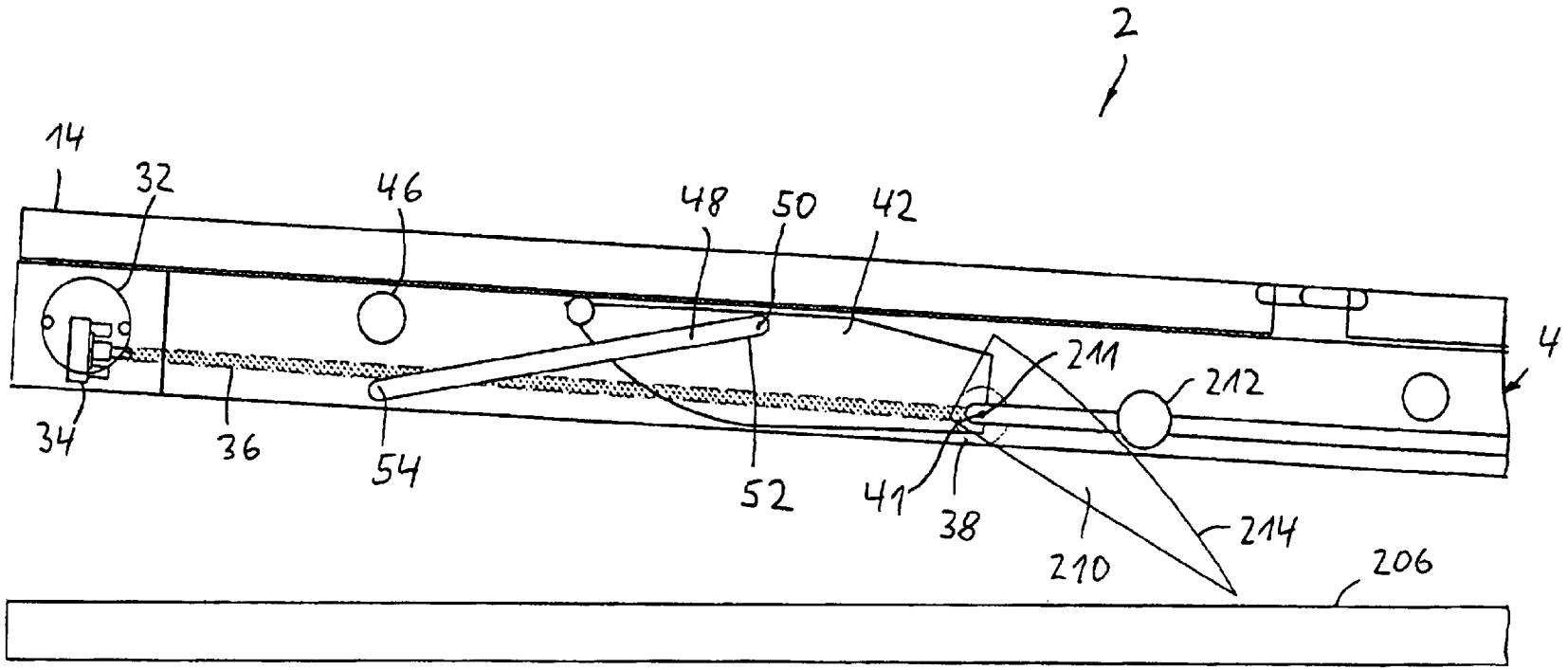
FIG. 22 shows a singularity from FIG. 21D in the area of the lower leg support element at a greatly enlarged scale.

FIG. 22 shows a singularity of FIG. 21D in the area of the pivot lever 210 in an enlarged illustration. In the example illustrated in FIG. 19, the actuators 46 and 48, or 76 that are assigned to the pivot levers 42, or 68, remain disengaged with a movement of the spindle nut 38 in FIG. 21A to the right so that only the entire base body 4 is tilted in this adjustment movement, however, the leg supporting element 10 and the lower leg element 14 are not adjusted relative to the central supporting element 6. However, it is also possible to arrange the pivot lever 210 and the actuator 212 in such a way that with a movement of the spindle nut in FIG. 21 to the left, the base body 4 is tilted relative to the bearing surface 206 and the leg supporting element 10 and the lower leg supporting element 14 are adjusted relative to the central supporting element 6. The tilt of the base body 4 relative to the bearing surface 206 may occur simultaneously, or successively offset to an adjustment of the support elements 10, 14.

Figure 23A:
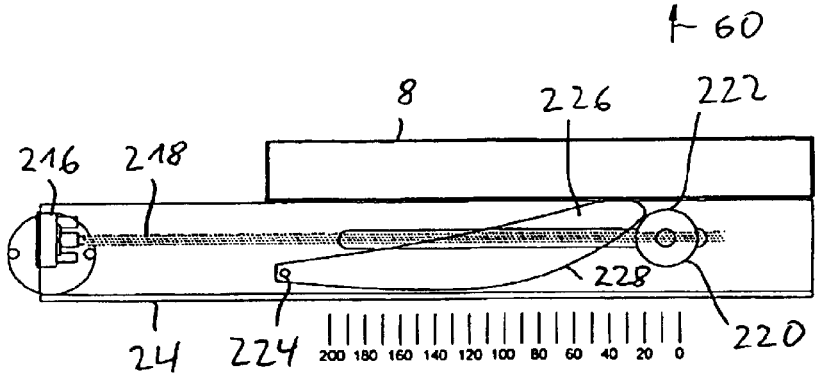
FIGS. 23A–23E shows an additional embodiment of an inventive adjusting device in various adjustment position in the same manner as FIG. 1.

FIG. 23A shows a further embodiment of an adjusting device that may serve, for instance, for the adjustment of the upper body supporting element 8 relative to the base body 4. In this embodiment, the adjusting device has an adjustment motor 216 that interacts in a pivot drive connection with a pivot driven fixed spindle 218, on which a spindle nut 220 is pivot proof and movable in axial direction is arranged. The spindle nut 220 is pivotably linked to a movable actuated roller that forms an actuator 222 for a pivot lever 226 around a pivot axis 224 that is parallel to the pivot axis of the upper body support element 8, and is pivotably linked to the interior surface of the longitudinal rail 24.

The adjustment motor 216, the fixed spindle 218, and the spindle nut 220 are received by the longitudinal rail 24 that is constructed as a hollow profile. In a first adjustment position illustrated in FIG. 23A, the pivot lever 226 is also received by the longitudinal rail 24. The upper body supporting element 8 is positioned loosely on the end of the pivot lever 226 that is opposite of the pivot axis 224, whereby the longitudinal rail 24 has a slot-shaped recess on the side opposite of the upper body support element, through which the pivot lever 226 extends for the adjustment of the upper body supporting element 8 toward the support side 60, as has been described, for instance, in FIG. 1 for the slot-shaped recess 62 and the pivot lever 42.

In order to adjust the upper body supporting element 8 relative to the base body, the adjustment motor 216 drives the fixed spindle 208 in such a way that the spindle nut 220 in FIG. 23 moves to the left. The actuator 222 at the abutting face 228 of the pivot lever 226 reaches the abutment that is tilted toward the linear movement axis of the spindle nut 220, and in this embodiment in a cross section, is constructed bow-shaped and convex toward the actuator 220.

Figure 23B:
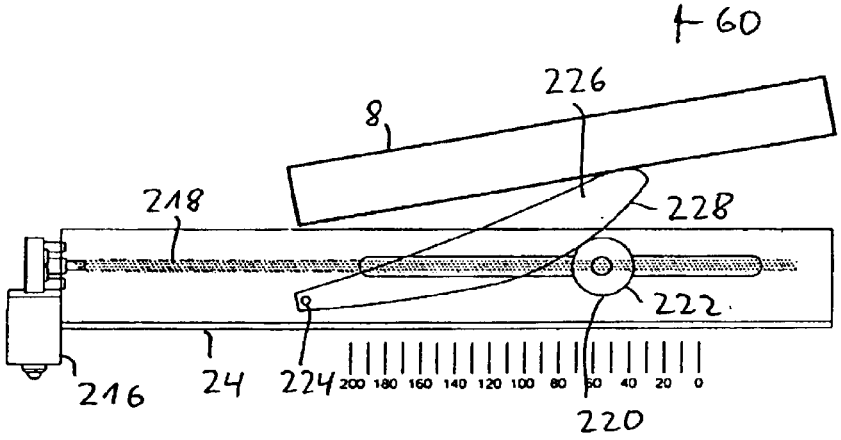
Figure 23C:
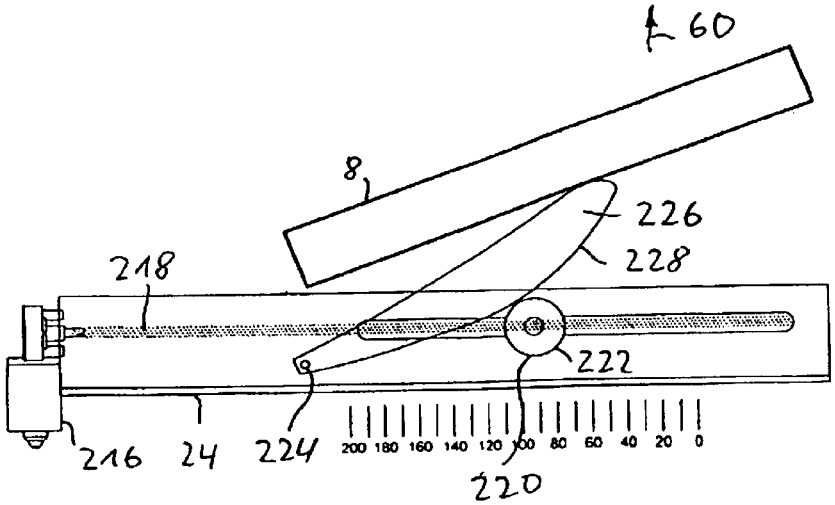
Figure 23D:
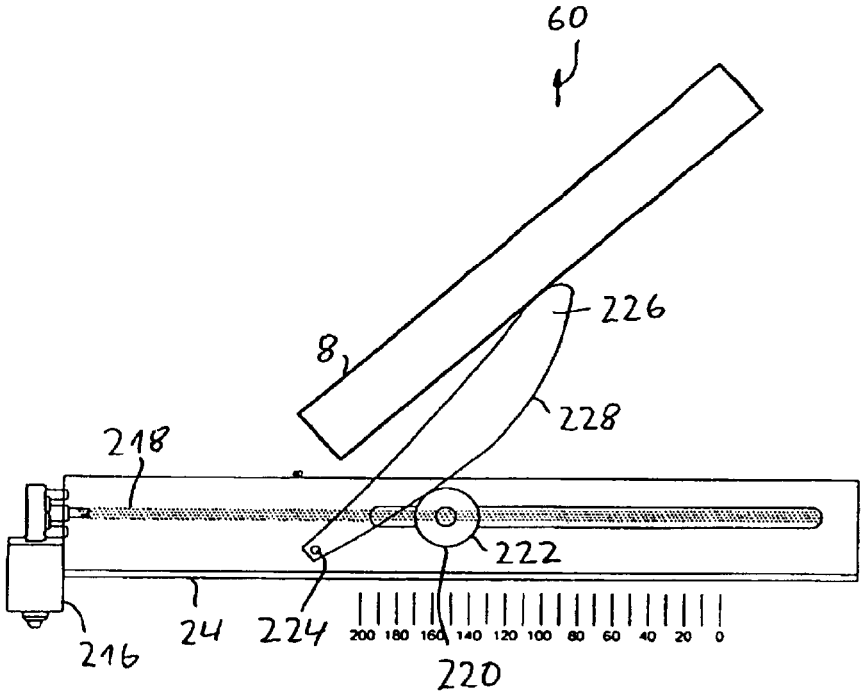
Figure 23E:
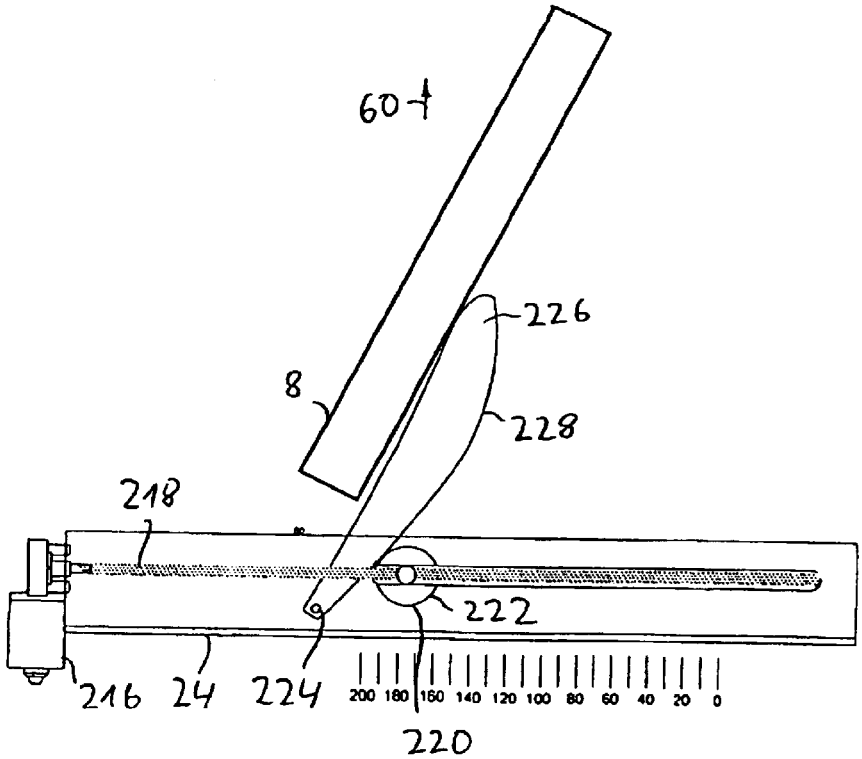

During the course of the adjustment movement, the pivot lever 226, by the effect of the actuator 224, pivots around its pivot axis 224 and thereby adjusts the upper body supporting element 8 relative to the base body 2 as is illustrated in FIGS. 23B to 23D, until the adjustment position illustrated in FIG. 23E has been achieved, which corresponds to a second end position of this adjustment movement, and in which the upper body supporting element 8 is pivoted by a maximum pivot angle relative to the base body 4. The reverse adjustment of the upper body supporting element 8 from the end position illustrated in FIG. 23E into the end position illustrated in FIG. 23A occurs by the dead weight of the upper body support element 8, however, with the adjustment motor 216 switched on, which drives the fixed spindle 218 in such a way that the spindle nut 222 in FIG. 23 moves to the right.

FIGS. 24A to 24E show a variation of the embodiment according to FIG. 23 that differs from the embodiment according FIG. 23A in that an additional angularly movable actuator in the form of a lever 230 is assigned to the pivot lever 226, the one end 232 of which is pivotably linked around a pivot axis 234 parallel to the pivot axis 224 to the pivot lever 232 at a distance of its pivot axis 224. The other end 236 of the lever 232 interacts with an abutment 238 during the course of the adjustment movement, which is constructed on the spindle nut 220 as is further explained in detail in FIGS. 24B to 24E.

In order to adjust the upper body supporting element 8 relative to the base body 2, the adjustment motor 216 drives the fixed spindle 218 in such a way that the spindle nut 220 in FIG. 24 moves to the left. The actuator 222 abuts to the abutting face 228 so that the pivot lever 226 pivots around the pivot axis 224 in a first movement phase of the adjustment movement as is illustrated in FIG. 24B. The lever 228 is disengaged from the abutment 238.

In a subsequent movement phase of the adjustment movement, the abutment 238 moves against the end 236 of the lever 230 so that it pivots its end 236, and thereby pivots the pivot lever 226 around its pivot axis 224, whereby the actuator 222 is disengaged from the abutting face 228.

Figure 24A:
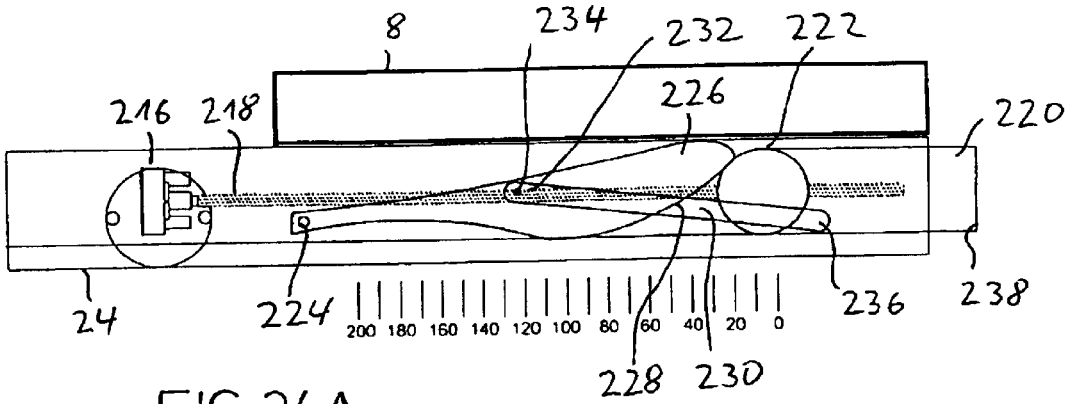
FIGS. 24A–24E shows a variation of the adjusting device according to FIG. 23 in the same manner as FIG. 23.
Figure 24B:
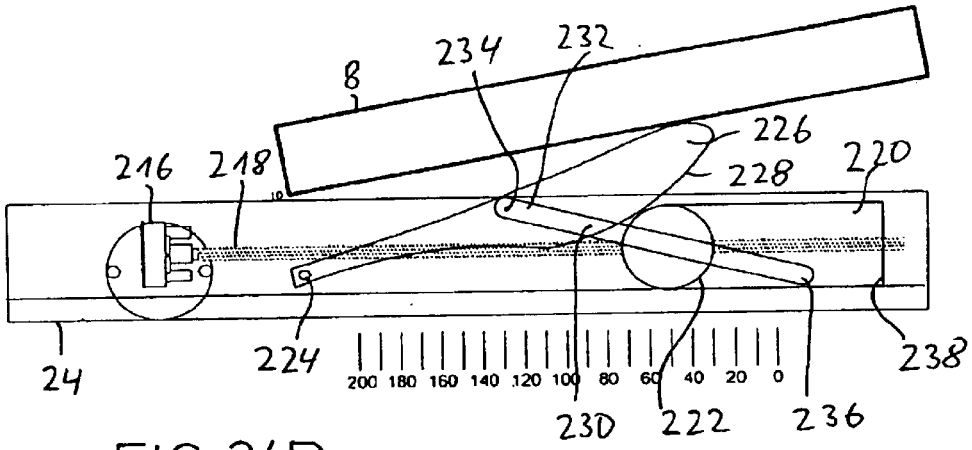
Figure 24C:
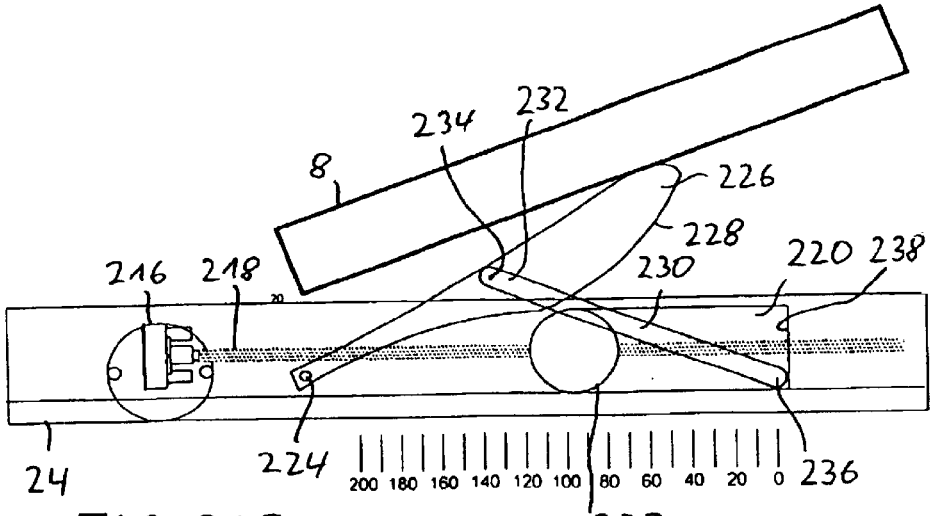
Figure 24D:
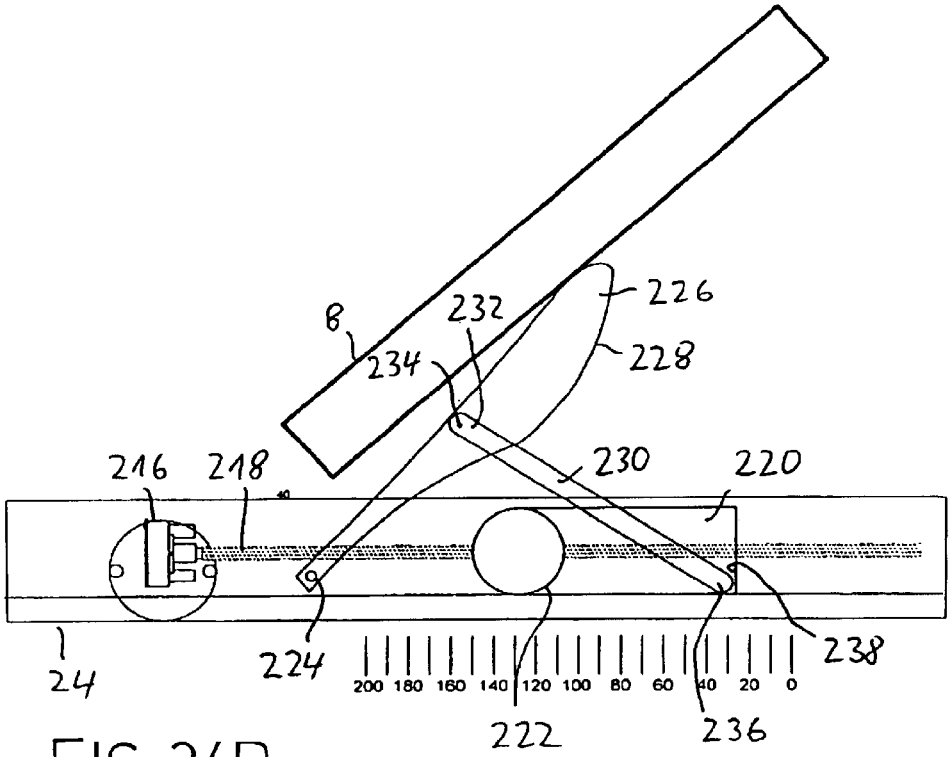
Figure 24E:
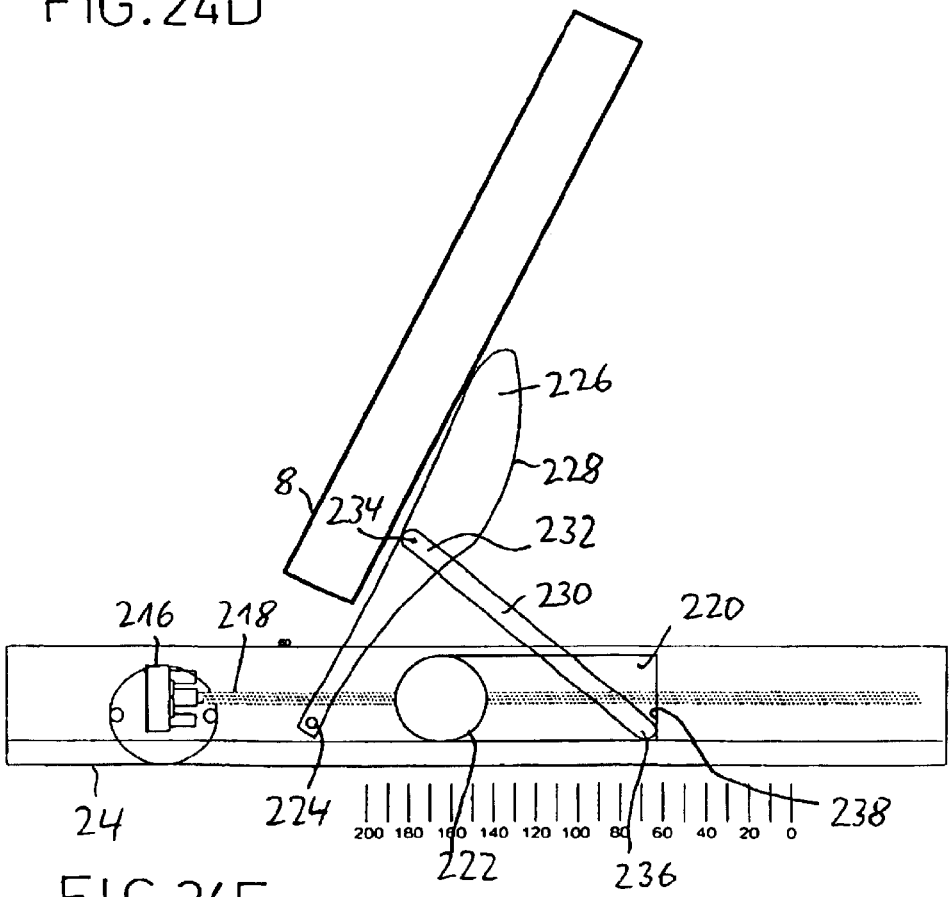

A further movement of the spindle nut 220 in FIG. 24 to the left, the pivot lever 226 continues to pivot around its pivot axis 224, and thereby adjusts the upper body supporting element 8 as is illustrated in FIG. 24D until the pivot position illustrated in FIG. 24E has been achieved, which corresponds to a second end position of the adjustment movement.

Due to the successive engagement of the actuators 224 and 230, an even application of force is achieved throughout the entire adjustment movement or phase in this embodiment.

FIG. 25 shows a variation of the embodiment according to FIG. 24, in which the actuator 222 constructed as a roller in conformity with the embodiment according to FIG. 24, and the angularly movable actuator constructed as the lever 230 are successively engaged. This variation differs from the embodiment according to FIG. 24 in that the end 236 of the lever 230 is pivotably linked to the spindle nut 220 around a pivot axis 240 parallel to the pivot axis 224 of the pivot lever 226. The other end 232 of the lever 230 is in this variation is fed on a guide relative to the pivot lever 226 and movably attached to it, whereby the guide is constructed of a slot 242 that is constructed on the pivot lever 226, in this the lever 230 engages with a pin 244 attached on its end 232 as is illustrated in FIG. 25B. An abutment 246 is constructed on the end of the slot 242 that is facing the pivot axis 224.

In order to adjust the upper body support element 8, the adjustment motor 216 drives the fixed spindle 218 in such a way that the spindle nut 220 in FIG. 25 moves to the left. The actuator 222 initially abuts the abutting face 228 of the pivot lever 226 so that it pivots around its pivot axis 224, and thereby pivots the upper body supporting element 8 relative to the base body 2. The pin 244 glides in the slot 242 without initially stopping at the abutment 246.

Figure 25A:
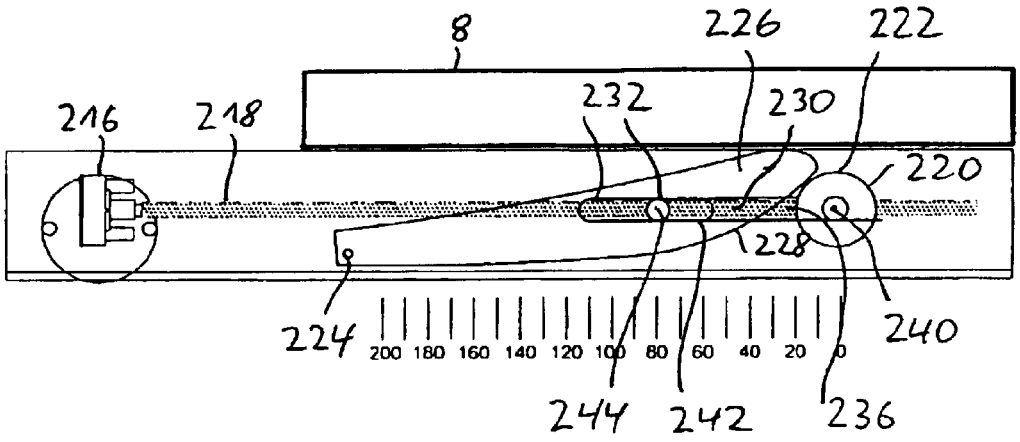
FIGS. 25A–25D shows a variation of the adjusting device according to FIG. 24 in the same manner as FIG. 24.
Figure 25B:
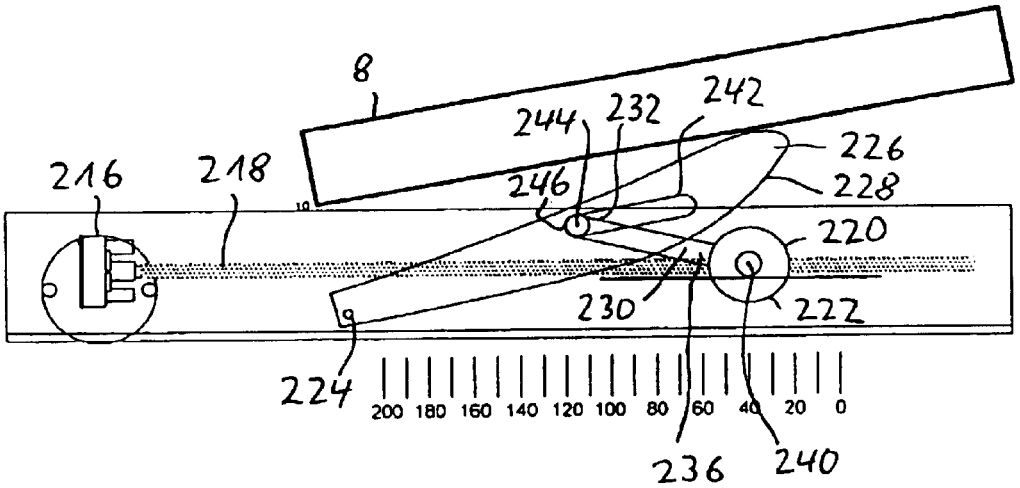
Figure 25C:
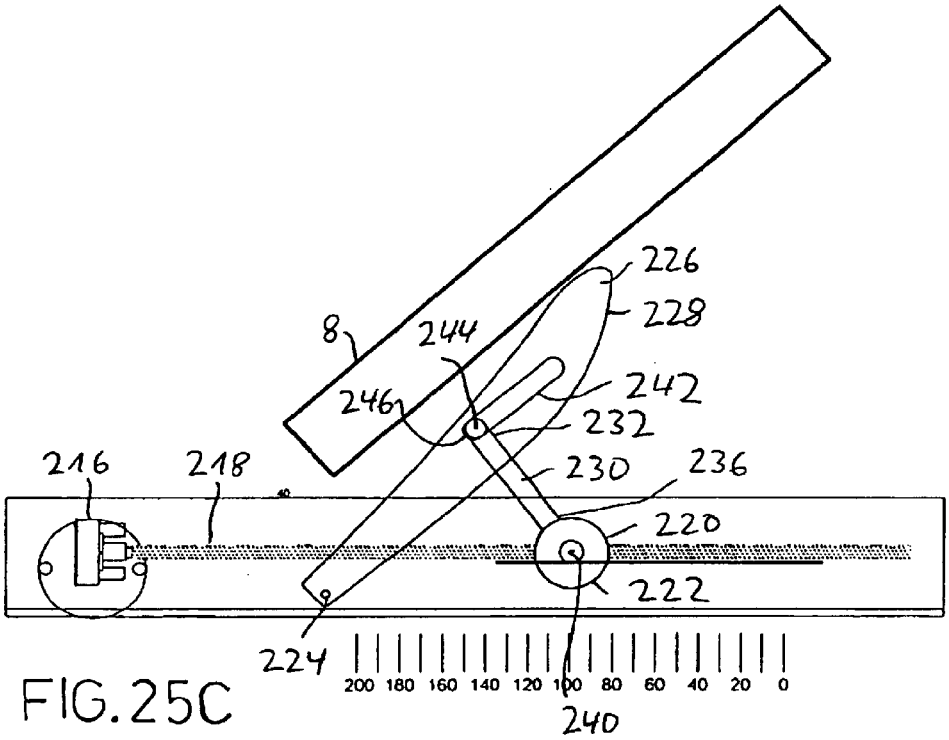
Figure 25D:
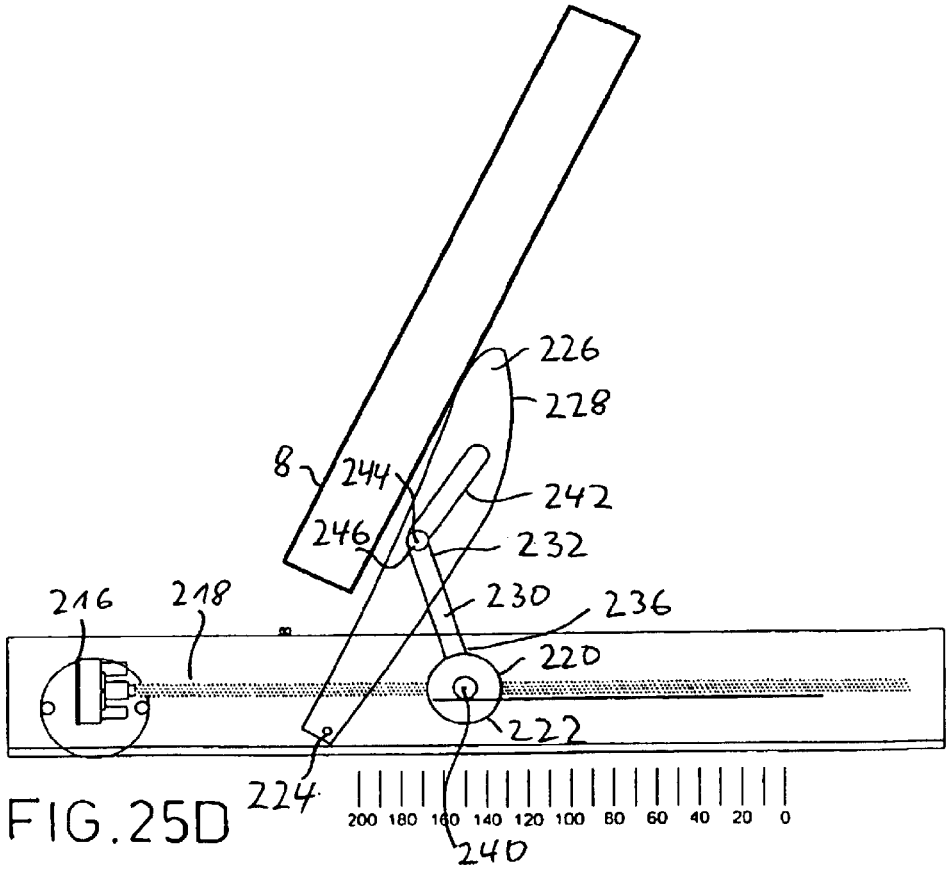

In the course of further adjustment movement, the pin 244 comes to a stop at the abutment 246 so that the pivot lever 226 is disengaged from the actuator 222, and further in the course of the adjustment movement pivots exclusively under the effect of the lever 230 around its pivot axis 224 as is illustrated in FIGS. 25B and 24C until the second end position of the adjustment movement has been achieved as illustrated in FIG. 25D.

FIG. 26 is a variation of the embodiment according to FIG. 25, in which the actuator 222 according to FIG. 25 is arranged at one end 247 of a two-armed lever 248, at which other end a pin 250 is arranged, which is fed in a guide at the longitudinal rail 24, which is constructed of a groove 252 constructed at the interior surface of the longitudinal that 24. At a distance of its ends 247, 249, the lever 248 is pivotably linked to the spindle nut 220 around a pivot axis 254 that is parallel to the pivot axis 224 of the pivot lever 226. In an adjustment position illustrated in FIG. 26A that corresponds to a first end position of the adjustment movement, the fixed spindle 218 extends essentially parallel to the groove 252. The fixed spindle 218 is tiltably linked at the longitudinal rail 24 around an axis parallel to the pivot axis 224 as is further explained in detail in FIGS. 26D and 26E.

In order to pivot the upper body supporting element 8 relative to the base body 4, the adjustment motor 216 drives the fixed spindle 218 in such a way that the spindle nut 222 in FIG. 26 moves to the left. The actuator 222 stops at the abutting face 228 of the pivot lever 226 so that the pivot lever 226 pivots around its pivot axis 224 during the further course of the adjustment movement as is illustrated in FIGS. 26B and 26C. The actuator 222 supports itself on a support surface 256, whereby the tilt angle of the lever 248 remains unchanged relative to the fixed spindle 218 as is illustrated in FIGS. 26A and 26B.

Figure 26A:
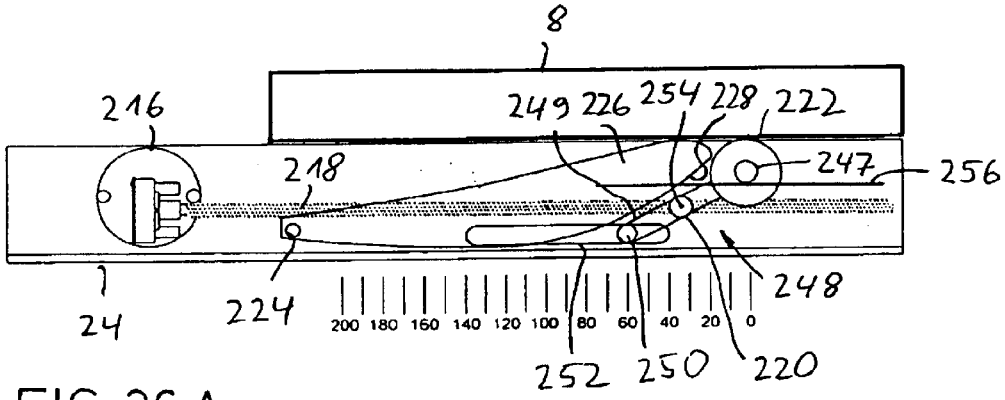
FIGS. 26A–26E shows a variation of the adjusting device according to FIG. 25 in the same manner as FIG. 25.
Figure 26B:
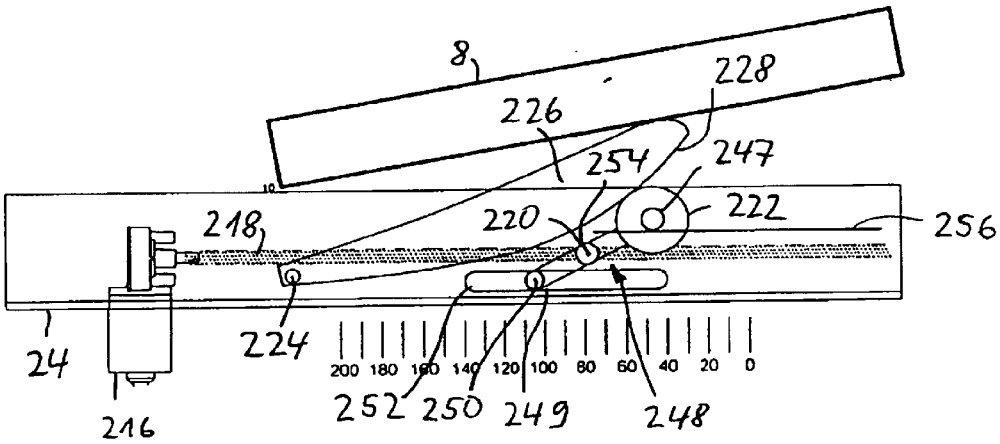
Figure 26C:
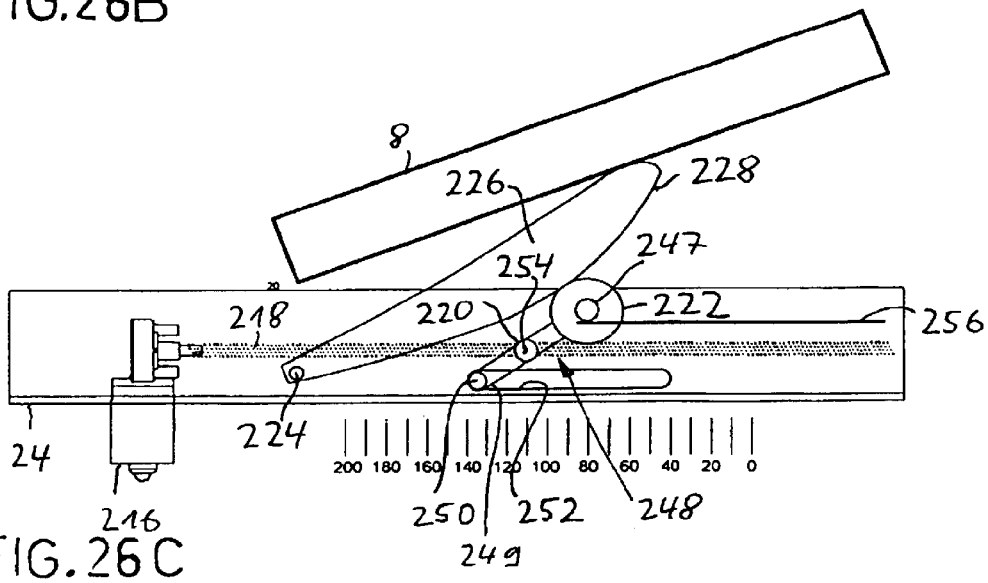
Figure 26D:
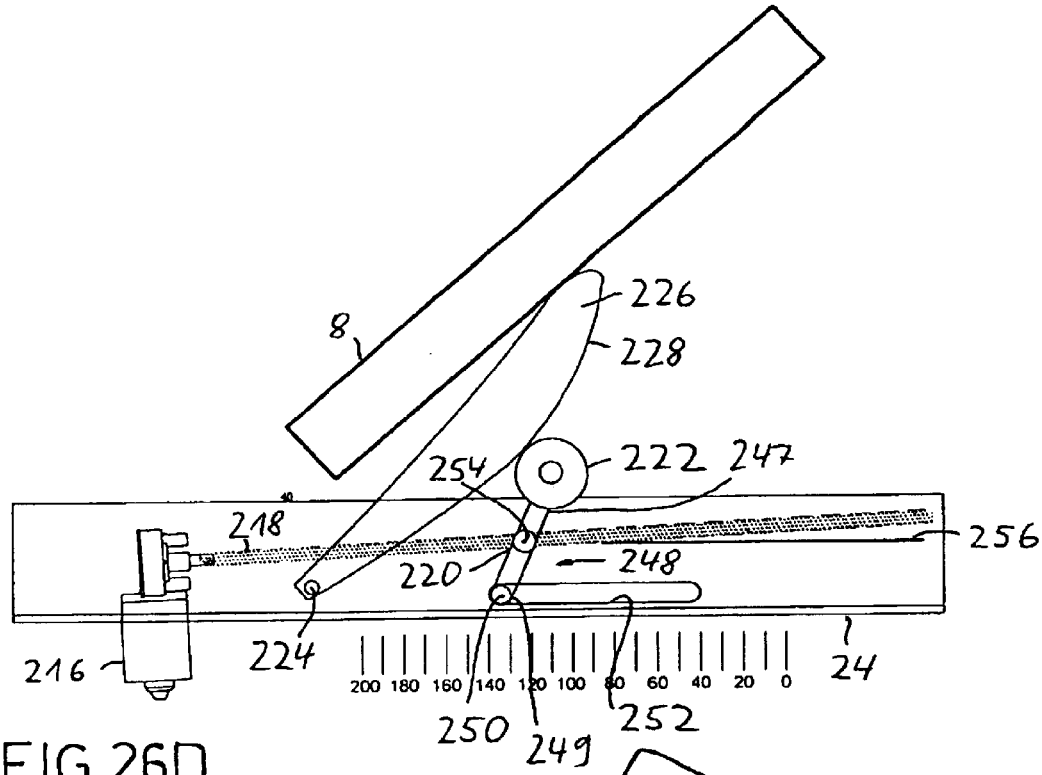
Figure 26E:
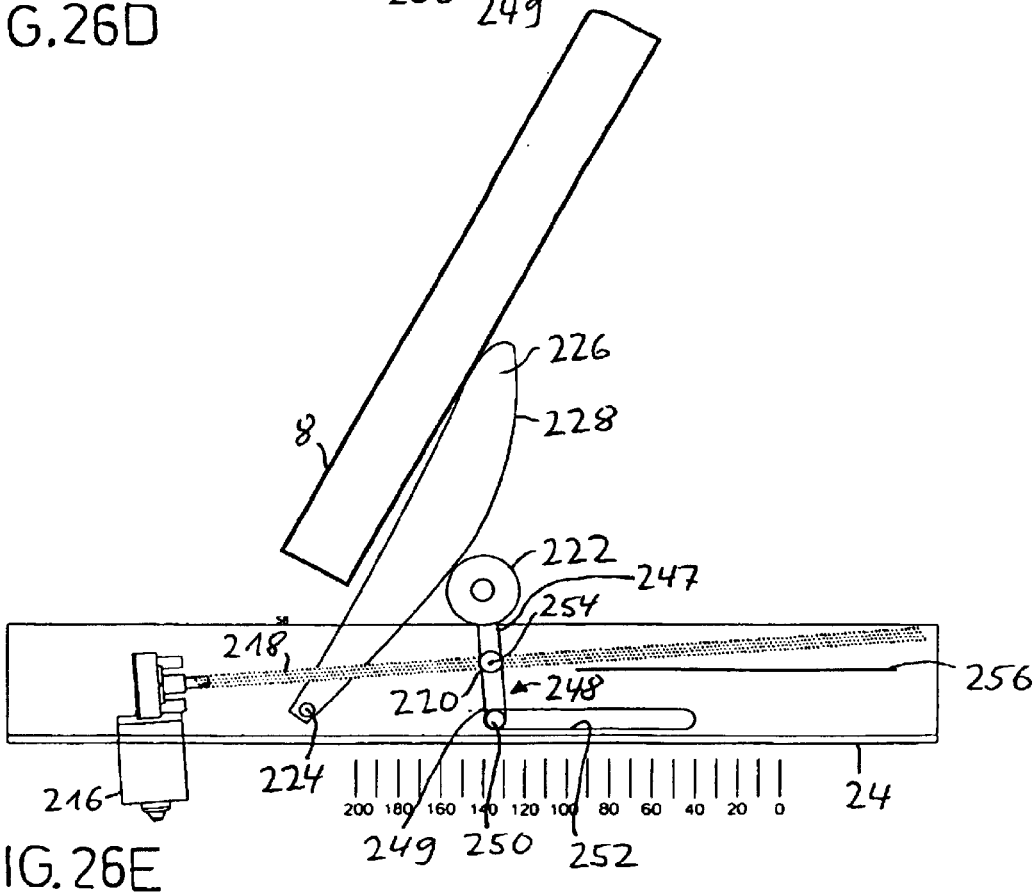

In the course of further adjustment movement, the pin 250 arranged at the end 249 of the lever 248 stops at a stop unit constructed at one end of the groove 252 as illustrated in FIG. 26C. This causes the lever 248 to pivot around its pivot axis 254, whereby the pivot lever 226 continues to pivot around its pivot axis 224 and thereby continues to adjust the upper body support element 8. In order to follow the kinematics of the lever 248, the fixed spindle 218 tilts around the axis assigned to it as illustrated in FIG. 26D, until the adjustment position illustrated in FIG. 26E has been achieved, which represents a second end position of the adjustment movement. The comparisons of FIGS. 26C and 26D show that the actuator 222 is disengaged from the support surface 256 when the lever 248 pivots around its pivot axis 254.

FIG. 27 shows a variation of the embodiment according to FIG. 25, which initially differs from the embodiment according to FIG. 25 in that the pivot lever 226 is not linked to the longitudinal rail 24, but is rather pivotably linked to the spindle nut 220 around its pivot axis 224. This variation further differs in that the actuator 222 is not arranged on the spindle nut 220, but rather locally fixed at an interior surface of the longitudinal rail 24. This variation therefore represents a kinematic reverse operation of the embodiment according to FIG. 25 in that the pivot lever 226 is linear movable arranged along the movement axis of the spindle nut 220, and the actuator 222 is locally fixed. Furthermore, an angularly movable actuator in the form of a lever 260 is intended in this variation, the one end 262 of which is pivotably linked to the pivot lever 226 at a distance of its pivot axis 224 around a pivot axis 264. The other end 266 of the lever 260 is fed in a guide linear movable with a pin 268, which is constructed of a groove 270 that is constructed on an interior wall of the longitudinal rail 24 in this embodiment.

In order to adjust the upper body supporting element 8 relative to the base body 4, the adjustment motor 216 drives the fixed spindle 218 in such a way that the spindle nut 220 in FIG. 27 moves to the right. In a first phase of the adjustment movement, the pivot lever 226 abuts the actuator 222 with its abutting face 228 so that the pivot lever 226 pivots around its pivot axis 224 in the further course of the adjustment movement, and thereby pivots the upper body supporting element 8 as is illustrated in FIG. 27B.

Figure 27A:
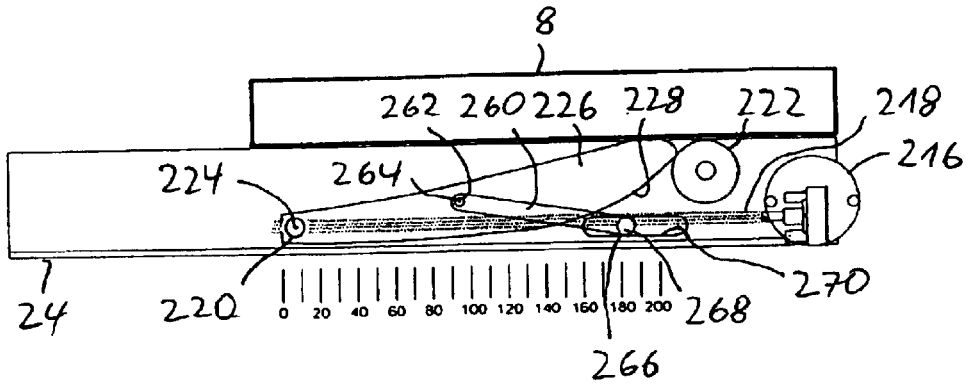
FIGS. 27A–27D shows a variation of the adjusting device according to FIG. 25 in the same manner as FIG. 25.
Figure 27B:
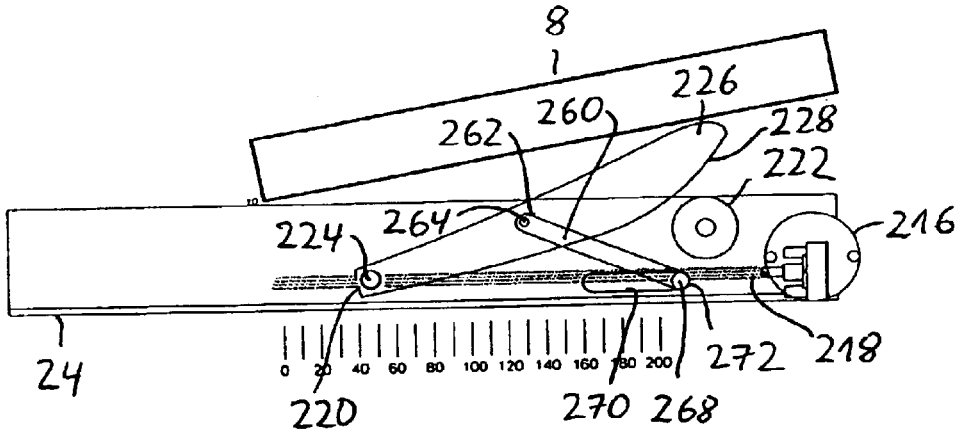

In the further course of the adjustment movement, the end 266 of the lever 260 fed in the groove 270 by means of the pin 268 abuts at a stop unit 272 constructed at one end of the groove so that the lever 260 pivots around its end 266, and thereby continues to adjust the upper body support element 8, whereby the abutting face 228 of the pivot lever 226 is disengaged from the actuator 222 as is illustrated in FIG. 27B.

Figure 27C:
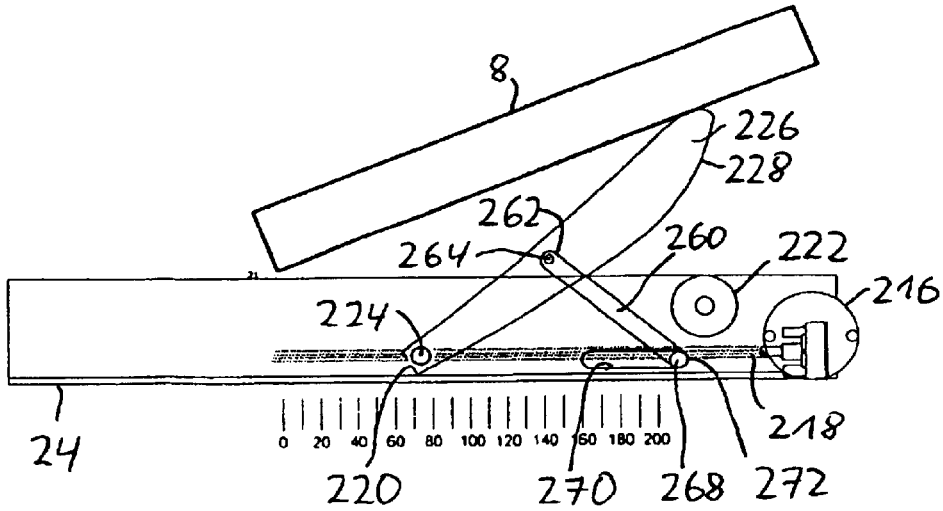
Figure 27D:
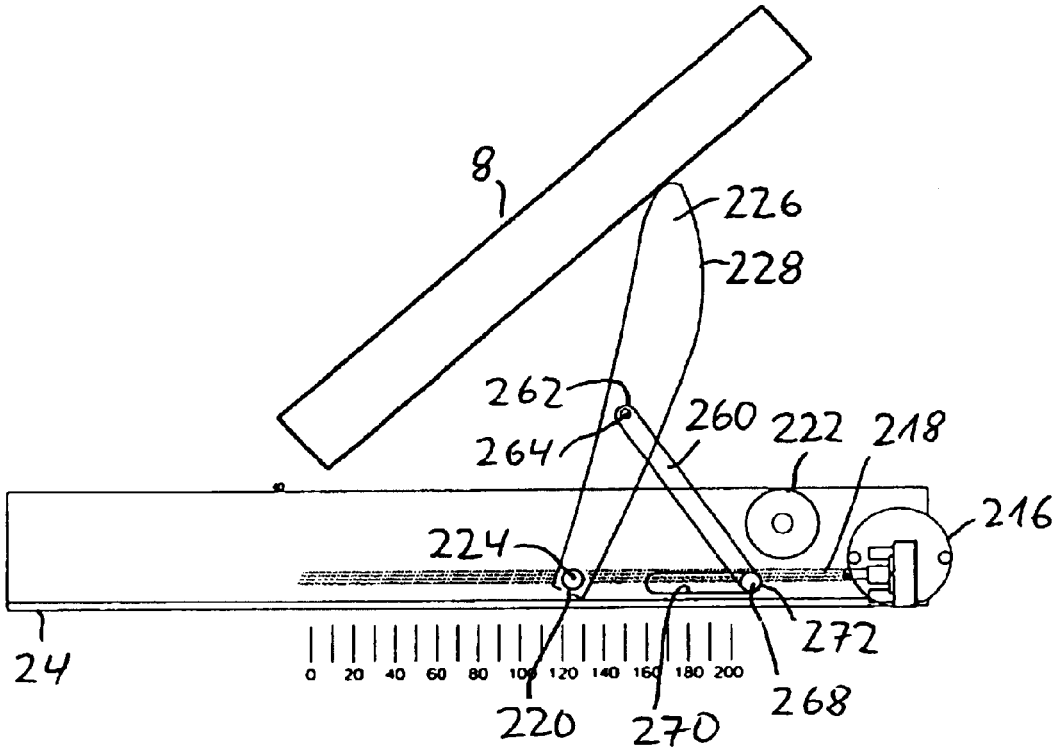

In the further course of the adjustment movement, the pivot lever 226 continues to pivot around its pivot axis 224, and thereby adjusts the upper body supporting element 8 as illustrated in FIG. 27C until the adjustment position illustrated in FIG. 27D has been achieved, which corresponds to a second end position of the adjustment movement.

FIG. 28 shows a variation of the embodiment according to FIG. 27 that differs from it in that the lever is pivotably linked to an interior wall of the longitudinal rail 24 around a pivot axis 274 parallel to the pivot axis 224 of the pivot lever 226. The other end 266 of the lever 260 is together with the pin 268 linear offset linked to a guide constructed at the pivot lever 226 at a distance of its pivot axis 224. The guide in this embodiment is constructed of a straight slot, the longitudinal axis of which forms an acute angle with the linear movement axis of the spindle nut 220 in each phase of the adjustment movement. A stop unit 278 is constructed at one end of the slot 276.

In order to adjust the upper body supporting element 8 relative to the base body 4, the adjustment motor 216 drives the fixed spindle 218 in such a way that the spindle nut 220 in FIG. 28 moves to the right. In a first phase of the adjustment movement, the pivot lever 226 abuts the actuator 222 with its abutting face 228 so that the pivot lever 226 pivots around its pivot axis 224, and thereby pivots the upper body supporting element 8 as is illustrated in FIG. 28B. The end 266 of the lever 260 glides in the groove 276 with the pin 266.

Figure 28A:
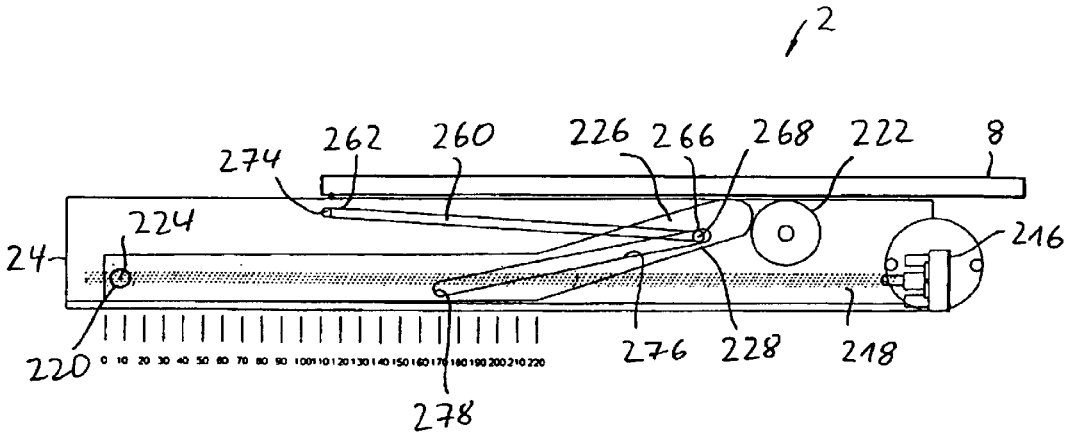
FIGS. 28A–28E shows a variation of the adjusting device according to FIG. 27 in the same manner as FIG. 27.
Figure 28B:
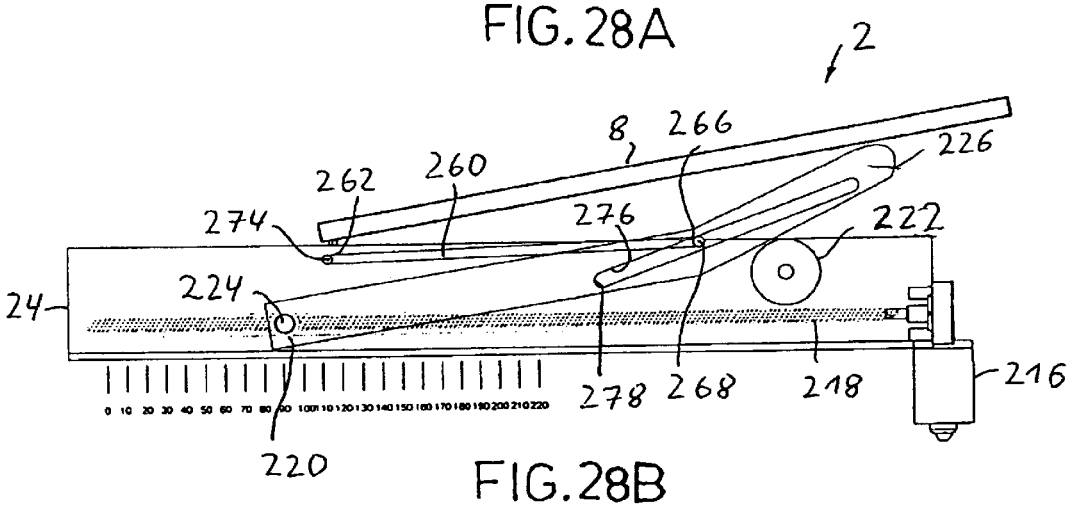
Figure 28C:
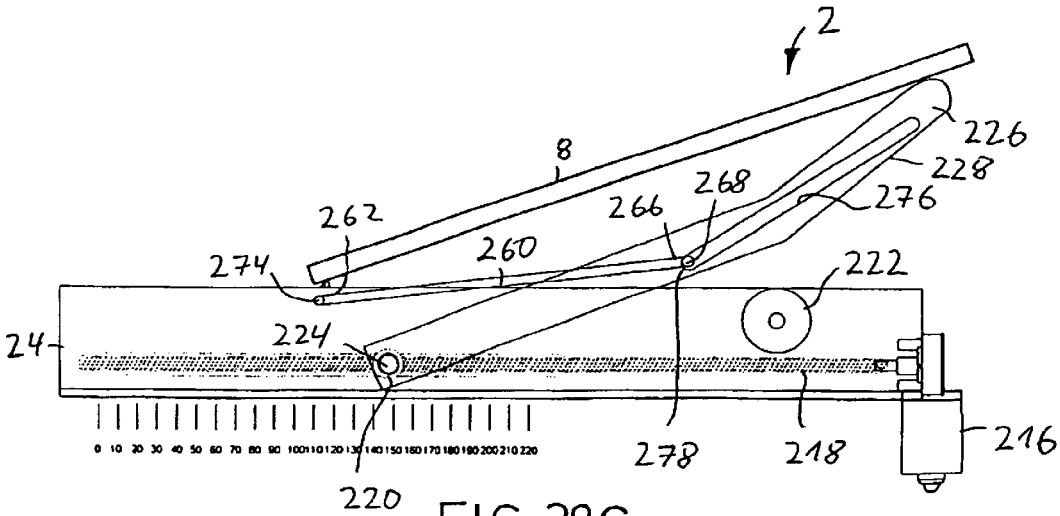
Figure 28D:
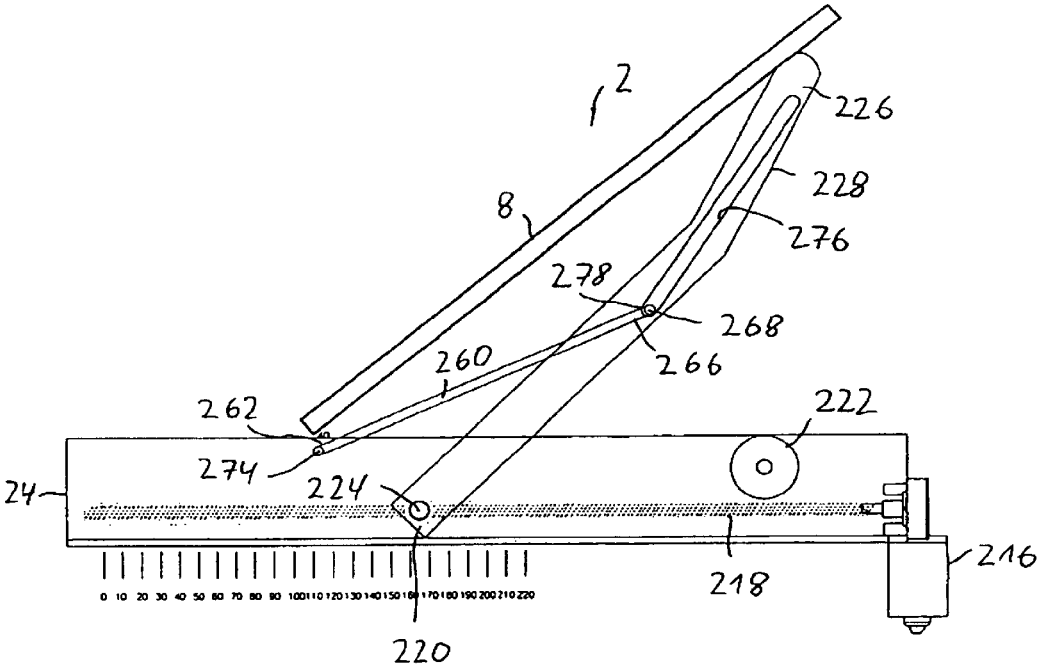
Figure 28E:
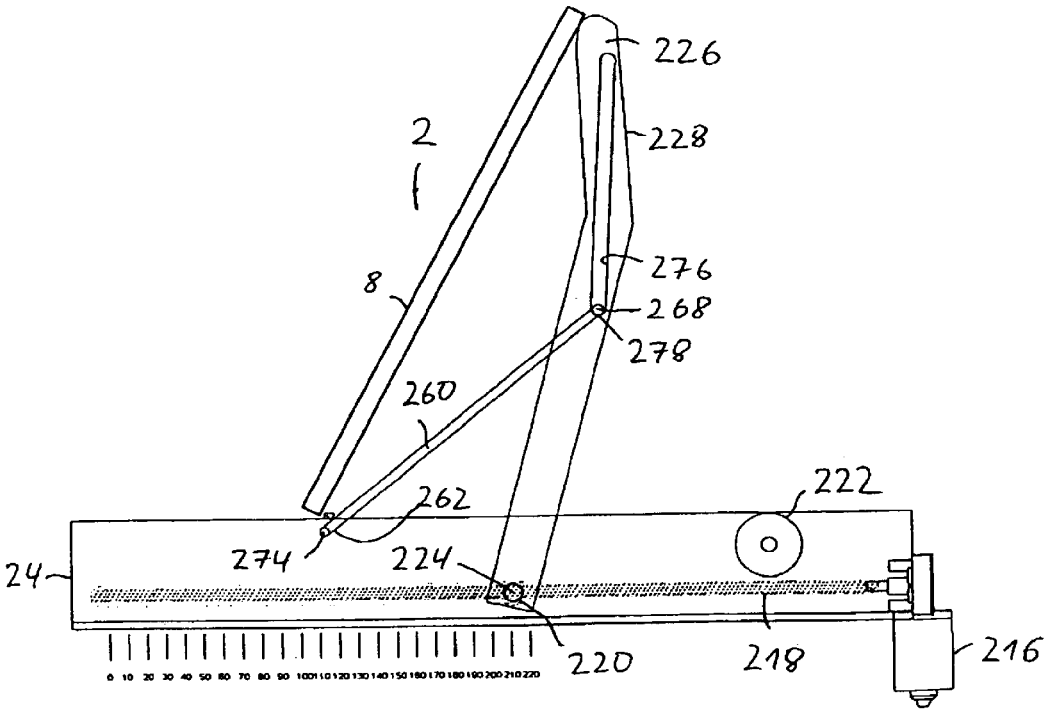
Figure 29A:
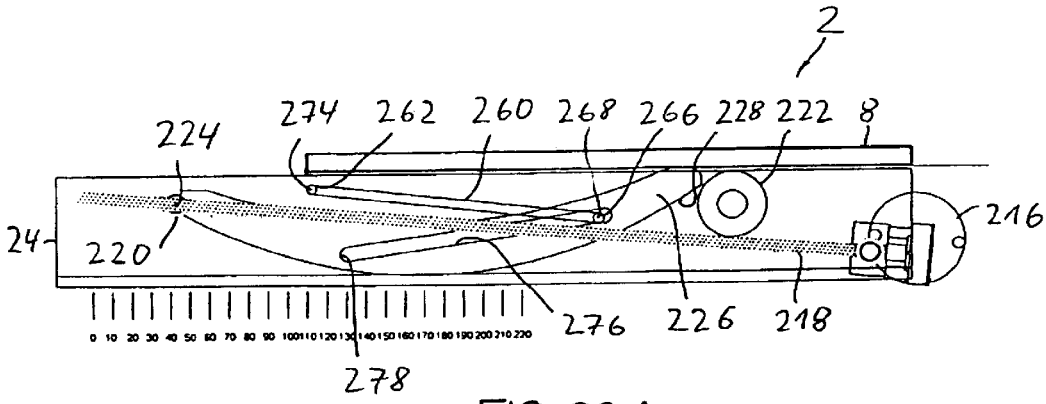
FIGS. 29A–29E shows a variation of the adjusting device according to FIG. 28 in the same manner as FIG. 28.
Figure 29B:
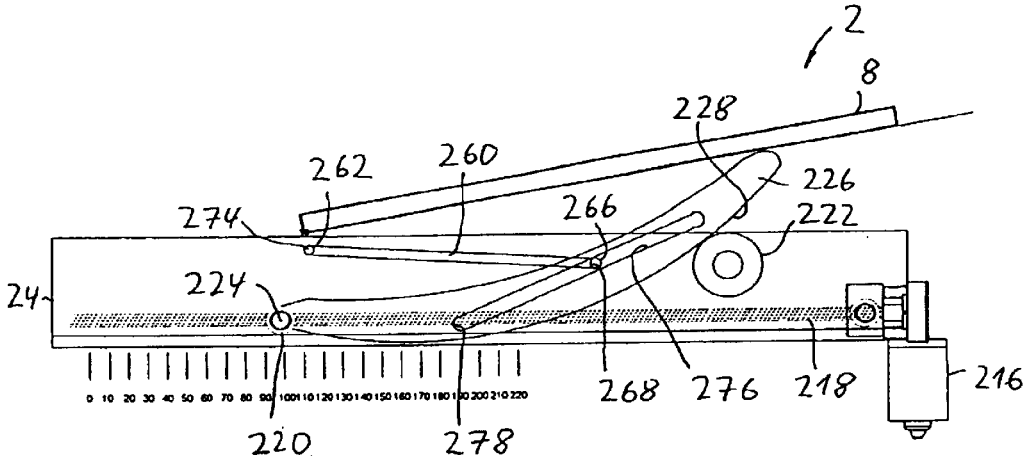
Figure 29C:
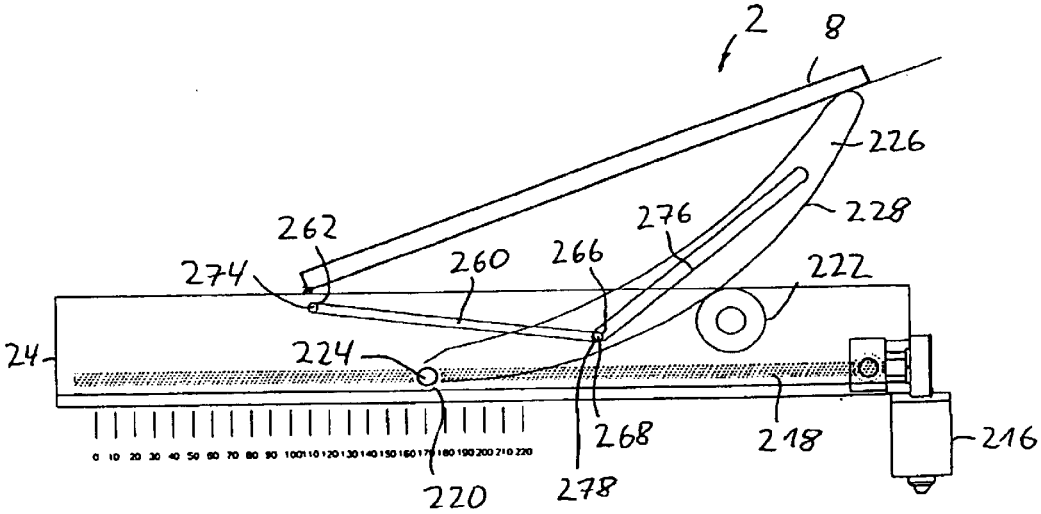
Figure 29D:
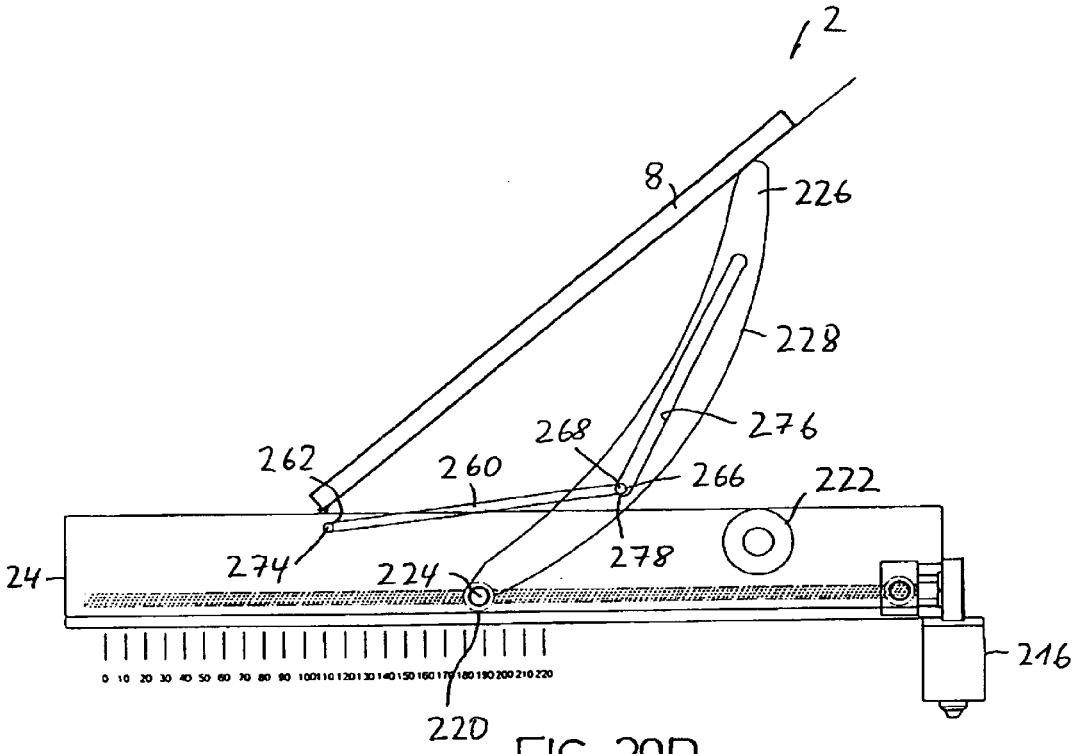
Figure 29E:
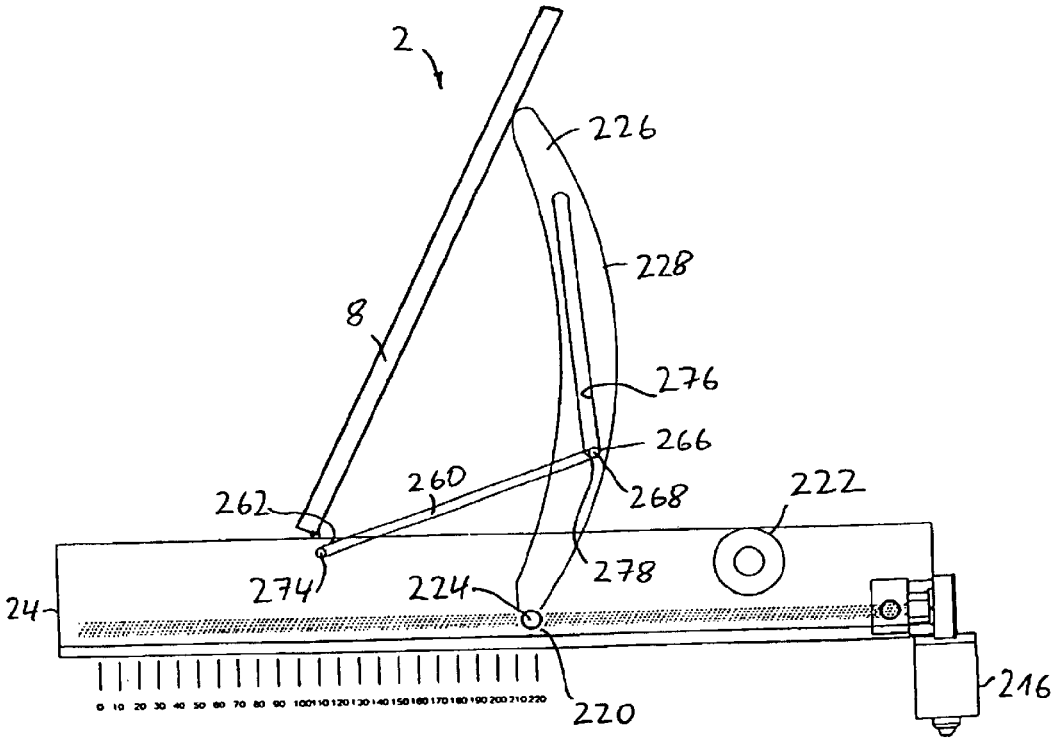
Figure 30A:
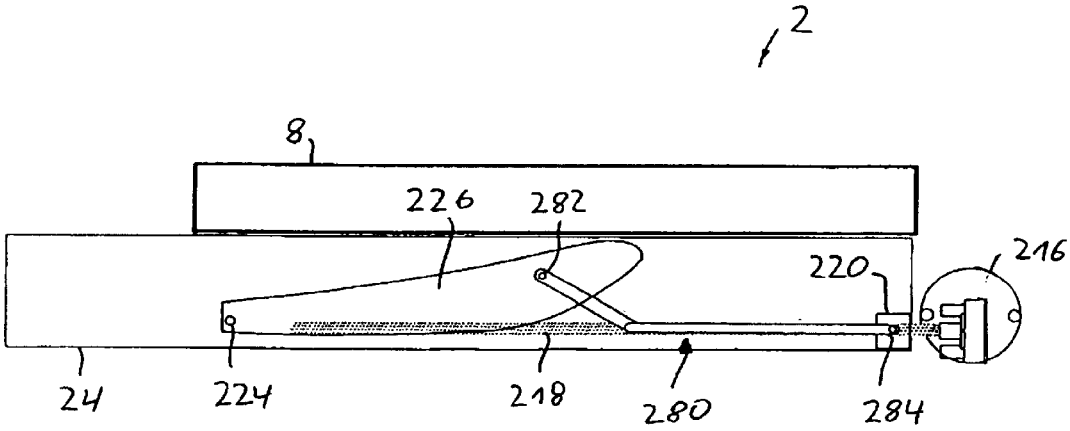
FIG. 30 shows a variation of the adjusting device according to FIG. 23 in the same manner as FIG. 23.
Figure 30B:
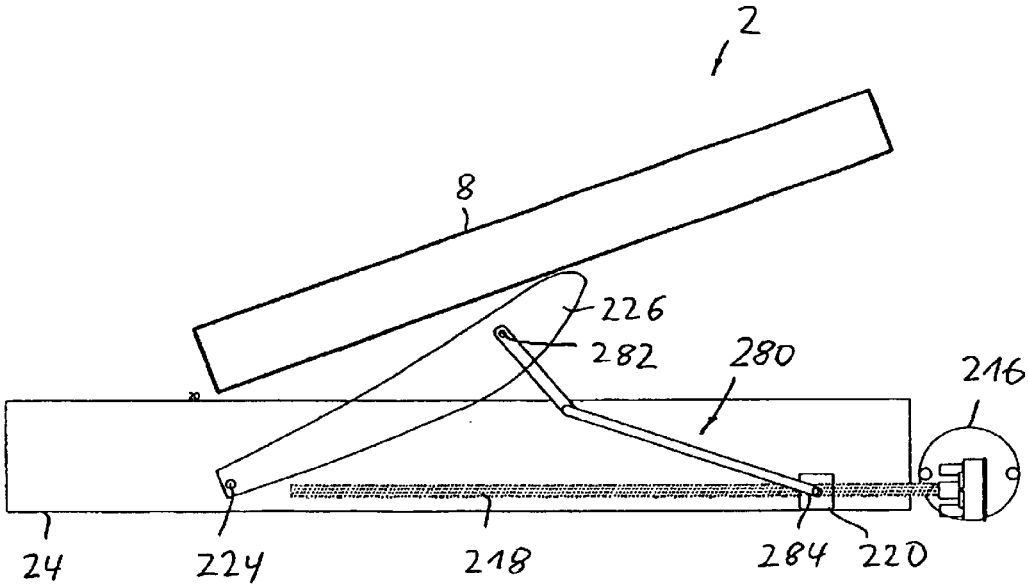
Figure 30C:
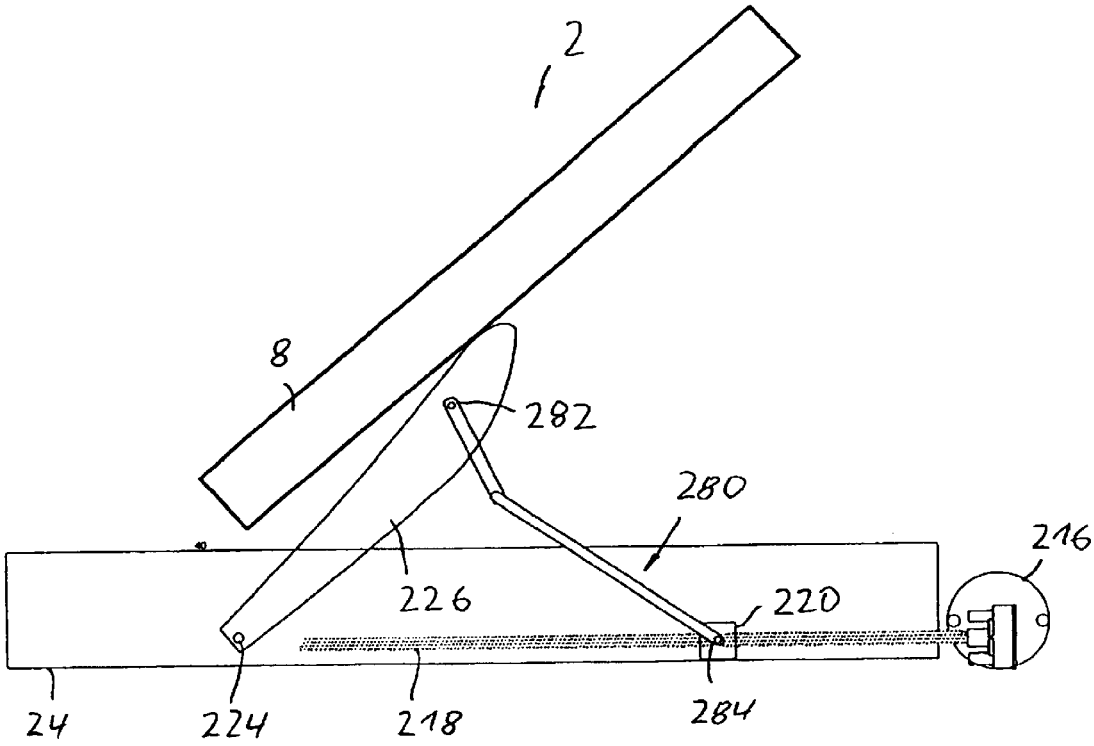
Figure 30D:
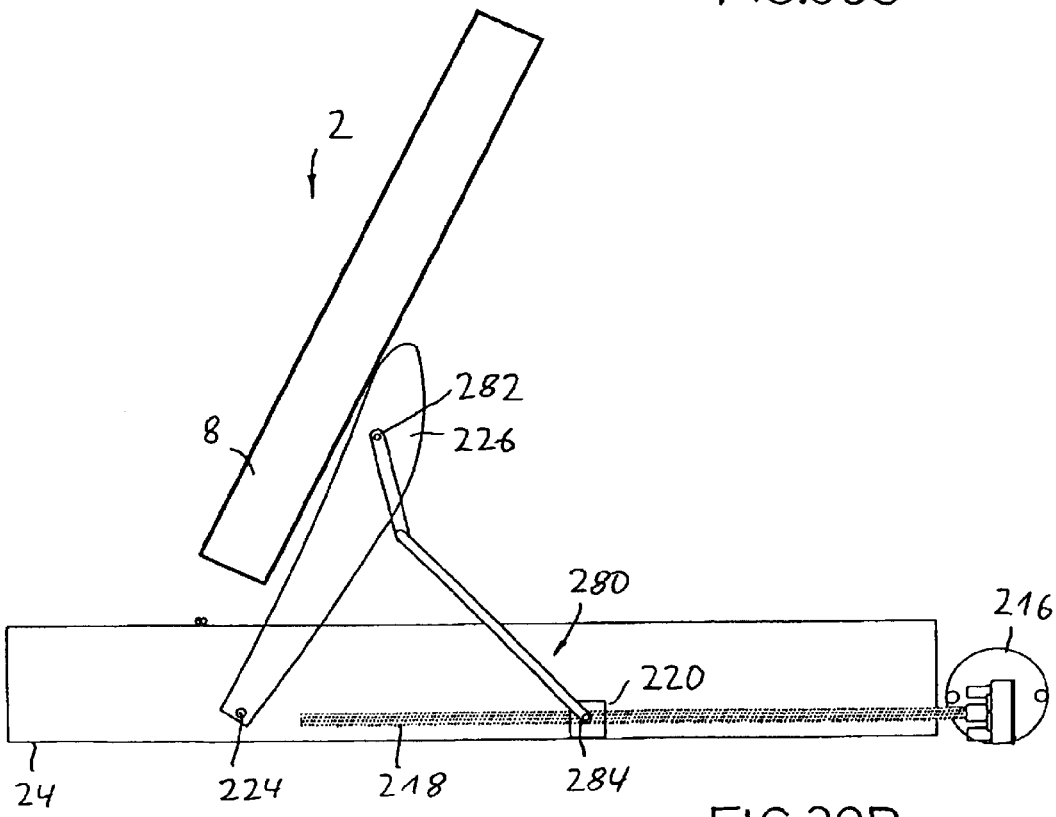

In the further course of the adjustment movement, the end 266 of the lever 260 abuts the stop unit 278 with the pin 268 so that the abutting face 228 of the pivot lever 260 is disengaged from the actuator 222, and the pivot lever 226 subsequently continues to pivot exclusively under the effect of the lever 260 around its pivot axis 224 as is illustrated in FIGS. 28C and 28D until the adjustment position illustrated in FIG. 28E has been achieved, which corresponds to the second end position of the adjustment movement.

FIG. 29 shows a variation of the embodiment according to FIG. 28 that differs from it in that the fixed spindle 218 is tiltably linked around an axis parallel to the pivot axis 224 of the pivot lever 226, and that tilts during the course of the adjustment movement in order to follow the kinematics of the pivot lever 226, which is predetermined by the form of the pivot lever 226 and the course of the groove 226 relative to the movement axis of the spindle nut 220. FIGS. 29A to 29E show different adjustment positions of the adjustment movement, whereby FIG. 29A shows the first end position, and FIG. 29E shows the second end position.

FIG. 30 illustrates an additional variation of the embodiment according to FIG. 23 that differs from it in that an angularly movable actuator in the form of an angle lever 280 is intended for the pivoting operation of the pivot lever 226, the lever arms of which are pivot proof connected with each other. One end 282 is pivotably linked to the pivot lever 226 around an axis parallel to the pivot axis 224 of the pivot lever 226 at a distance of its pivot axis 224. The other end 284 of the angle lever 280 is pivotably linked to the spindle nut 220 around a pivot axis parallel to the pivot axis 224 of the pivot lever 226. In order to adjust the upper body support element 8, the adjustment motor 216 drives the fixed spindle 218 in such a way that the spindle nut 220 in FIG. 30 moves to the left so that the angle lever 280 changes its angle position, and the pivot lever 226 pivots so that the upper body supporting element 8 also pivots around its pivot axis, as illustrated in FIGS. 30B and 30C, until the second end position of the adjustment movement illustrated in FIG. 30D has been achieved.

FIG. 31 shows an additional embodiment of coupling means for the coupling of the movement of an adjusting device to the movement of another adjusting device. In this embodiment, the adjusting device 18 has an adjustment motor 286 that interacts with a fixed spindle 288 in a pivot drive connection by means of a not illustrated angular gear, on which a pivot proof spindle nut 290 is arranged movable in axial direction of the fixed spindle 288. A base element 294 of the adjusting device 16 is connected to the spindle nut 290 by means of a rod-shaped coupling element 292, that is offset fed in the longitudinal rail 24 in the direction of the movement axis of the spindle nut 290. In order to adjust the lower leg supporting element 14, an adjustment lever 296 is intended, the one end of which is pivotably linked to the base element 294 around an axis parallel to the pivot axis 138 between the leg supporting element 10 and the lower leg supporting element 14, and the other end of which is pivotably linked to the lower leg supporting element 14 around an axis parallel to the pivot axis 138.

For the coupling of a linear movement of the adjusting device 18 to a linear movement of the adjusting device 16, an additional rod-shaped coupling element 298 is intended, the one end of which is firmly connected to a linear base element 300 of the adjusting device 18 that is offset fed in a longitudinal rail 24 in the direction of the movement axis of the spindle nut 290. The end of the coupling element 298 opposite of the base element 300 of the adjusting device 18 has a guide in the form of an elongated straight slot 302 that is firmly connected to the base element 294 of the adjusting device 16. A stop unit 306 is constructed at one end of the slot 302.

In order to adjust the leg supporting element 10, the adjusting device 18 has an adjustment lever 308, the one end of which is pivotably linked to the base element 300 of the adjusting device 18 around an axis parallel to the pivot axis 138 between the leg supporting element 10 and the lower leg supporting element 14, and the other end of which is pivotably linked to the leg supporting element 10 around an axis parallel to the pivot axis 138.

Figure 31A:
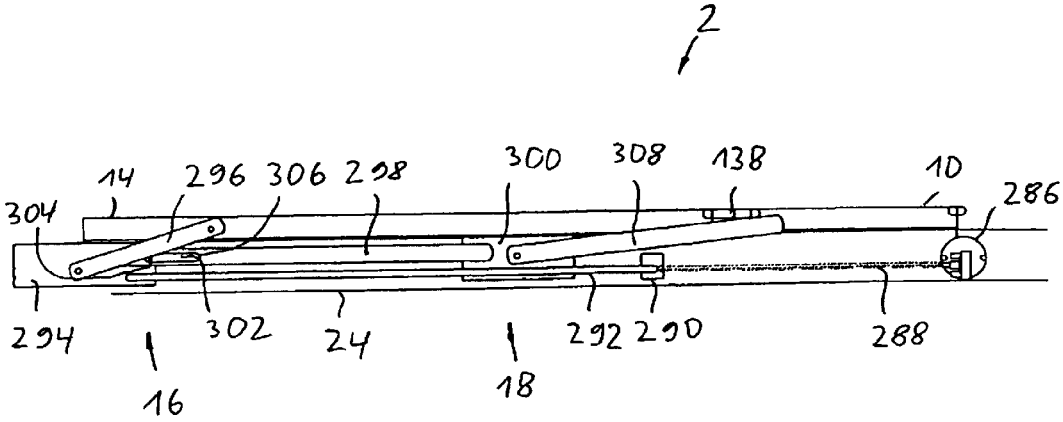
FIG. 31 shows an additional embodiment of an inventive support device in the same manner as FIG. 7.
Figure 31B:
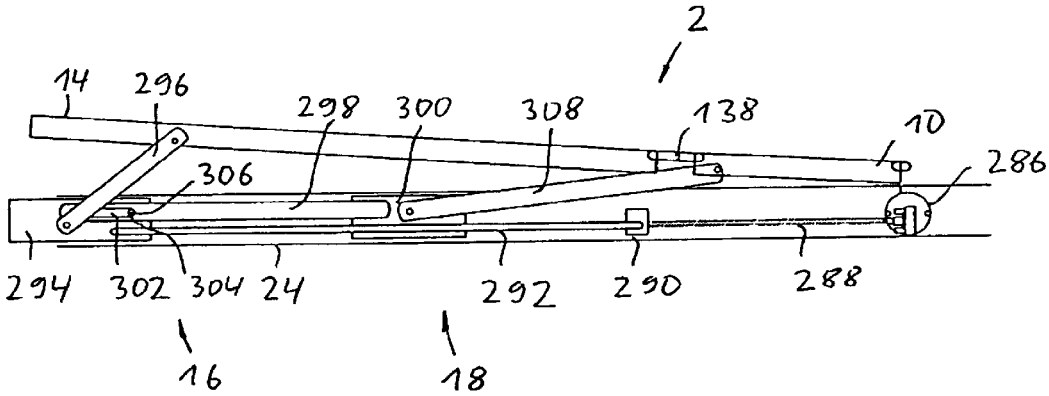
Figure 31C:
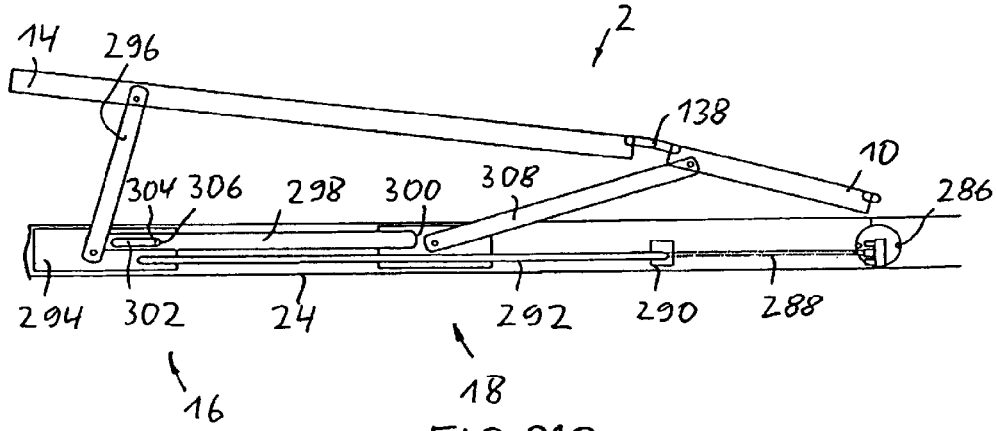

FIG. 31A represents a first end position of the adjustment movement in which the leg supporting element 10 and the lower leg supporting element 14 are not adjusted relative to the base body 4. In order to adjust the support elements 10, 14, the adjustment motor 286 drives the fixed spindle 288 in such a way that the spindle nut 290 in FIG. 31 moves to the right. Due to the coupling of the base element 294 to the spindle nut 290, the base element 294 in FIG. 31 moves to the right, whereby the adjustment lever 296 pivots around its end that is lined to the base element 294, and thereby tilts the lower leg supporting element 14 together with the leg supporting element 10 as illustrated in FIG. 31B.

In this first phase of the adjustment movement, the pin 304 in the slot 302 moves to the right, however is still at a distance from the stop unit 306. This way, the adjusting device 18 is decoupled from the adjusting device 16 in this first phase so that the coupling element 298 does not exert any force on the base element 300 of the adjusting device 18 in this phase. In this first phase, the adjustment lever 308 merely follows the tilt of the leg supporting element 10, and pivots as is illustrated in FIG. 31B. Although the leg supporting element 10 and the lower leg supporting element 14 are tilted together relative to the base body 4 in this first phase of the adjustment movement, they are not adjusted relative to each other, however.

In a second phase of the adjustment movement, the pin 304 of the base element 294 abuts the stop unit 306 in the coupling element 298 so that in the further course of the adjustment movement, the base element 300 is coupled to the base element 294 by means of the coupling element 298, and can be stressed by pressure so that the base element 300 under pressure forces of the coupling element 298 moves to the right together with the base element 294 in FIG. 31. The adjustment lever 308 pivots so that the leg supporting element 10 is adjusted relative to the lower leg supporting element 14 as is illustrated in FIG. 31C.

Figure 31D:
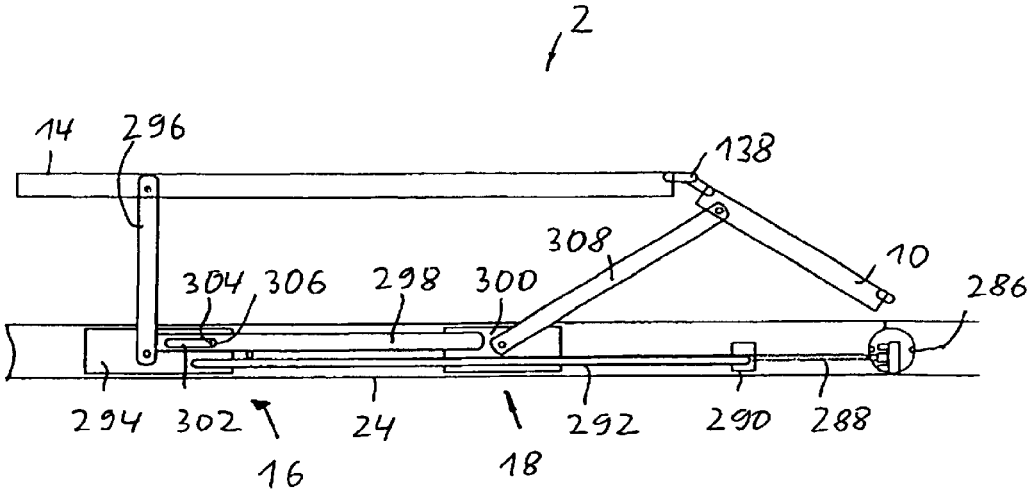
Figure 31E:
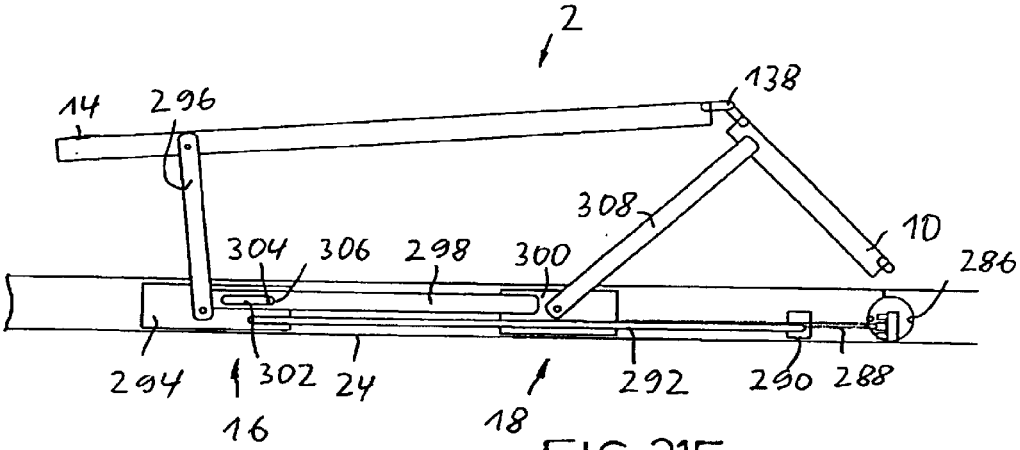
Figure 31F:
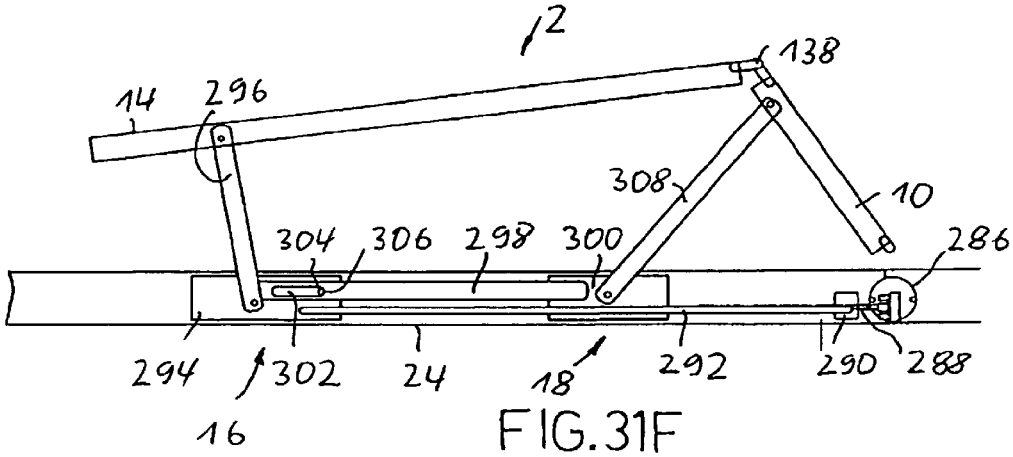

In the further course of the adjustment movement, the angle between the leg supporting element 10 and the lower leg supporting element 14 increases as is illustrated in FIGS. 31D and 31E until the second end position of the adjustment movement illustrated in FIG. 31F has been achieved.

Figure 32:
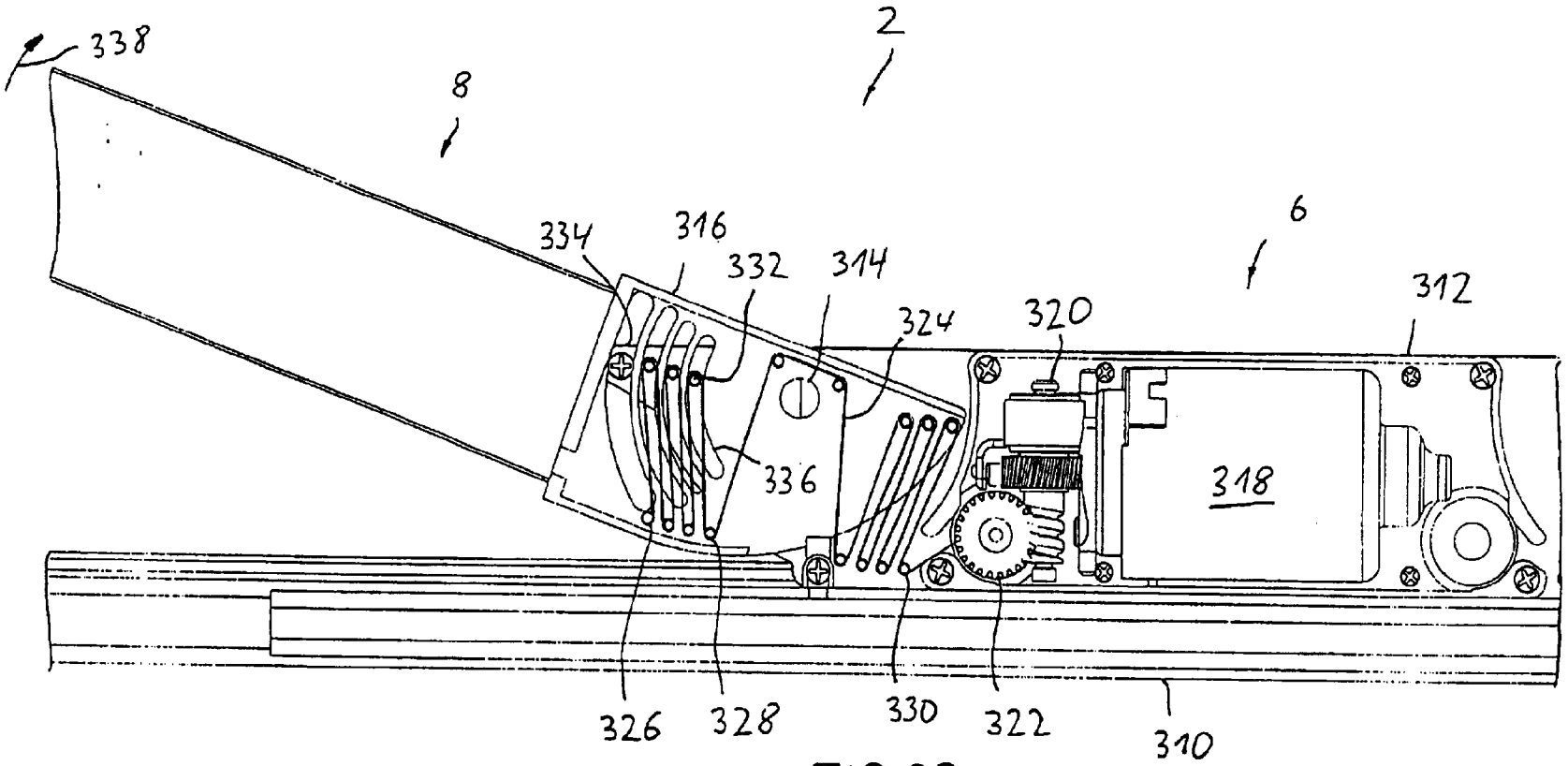
FIG. 32 shows a side view of a further embodiment of an inventive support device, whereby the walls of the longitudinal rails facing the viewer in FIG. 32 are omitted for illustration purposes, so that the elements of the adjusting device can be recognized.

FIG. 32 shows in a side view an additional embodiment of an inventive support device 2, on which the central supporting element 6 is arranged on a sub-frame 310, which forms the base body 4 of the support device 2.

The central supporting element 6 has longitudinal rails that are parallel to each other, and that are at a distance to each other, of which only one longitudinal rail 312 is illustrated in FIG. 32, and that is pivotably linked to a leg supporting element 8 around a horizontal pivot axis on a pivot bearing 314, which has longitudinal rails parallel to each other, and at a distance to each other, of which only one longitudinal rail 316 is illustrated in FIG. 32.

The longitudinal rails 314, 316 are constructed hollow in the area of their ends facing each other for receiving the elements of the adjustment device. In the embodiment the ends of the longitudinal rails 312, 316 are constructed as essentially closed hollow profiles, whereby for illustration purposes the wall of the longitudinal rails 312, 316 has been omitted in FIG. 32 so that the elements of the adjusting device can be recognized.

The adjusting device in this embodiment has an electric motor as the adjustment motor that is received by the longitudinal rail 312 and is linked to an interior wall. The adjustment motor 318 interacts in a pivot drive connection with a pivot driven winding element 322 by means of an angular gear 320, which is received by the longitudinal rail 312, and is pivotably linked around a pivot axis parallel to the pivot axis of the pivot bearing 314. The winding element 322 serves for the winding of a flexible pull element that is constructed of a flat ribbon 324 in this embodiment. The ribbon 324, the first end 326 of which is attached to an interior wall of the longitudinal rail 316, is successively fed over the longitudinal rail 312, and the turns assigned to the longitudinal rail 316 like a multiple rope pulley. The longitudinal rail 316 is assigned to a group of turn rollers that are linked to an interior wall of the longitudinal rail 316, and of which one turn roller is identified in FIG. 32 with the reference symbol 328.

A first group of turn rollers is assigned to the longitudinal rail 312 that are arranged on the side of the pivot bearing 314 that faces the adjustment motor 318, and of which one turn roller is identified in FIG. 32 with the reference symbol 330. Furthermore, a second group of turn rollers is assigned to the longitudinal rail 312, that are arranged on the side opposite of the pivot bearing 314 of the first group of turn rollers 330, and of which one turn roller is identified in FIG. 32 by the reference symbol 332. The turn rollers 332 of this second group are arranged on axis that are attached to an extension 334 of the longitudinal rail 312, which extends from the area of the pivot bearing 314 in the direction of the longitudinal rail 316. The axis of the turn rollers 332 extend into the interior of the longitudinal rail 316, whereby a recess is assigned to each axis that runs in a radius around the pivot bearing 314 in the adjustment direction, in this example in pivot direction, as is identified as a recess in FIG. 32 with the reference symbol 336, which is assigned to the axis of the turn roller 332.

The operation of this inventive adjusting device is as follows:

In order to adjust the leg support element relative to the central supporting element 6 in the direction of an arrow 338, the adjustment motor 318 drives the winding element 322 across the angular gear 320 in such a way that the winding element 322 winds the ribbon 324. This causes the distance between the turn rollers 332 at the longitudinal rail 312 and the turn rollers 328 at the longitudinal rail 316 to decrease so that the leg support element pivots around the pivot bearing 314 in the direction of the arrow 338 relative to the central supporting element 6. Due to the fact that the ribbon 324 is turned like in a multi-rope pulley, high forces can be exerted in this embodiment of the adjusting device, even with the use of a small, inexpensive electric motor. Furthermore, all elements of the adjusting device are received by the longitudinal rails 312, 316 that are constructed as hollow profiles at least in the area in which they face each other so that they are protected from damage, and are not visible from the exterior.

Figure 33:
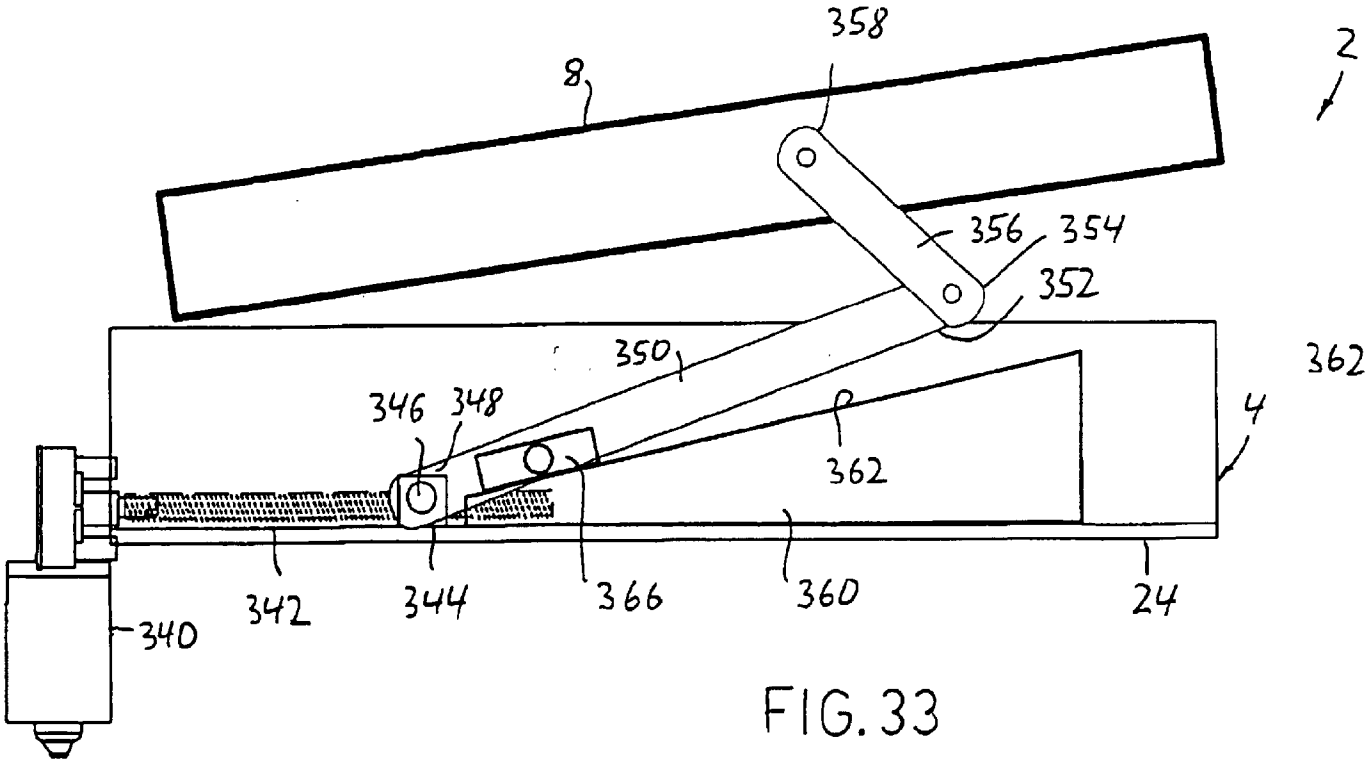
FIG. 33 shows an additional embodiment of an inventive adjusting device in the same manner as FIG. 23.

FIG. 33 shows a further embodiment of an adjusting device that has an adjustment motor 340, which interacts in a pivot drive connection with a pivot driven fixed spindle 342 that is received in the longitudinal rail 24 of the base body 4, on which a spindle nut 344 is pivot proof and movable arranged in axial direction. A first end 348 of a pivot lever 350 is connected to the spindle nut 344 around a pivot axis 346 parallel to the pivot axis of the upper body support element 8, the second end 352 of which is connected to the end 354 of an articulated lever 356, the other end 358 of which is pivotably linked to the upper body supporting element 8 at a distance to its pivot axis.

The adjusting device according to FIG. 33 further has a locally fixed actuator 360 that is received in the longitudinal rail 24, which is constructed in a ramp shape in this embodiment like a slanted level, and which has an abutting face 362 at an acute angle that is tilted toward the linear movement axis of the spindle nut 344.

Figure 34:
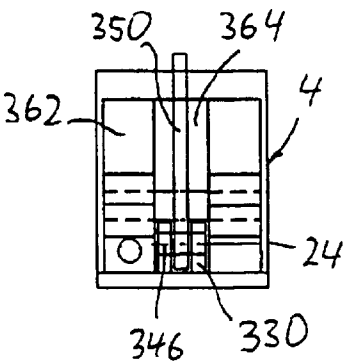
FIG. 34 shows a left view into FIG. 33 into the interior of the longitudinal rail of the support device according to FIG. 33.

FIG. 34, which illustrates a left view of FIG. 33 into the interior of the longitudinal rail 24, shows that the actuator 360 has a slot-shaped recess 364 in longitudinal direction of the longitudinal rail 24, the clearance of which is larger than the width of the pivot lever 350.

The pivot lever 350 has a plate-shaped abutting element 366 for the abutment on the abutting face 362 of the actuator 360, which is pivotably linked to the pivot lever 350 around an axis parallel to the pivot axis 346 in the area of the end 348 at a distance to the pivot axis 346.

In a first end position of the adjustment movement, in which the upper body supporting element 8 is not adjusted relative to the base body 4, the spindle nut 344 is positioned in FIG. 33 on the left end of the fixed spindle 342, whereby the abutting element 366 of the abutting face 362 of the actuator 360 is disengaged, and the pivot lever 350, as well as the end 354 of the articulating lever 356 are received by the slot-shaped recess 364.

In order to adjust the upper body supporting element 8 relative to the base body, the adjustment motor 340 drives the fixed spindle 342 in such a way that the spindle nut 344 in FIG. 33 moves to the right until the abutting element 366 abuts the tilted level formed by the abutting face 362 so that the pivot lever 350 pivots around its pivot axis, and thereby pivots the upper body supporting element 8 relative to the base body 4 by means of the articulating lever 356 as is illustrated in FIG. 33.

Figure 35:
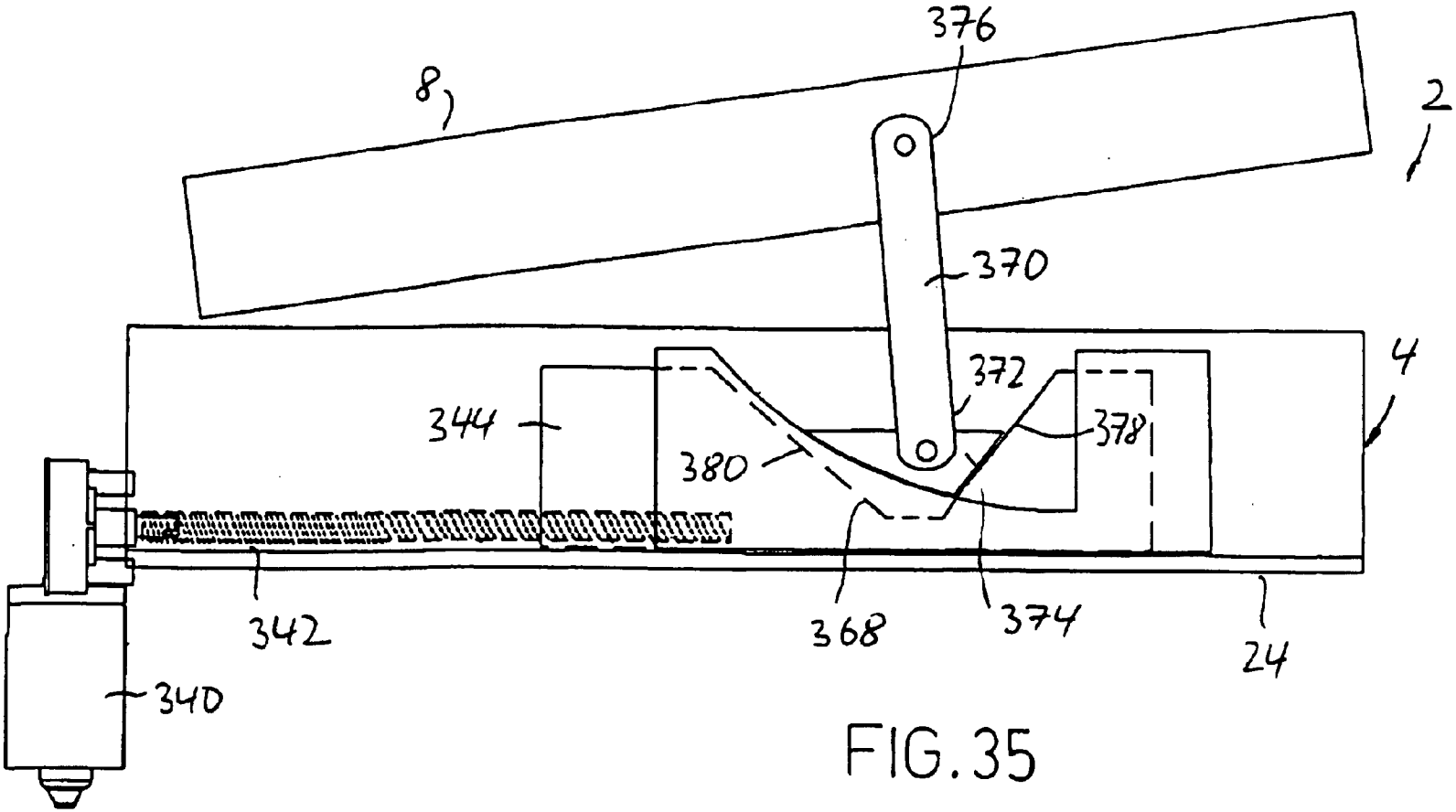
FIG. 35 shows an additional embodiment of an inventive adjusting device in the same manner as FIG. 33.

FIG. 35 shows an additional embodiment of an adjusting device that differs from the embodiment according to FIG. 33 in that an essentially trapeze-shaped recess 368 in the cross section is constructed on the spindle nut 344. In order to adjust the upper body support element 8, an adjustment lever 370 is intended, the one end 372 of which is pivotably linked to an abutting element 374 around an axis parallel to the pivot axis of the upper body support element 8, and the other end 376 of which is pivotably linked to the upper body supporting element 8 around an axis parallel to the pivot axis of the upper body supporting element 8 at a distance to its pivot axis.

FIG. 35 shows an adjustment position, in which the upper body supporting element 8 is tilted relative to the base body 4. In order to increase the tilt of the upper body support element 8, the adjustment motor 340 drives the fixed spindle 342 in such a way that the spindle nut 340 in FIG. 35 moves to the right. The abutting element 374 glides onto the wall 380 so that the upper body supporting element 8 continues to be pivoted by means of the adjustment lever 370. In order to reverse the upper body supporting element 8 from the adjustment position illustrated in FIG. 35 into a base position, in which it is not tilted relative to the base body 4, the adjustment motor drives the fixed spindle 342 in such a way that the spindle nut 344 in FIG. 35 moves to the left. As the drawing does not clearly show this, it is further explained that the spindle nut has a slot-shaped recess at its end opposite of the adjustment motor 340, in which the adjustment lever 370 can be received.

Figure 36:
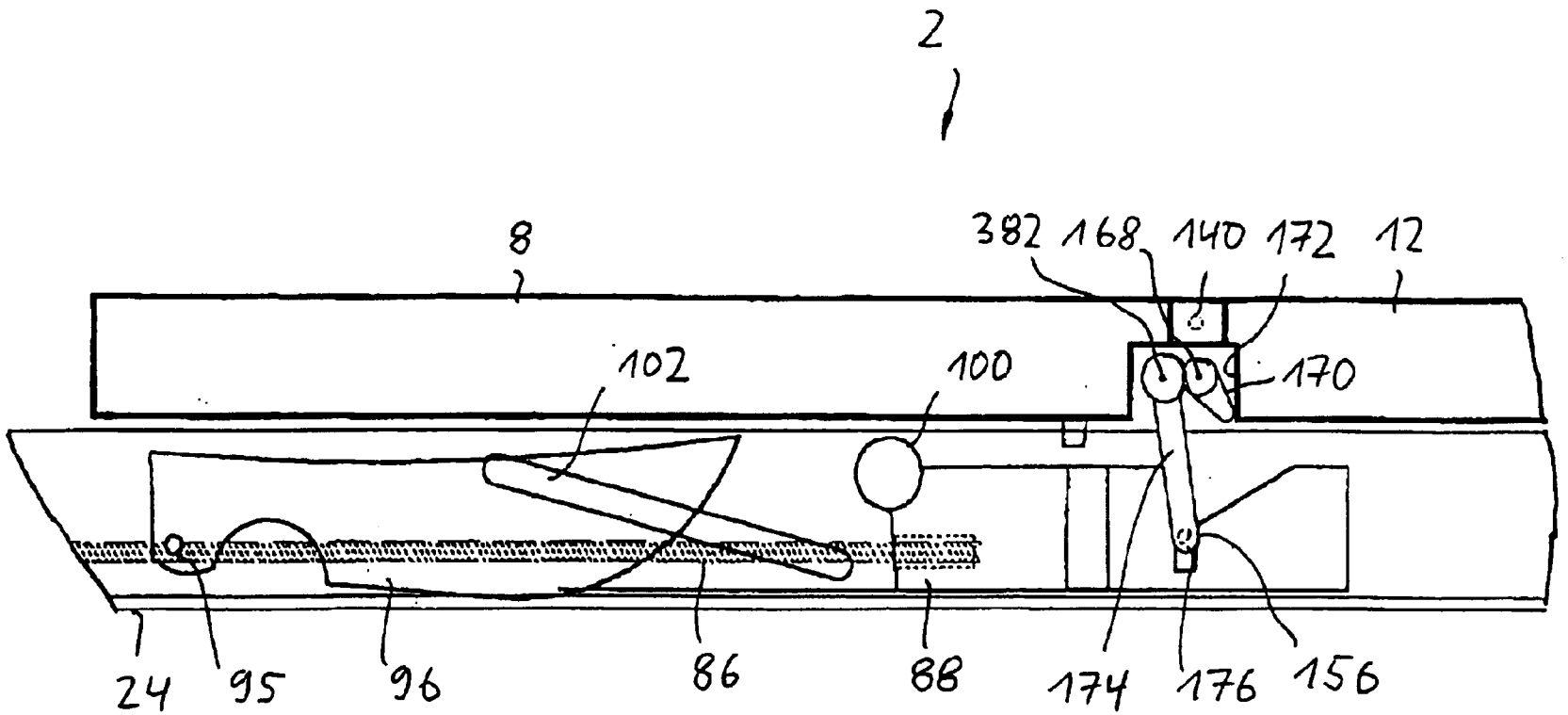
FIG. 36 shows a variation of the embodiment according to FIG. 11 in the same manner as FIG. 11.

FIG. 36 shows a variation of the adjustment arrangement for the adjustment of the head support element 12 relative to the upper body support element 8. This variation differs from the embodiment according to FIG. 11 especially in that the actuator lever 174 is not pivot proof linked to the eccentric 170, but instead is pivotably linked to the upper body supporting element 8 around a pivot axis 382 parallel to the pivot axis 168 of the eccentric 170. The actuator lever 174 has an interlocking system on its exterior surface at its end facing the pivot axis 382 that interacts with a complementary formed interlocking system on the exterior surface of the eccentric 170 in such a way that the eccentric 170 pivots with a turn of the articulating lever 174 clockwise in FIG. 36, in counter-clockwise direction around its pivot axis 168, and thereby adjusts the head support element 12 relative to the upper body support element 8.

Furthermore, this variation differs from the embodiment according to FIG. 11 in that the eccentric 170 is constructed in a cam-like fashion, and has a larger eccentricity than the eccentric in the embodiment according to FIG. 11.

Figure 37A:
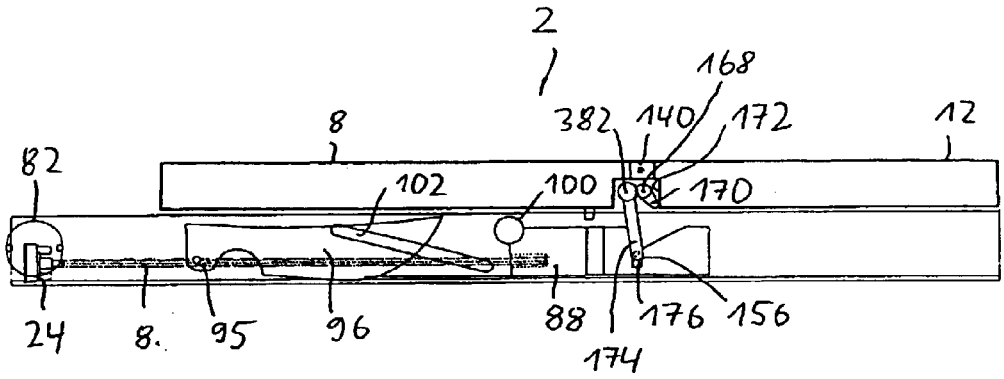
FIGS. 37A–37C shows the embodiment according to FIG. 36 in various adjustment positions in the same manner as FIG. 12.
Figure 37B:
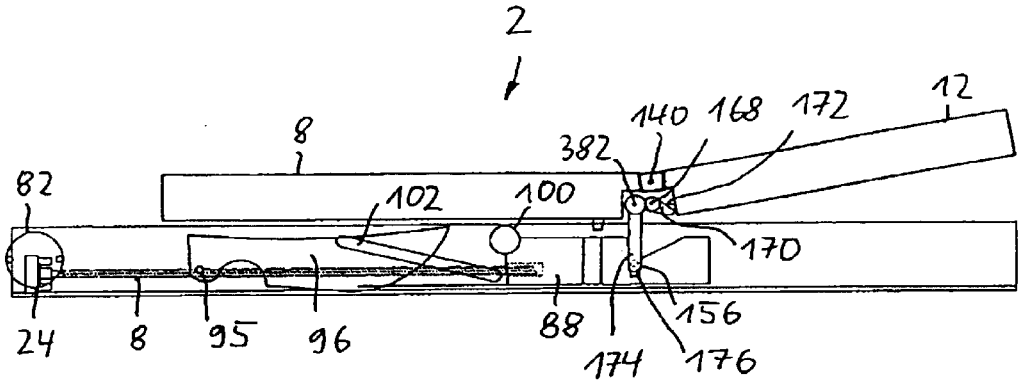

FIG. 37A shows a first end position of the adjustment movement, in which the head support element 12 is not adjusted relative to the upper body support element 8. In order to adjust the head support element 12 relative to the upper body support element 8, the adjustment motor 24 drives the fixed spindle 86 in such a way that the spindle nut 88 in FIG. 37 moves to the left. Here, the rear wall 158 of the guide 156 in the movement direction of the spindle nut 88 pushes the end of the articulating lever 174 so that the lever in FIG. 37 pivots in clockwise direction, and the eccentric 170 pivots in counterclockwise direction so that it adjusts the head support element 12 relative to the upper body supporting element 8 as is illustrated in FIG. 37B until the second end position of this adjustment movement illustrated in FIG. 37C has been achieved, and the end 176 of the articulating lever 174 is disengaged from the guide 156.

Figure 37C:
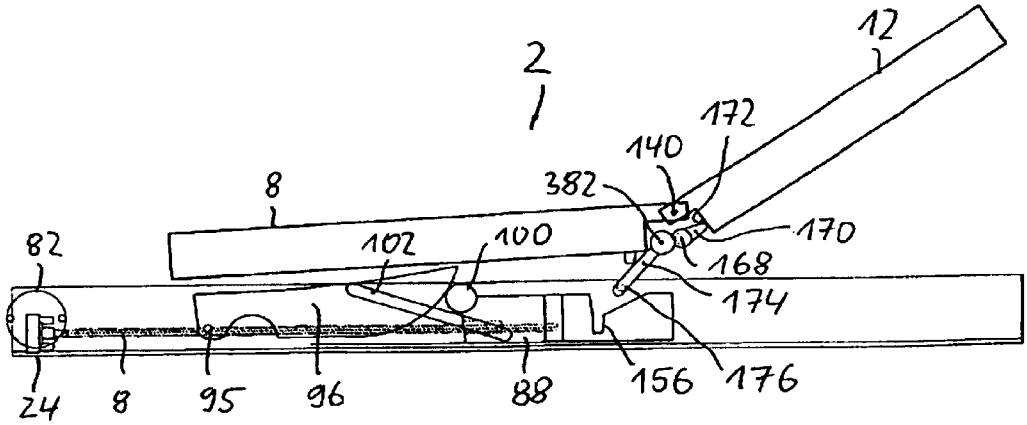

The second end position of the adjustment movement illustrated in FIG. 37C is a stable adjustment position due to its self-stoppage of the eccentric 170 so that a reverse turn of the eccentric 170 is prevented, and the head support element 12 also does not reverse even when stressed.

FIG. 38 shows an additional embodiment of an inventive adjusting device that represents a kinematic reverse, such as that of the embodiment according to FIG. 23 insofar as the movement axis of the abutting face that is tilted toward the movement axis of the drive element not illustrated in FIG. 38, that moves back and forth in the direction of a double arrow 384, is not constructed on the pivot lever that is identified in FIG. 38 by the reference symbol 386, but is instead constructed on an articulating element 388. In the embodiment illustrated in FIG. 38, the articulating element 388 has an abutting face 390 that is tilted toward the linear movement axis of the drive element, that is essentially level in this embodiment, to which the pivot lever 386 abuts with roller 392 arranged at a distance to its ends, and with which the pivot lever 386 interacts like a cam drive. In order to form the tilted abutting face 390, the actuator 388 is constructed in a ramp shape as tilted levels in this embodiment as is illustrated in FIG. 38A. In this embodiment, the abutting face 390 is tilted relative to the linear movement axis of the drive element at an acute angle of about 18°. However, the tilt of the abutting face 390 can be selected from a wide range corresponding to the respective requirements.

The pivot lever 386 is pivotably linked around an axis 394 parallel to the pivot axis of the upper body support element, at an interior surface of a longitudinal rail not illustrated in FIG. 38 of the base body, also not illustrated. The pivot lever 386 carries a roller 396 on its end opposite of the pivot axis 394, on which the upper body supporting element 8 is loosely positioned with its side facing the actuator 388. In order to pivot the upper body supporting element 8 relative to the base body, the not illustrated drive element moves the actuator 388 along the linear movement axis in FIG. 38 to the left so that the pivot lever 386 initially reaches the abutment at the abutting face 390 with its roller 392, and subsequently abuts the abutting face 329 constructed as a tilted level, and thereby pivots as is illustrated in FIG. 38B. Here, the toller 392 of the pivot lever 386 rolls onto the abutting face 390 to that only minimal friction occurs, and the wear of the abutting face 390 is therefore avoided.

Figure 38A:
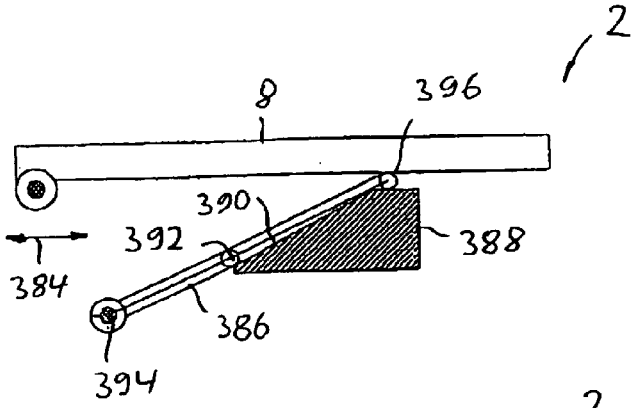
FIGS. 38A–38E shows a side view of an additional embodiment of an inventive adjusting device in various adjustment positions, whereby only the pivot lever and the actuator, as well as the upper body support element are illustrated for purposes of simplifying the illustration.
Figure 38B:
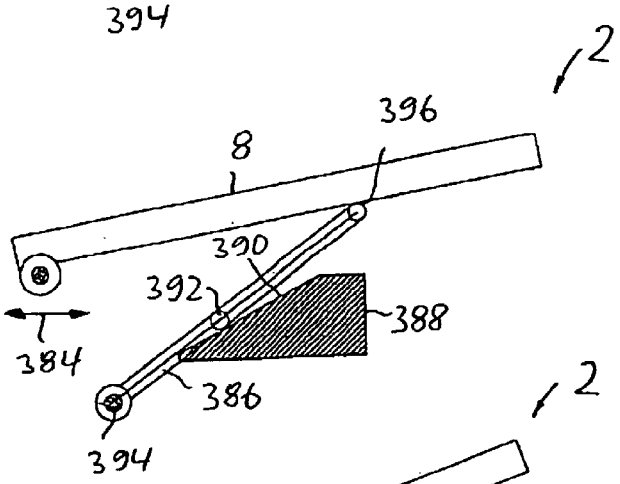
Figure 38C:
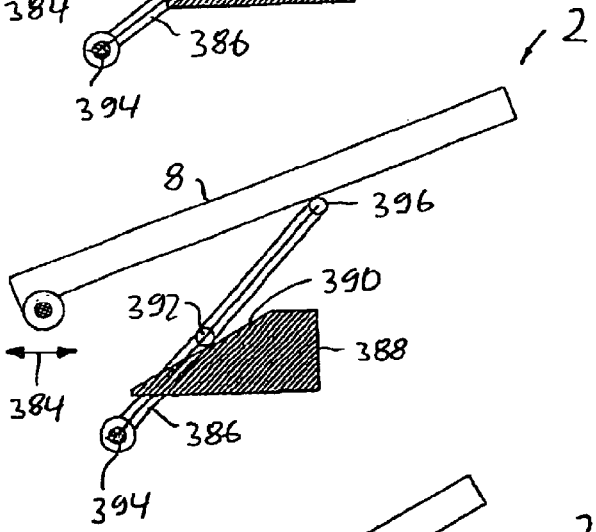
Figure 38D:
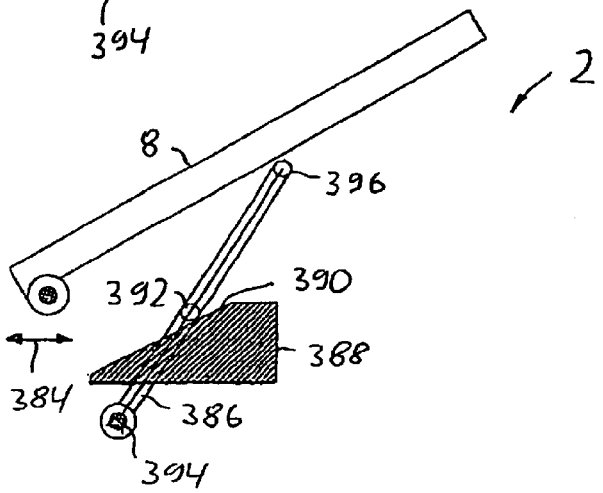
Figure 38E:
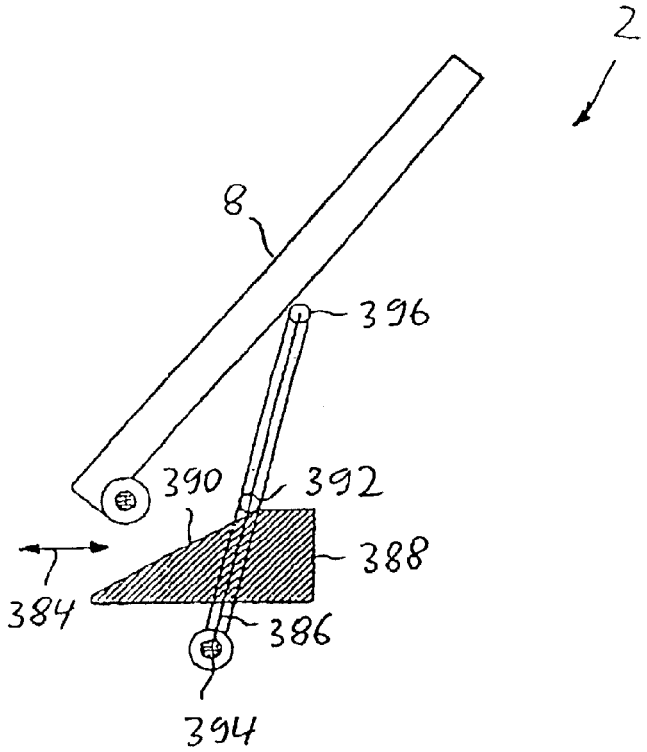
Figure 38F:
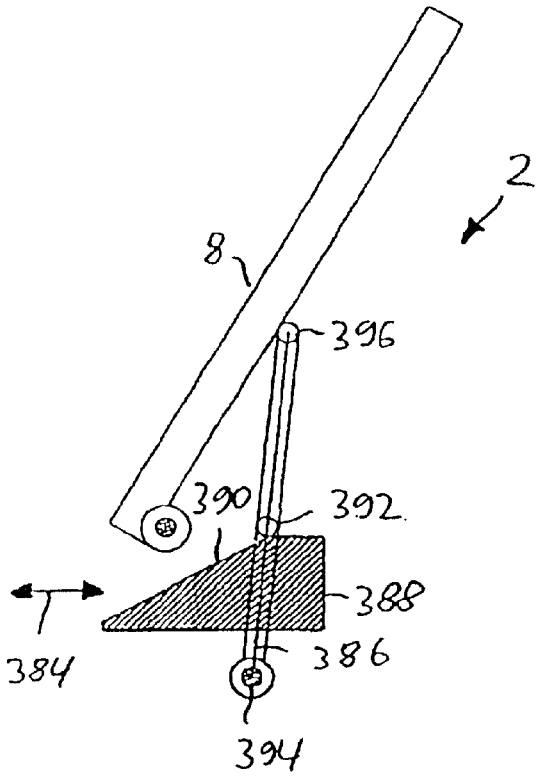

In the further course of the adjustment movement, the drive element moves the actuator 388 in FIG. 38 further to the left so that the pivot lever 386 continues to pivot as is illustrated in FIGS. 38C to 38E until the second end position of the adjustment movement illustrated in FIG. 38F has been achieved.

Corresponding to the respective requirements, the abutting face 390 can also be constructed bow-shaped in cross section, and either concave, or convex facing toward the roller 392, whereby the operating principle of a tilted level is maintained.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. Motor adjustable support device for the upholstery of one of a seat and a reclining furniture, comprising:

a) a base body having rails;

b) at least one adjustable support element adjustable relative to the base body:

c) an adjusting device for the adjustment of the adjustable support element relative to the base body; and d) at least one adjustment motor provided with the adjusting device, the adjustment motor being disposed, as viewed in side view, within the bounds of one of the rails.

2. Support device according to claim 1, wherein:

a) the adjusting device has at least one adjustment element that is adjustable between a first adjustment position and a second adjustment position, that interacts with the support element to be adjusted, and that is received by one of the rails in the first adjustment position, or in side view within the limits of one of the rails, and that protrudes over the one of the rails toward a support side in the second adjustment position.

3. Support device according to claim 2, wherein:

a) the adjusting device has an actuator movable relative to the adjustment element, the at least one adjustment element has an abutting face for abutment with the actuator, whereby the actuator moves back and forth relative to and along an abutting face of the adjustment element, and thereby adjusts the at least one adjustment element between its first adjustment position and its second adjustment position.

4. Support device according to claim 3, wherein:

a) the actuator moves linearly relative to the at least one adjustment element, and the abutting face of the adjustment element is tilted relative to the movement axis of the actuator.

5. Support device according to claim 3, wherein:

a) the abutting face of the at least one adjustment element is an essentially level surface.

6. Support device according to claim 3, wherein:

a) the abutting face of the at least one adjustment element in a cross section includes a bow shape configuration.

7. Support device according to claim 6, wherein:

a) the abutting face in a cross section to the actuator includes a convex configuration.

8. Support device according to claim 3, wherein:

a) the actuator is arranged in one of the rails, or in side view, within the limits of one of the rails.

9. Motor adjustable support device for the upholstery of one of a seat and a reclining furniture, comprising:

a) a base body having rails;

b) at least one adjustable support element adjustable relative to the base body, the adjustable support element including at least one rail;

c) an adjusting device for the adjustment of the at least one adjustable support element relative to the base body;

d) at least one of the rails being one of hollow and open on one side for receiving at least a part of the adjusting device; and e) the adjusting device including an adjustment motor, the adjustment motor being received by one of the rails which is one of hollow and open on one side.

10. Support device according to claim 9, wherein:

a) the adjusting device has at least one linearly movable drive element that moves back and forth.

11. Support device according to claim 10, wherein:

a) the linearly movable drive element interacts with the at least one adjustable support element for the adjustment of the same, and an element is provided that transfers a back and forth movement of the drive element in movement of the adjustable support element between its adjustment positions.

12. Support device according to claim 10, wherein:

a) the drive element is arranged in one of the rails, or in side view, within the limits of one of the rails.

13. Support device according to claim 12, wherein:

a) the rail, in which the linearly movable drive element is received, has a recess, through which a free end of one of an angle lever and an actuator lever extends in at least one adjustment position for the purpose of interacting with a guide.

14. Support device according to claim 10, wherein:

a) the linearly movable drive element includes a spindle nut disposed on a fixed spindle and movable in an axial direction.

15. Support device according to claims 10, wherein:

a) the linearly movable drive element is unpivotable, in an axial direction movable fixed spindle, on which a locally fixed, pivot driven spindle nut is disposed.

16. Support device according to claim 15, wherein:

a) the fixed spindle includes a threaded spindle, and the spindle nut has a female thread.

17. Support device according to claim 10, wherein:

a) the linearly movable drive element includes a guide that extends substantially laterally to the linear movement axis of the drive element, and into which one of a free end of an angle lever and a free end of an actuator lever engages at least in one adjustment position.

18. Support device according to claim 9, wherein:

a) at least one of the rails, at least in a section, is constructed as an open hollow profile toward a support side of the support element.

19. Support device according to claim 9, wherein:

a) at least one of the rails, at least in a section, is constructed as a closed hollow profile.

20. Support device according to claim 19, wherein:

a) the one of the rails has a recess toward a support side, in which the at least one adjustable support element is received in a first adjustment position, and through which the at least one adjustable element protrudes toward the support side in a second adjustment position.

21. Support device according to claim 20, wherein:

a) an adjustable support element is loosely positioned on an adjustment element associated with the at least one adjustable support element.

22. Support device according to claim 20, wherein:

a) the at least one adjustment element is an adjustment lever.

23. Support device according to claim 22, wherein:

a) the adjustment lever is a pivot lever that is pivotably linked toward the support side.

24. Support device according to claim 23, wherein:

a) the adjusting device has a drive element, and an element is provided that transfers a back and forth movement of the drive element into a pivot movement of the pivot lever between its adjustment positions.

25. Support device according to claim 23, wherein:

a) the adjusting device has at least one linearly movable drive element that moves back and forth; and b) the pivot lever is pivotably linked to one of the at least one linearly movable drive element and to a part that is connected to it.

26. Support device according to claim 23, wherein:

a) the pivot lever includes one of an angle lever and a bow-shaped lever.

27. Support device according to claim 23, wherein:

a) an angularly movable actuator is arranged between the pivot lever and one of the base body and a drive element, and the angularly movable actuator interacts with a stop unit during the course of the adjustment movement for pivoting of the pivot lever.

28. Support device according to claim 27, wherein:

a) the angularly movable actuator is responsive to pulling.

29. Support device according to claim 27, wherein:

a) the angularly movable actuator is responsive to pressure.

30. Support device according to claim 27, wherein:

a) the angularly movable actuator includes one of a lever and a rod.

31. Support device according to claim 27, wherein:

a) the angularly movable actuator is received at least in a first adjustment movement of the pivot lever by one of the rails, or in side view, within the limits of one of the rails.

32. Support device according to claim 27, wherein:

a) the pivot lever is directly or indirectly pivotably linked to the base body, a first end of the actuator is pivotably linked to the pivot lever around a pivot axis parallel and at a distance to the pivot axis of the pivot lever, and the stop unit is included on the linearly movable drive element, that abuts a second end of the actuator during the course of the adjustment movement in such a way that the actuator pivots around its second end during the course of the adjustment movement, and the pivot lever thereby pivots around its pivot axis.

33. Support device according to claim 27, wherein:

a) the pivot lever is pivotably linked to the base body, a first end of the actuator is pivotably linked to the drive element that pivots around a pivot axis parallel to the pivot axis of the pivot, lever, and a second end of the actuator is movable along a guide relative to the pivot lever, the stop unit is arranged at one end of the guide, onto which the actuator abuts with its second end during the course of the adjustment movement in such a way that the actuator pivots the pivot axis assigned to it, and the pivot lever thereby pivots around the pivot axis assigned to it.

34. Support device according to claim 27, wherein:

a) the pivot lever is pivotably linked to the drive element, a first end of the actuator is pivotably linked to the base body, around a pivot axis parallel and at a distance to the pivot axis of the pivot lever, and a second end of the actuator is movable along a guide relative to the pivot lever, a stop unit is arranged at one end of the guide, onto which the actuator abuts with its second end during the course of the adjustment movement in such a way that the actuator pivots the pivot axis associated with it, and the pivot lever thereby pivots around the pivot axis associated with it.

35. Support device according to claim 27, wherein:

a) the pivot lever is pivotably linked to one of a linearly movable drive element, a first end of the actuator is pivotably linked to the pivot lever around a pivot axis parallel and at a distance from the pivot axis of the pivot lever, and the stop unit is arranged on the base body, and against which a second end of the actuator abuts during the course of the adjustment movement in such a way that the actuator pivots around its second end, and thereby pivots the pivot lever around its pivot axis.

36. Support device according to claims 33 or 34, wherein:

a) the guide includes an elongated recess, in which the actuator engages with a protrusion.

37. Support device according to claim 36, wherein:

a) the longitudinal axis of the recess extends at an angle relative to a movement axis of the linearly movable drive element.

38. Support device according to claim 36, wherein:

a) the recess runs straight.

39. Support device according to claim 36, wherein:

a) the recess runs bow-shaped.

40. Support device according to claim 36, wherein:

a) the recess includes one of a groove and a slot.

41. Support device according to claim 9, wherein:

a) a one first rail of the base body, and a second rail of the base body at least in the area of their ends facing each other, are hollow, and a drive element is arranged in the first rail;

b) one of a rope, a ribbon, and a chain-shaped pull element is provided a first end of which is attached to one of the rails, and which interacts with the drive element is arranged in the first rail for the adjustment of the rails relative to each other; and c) the pull element is guided successively across at least one turn assigned to the first rail like a pulley, and at least one turn assigned to the second rail.

42. Support device according to claim 41, wherein:

a) the drive element includes a linearly movable drive element with which a second end of the pull element interacts.

43. Support device according to claim 42, wherein:

a) the second end of the pull element is attached to the drive element.

44. Support device according to claim 42, wherein:

a) the linearly movable drive element includes a further pull element, and exerts a pulling force on the pull element for the adjustment of the second rail relative to the first rail.

45. Support device according to claim 41, wherein:

a) a turn that is associated with the one of the rails, is arranged on an intermediary element that forms a force transmission connection to the one of the rails.

46. Support device according to claim 41, wherein:

a) the turns include turn rollers.

47. Support device according to claim 41, wherein:

a) the turns are received by the rails.

48. Support device according to claim 41, wherein:

a) at least one turn that is associated the rails includes an axis, or is disposed on an axis that extends into the interior of the rails by means of a recess in an adjustment direction, which recess is disposed in another one of the rails.

49. Support device according to claim 48, wherein:

a) the recess runs at a radius around the axis.

50. Support device according to claim 41, wherein:

a) the drive element includes a pivot driven winding element for the winding of the pull element, and on which a second end of the pull element is attached.

51. Support device according to claim 41, wherein:

a) the first end of the pull element is attached to the second rail, and at an interior wall of the second rail.

52. Support device according to claim 41, wherein:

a) the pull element is fed successively across turns associated with the first rail in the manner of a 4-rope pulley, and across turns associated with the second rail.

53. Support device according to claim 41, wherein:

a) the second rail can be pivoted relative to the first rail in such a way that the adjusting device comprises a pivot drive.

54. Support device according to claim 41, wherein:

a) a turn is associated with the one of the rails, and is disposed on the one of the rails on the interior wall of the one of the rail.

55. Support device according to claim 9, wherein:

a) the adjusting device has at least one electric motor as the adjustment motor.

56. Support device according to claim 9, wherein:

a) the support device has at least a first support element and a second support element for the plane support of the upholstery, the first support element and the second support element are pivotably linked, and can be pivoted relative to each other by the adjusting device.

57. Support device according to claim 56, wherein:

a) the first support element includes a center support element, and the second support element is constructed of an upper body support element, and a leg support element is provided that is pivotably linked to the center support element on a side opposite of the upper body support element, and that pivots around a pivot axis substantially parallel to a pivot axis of the upper body support element.

58. Support device according to claim 57, wherein:

a) a head support element is provided that is pivotably linked to the upper body support element on a side opposite the center support element, and that pivots around a pivot axis substantially parallel to a pivot axis between the upper body support element and the center support element.

59. Support device according to claim 57, wherein:

a) a lower leg support element is provided that is pivotably linked to the leg support element on a side opposite the center support element, and that pivots around a pivot axis that is substantially parallel to the pivot axis between the center support element and the leg support element.

60. Support device according to claim 56, wherein:

a) an adjustment position with a dead point for pivoting of the support elements relative to each other is associated with two neighboring support elements that can be pivoted relative to each other, and an actuator is provided that moves the adjustment position for the pivoting of the support elements relative to each other beyond their dead point into a stable adjustment position, in which a reverse operation of the support elements relative to each other into the base position is prevented.

61. Support device according to claim 60, wherein:

a) the adjustment position has a knee lever, the one lever arm of which is linked to the first support element, and the other lever arm of which is linked to the second support element.

62. Support device according to claim 61, wherein:

a) one of the lever arms of the knee lever is constructed as an angle lever, or is unpivotably linked to an actuator lever for defining an angle lever, whereby a free end of one of the angle lever and of the actuator lever can be moved back and forth for articulating the adjustment movement.

63. Support device according to claim 62, wherein:

a) a drive element for moving the free end back and forth is associated with one of the free end of the angle lever and the actuator lever.

64. Support device according to claim 60, wherein:

a) the stable adjustment position is an adjustment position, in which the support elements are pivoted relative to each other.

65. Support device according to claim 60, wherein:

a) an eccentric is provided that is pivotably linked to one of the support elements, and abuts the other support element in such a way that the support elements pivot relative to each other with the turn of the eccentric.

66. Support device according to claim 65, wherein:

a) an actuator lever is provided for the turning of the eccentric around its pivot axis, that is pivotably connected to the eccentric, a free end of which can be moved back and forth for turning of the eccentric.

67. Support device according to claim 9, wherein:

a) the reclining furniture includes a bed.

68. Support device according to claim 9, wherein:

a) the base body has at least two longitudinal rails that are parallel to each other and are at a distance to each other, and which are connected to each other by at least one cross rail.

69. Support device according to claim 9, wherein:

a) the support device includes a slat system.

70. Support device according to claim 9, wherein:

a) the base body includes in a frame.

71. Support device according to claim 9, wherein:

a) the adjusting device includes at least first and second adjusting devices, each adjusting device is associated with a support element for the adjustment of the same, and a mechanical coupling is provided that couples a movement of an element of the first adjusting device to the movement of an element of the second adjusting device in such a way that an adjustment movement of the first adjusting device for the adjustment of the associated support element is mechanically coupled to an adjustment movement of the second adjusting device for the adjustment of the associated support element.

72. Support device according to claim 71, wherein:

a) the coupling includes at least one coupling element that couples a turn of the element of the first adjusting device to a turn of the element of the second adjusting device, and couples the element of the first adjusting device unpivotably to the element of the second adjusting device.

73. Support device according to claim 72, wherein:

a) the coupling element includes a shaft.

74. Support device according to claim 72, wherein:

a) the coupling includes at least one coupling is received by one of the rails, or in side view, within the limits of the rail.

75. Support device according to claim 71, wherein:

a) the coupling includes at least one coupling element that couples the element of the first adjusting device offset to the element of the second adjusting device.

76. Support device according to claim 75, wherein:

a) the coupling element is one of rod-shaped and plate-shaped.

77. Support device according to claim 71, wherein:

a) the first adjusting device and the second adjusting device are associated with the same support element.

78. Support device according to claim 71, wherein:

a) the first adjusting device and the second adjusting device are associated with different support elements.

79. Support device according to claim 78, wherein:

a) the couplings are configured in such a way that the adjustment of the support element, to which the first adjusting device is assigned, substantially occurs at the same time as the adjustment of the support element, to which the second adjusting device is associated.

80. Support device according to claim 78, wherein:

a) the coupling is configured in such a way that the adjustment of the support element, with which the first adjusting device is associated, occurs at an offset to the adjustment of the support element, with which the first adjusting device is associated.

81. Support device according to claim 78, wherein:

a) at least one of the rails is a longitudinal rail configured for receiving parts of the adjusting device.

82. Support device according to claim 71, wherein:

a) the coupling is arranged in one of the rails, or in side view, within the limits of the rail.

83. Motor adjustable support device for the upholstery of one of a seat and a reclining furniture, comprising:

a) a base body having rails;

b) at least one adjustable support element adjustable relative to the base body;

c) an adjusting device, including an adjustment motor, for the adjustment of the adjustable support element relative to the base body;

d) at least one of the rails being a hollow rail and receiving substantially receiving the adjustment motor and at least a part of the adjusting device therein;

e) the adjusting device having at least one adjustable element that can be adjusted between a first adjustment position and a second adjustment position; and f) the at least one adjustable element interacting in the first adjustment position with the at least one adjustable support element to be adjusted, and the at least one adjustable element being received in the first adjustment position within the hollow rail, and the at least one adjustable element protruding in the second adjustment position over the hollow rail toward a support side.

84. Motor adjustable support device for the upholstery of one of a seat and a reclining furniture, comprising:

a) a base body having rails;

b) at least one adjustable support element adjustable relative to the base body;

c) an adjusting device moluding an adjustment motor, for the adjustment of the at least one adjustable support element relative to the base body;

d) at least one of the rails being one of hollow and open on one side for receiving substantially receiving the adjustment motor and at least a part of the adjusting device;

e) the adjusting device having at least one adjustable element that can be adjusted between a first adjustment position and a second adjustment position; and f) the at least one adjustable element interacting in the second adjustment position with the at least one adjustable support element to be adjusted, and the at least one adjustable element being received in the first adjustment position within the extent of the at least one of the rails, and the at least one adjustable element in the first adjustment position being invisible from the exterior of the at least one of the rails, and the at least one adjustable element protruding in the second adjustment position over the at least one of the rails toward a support side.

* * * * *